US006910313B2

(12) United States Patent
De Cardenas et al.

(10) Patent No.: US 6,910,313 B2
(45) Date of Patent: Jun. 28, 2005

(54) SYSTEM AND APPARATUS FOR AN AUTOMATED CONTAINER FILLING PRODUCTION LINE

(76) Inventors: Gilbert L. De Cardenas, 14940 Proctor Ave., Industry, CA (US) 91744; Kenneth N. Barker, 110 S. 250 West, Willard, UT (US) 84340

( * ) Notice: Subject to any disclaimer, the term of this patent is extended or adjusted under 35 U.S.C. 154(b) by 0 days.

(21) Appl. No.: 10/359,138

(22) Filed: Feb. 6, 2003

(65) Prior Publication Data

US 2004/0020163 A1 Feb. 5, 2004

Related U.S. Application Data

(62) Division of application No. 09/659,618, filed on Sep. 11, 2000, now Pat. No. 6,523,328.
(60) Provisional application No. 60/153,244, filed on Sep. 13, 1999.

(51) Int. Cl.[7] ..... B65B 57/00; B65B 51/10; B65B 7/28

(52) U.S. Cl. ..... 53/53; 53/75; 53/510; 53/167; 53/282; 53/329.3

(58) Field of Search ..... 53/53, 55, 75, 53/510, 167, 266.1, 267, 281, 282, 283, 329.2, 329.3, 76

(56) References Cited

U.S. PATENT DOCUMENTS 1,346,613 A * 7/1920 Taliaferro et al. ..... 53/281
2,183,433 A 12/1939 Rheinstrom (Continued)

FOREIGN PATENT DOCUMENTS

DE 4114889 A1 * 11/1992 ..... B07C/5/34
JP 63307005 A * 12/1988 ..... B65B/7/28

*Primary Examiner*—Stephen F. Gerrity
(74) *Attorney, Agent, or Firm*—Todd A. Vaughn, Esq.; William D. Breneman, Esq.; Breneman & Georges

(57) ABSTRACT

An automated container production line or automatically removing, orienting, filling, sealing and providing a label and applying a straw to the outside of the labeled container is provided which utilizes a novel orienting conveyor for receiving unoriented containers from a supply bin and orienting the containers for a plurality or novel short production lines having a positioning screw conveyor which intermittently starts and stops the advancement of the containers as groups of containers in which various groups of containers are simultaneously filled, sealed, inspected and then subsequently transported to a sleeving device for adding labels, a heat shrink tunnel for fastening the sleeve to the container and then to a novel straw applicator for subsequently attaching a straw to the outside of the container. The novel automated container filling, sealing and inspecting production line includes a computer program for controlling the production line in conjunction with various sensor devices for determining whether the containers are properly aligned, properly filled, properly sealed and completed in accordance with the highest quality control standards to not only assure product quality but also assure that containers not meeting specifications are removed from the production line and not processed further.

59 Claims, 59 Drawing Sheets

U.S. PATENT DOCUMENTS

| | | | | | |
|---|---|---|---|---|---|
| 2,571,036 | A | | 10/1951 | Heyne et al. | |
| 3,012,650 | A | | 12/1961 | Carter | |
| 3,189,171 | A | | 6/1965 | Miller | |
| 3,517,797 | A | | 6/1970 | Daleffectal | |
| 3,708,945 | A | * | 1/1973 | Klettke | 53/282 |
| 3,978,979 | A | | 9/1976 | Mezey | |
| 4,223,778 | A | | 9/1980 | Kontz | |
| 4,271,954 | A | | 6/1981 | Gosney | |
| 4,384,915 | A | | 5/1983 | Utsumi | |
| 4,572,758 | A | | 2/1986 | Wild | |
| 4,605,047 | A | | 8/1986 | Bausch et al. | |
| 4,662,154 | A | * | 5/1987 | Hayward | 53/53 |
| 4,691,496 | A | * | 9/1987 | Anderson et al. | 53/53 |
| 4,789,016 | A | | 12/1988 | Mihail | |
| 4,947,979 | A | | 8/1990 | Martin et al. | |
| 4,969,308 | A | | 11/1990 | Hakansson | |
| 5,033,254 | A | * | 7/1991 | Zenger | 53/53 |
| 5,037,366 | A | | 8/1991 | Yokoyama | |
| 5,406,772 | A | * | 4/1995 | Dinius | 53/167 |
| 5,673,533 | A | * | 10/1997 | Wang et al. | 53/53 |
| 6,205,743 | B1 | * | 3/2001 | Castellari | 53/53 |

* cited by examiner 143
163
141
157
161
155
149
147
153
167
165
177
175
171
169
165
143

Fig. 22
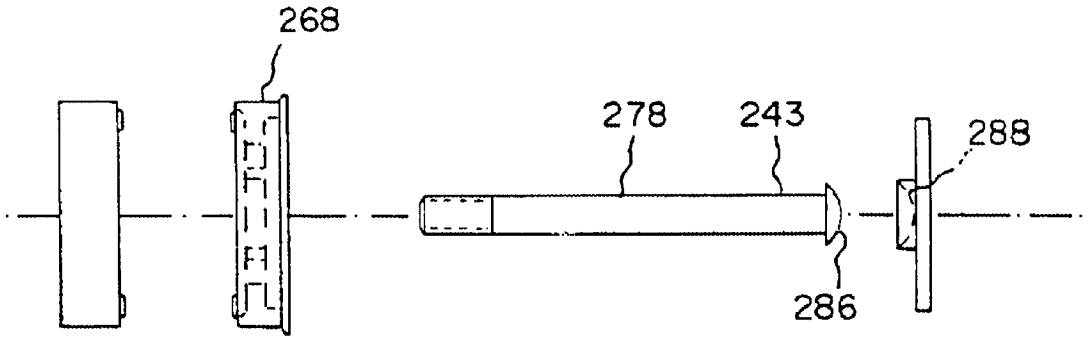
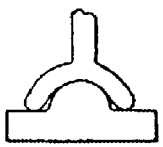
Fig. 22D

SYSTEM AND APPARATUS FOR AN AUTOMATED CONTAINER FILLING PRODUCTION LINE

CROSS-REFERENCE TO RELATED APPLICATIONS

This application is a division of U.S. patent application Ser. No. 09/659,618, filed Sep. 11, 2000, now U.S. Pat. No. 6,523,328, which application claims the benefit of U.S. Provisional Application No. 60/153,244, filed Sep. 13, 1999.

BACKGROUND OF THE INVENTION

1. Field of the Invention

The invention pertains to a method and apparatus for an automated container filling production line, which at one end has a supply of unoriented containers and at the other end provides a filled, sealed and consumer packaged end product. In the preferred application of the invention the filled, sealed and consumer packaged end product includes a wrapped telescoping straw attached to the outside of the container packaged for final consumer use.

More specifically, the invention relates to an automated container filling production line having continuous and discontinuous operating systems integrated together to form a seamless production line controlled by a computer and related software to automatically take unfilled, unoriented containers, orient those containers, fill, seal, inspect and remove unsatisfactory containers from the novel filling and sealing machine and then automatically transport properly filled and sealed containers to a sleever to automatically label the container, heat-shrink the sleeve to the container and optionally apply a pre-packaged straw to the outside of the container in the novel automated integrated container filling production line.

The novel method and system for the integrated automated container filling production line includes, in the preferred application, an infeed conveyor which includes a novel orientation conveyor to transport randomly oriented containers from a supply hopper and orient and provide a rough sequencing of those containers into a plurality of individual production lines that are introduced into a novel filling and sealing machine having a plurality of production lines. The novel orientation conveyor removes the randomly oriented containers from the supply bin and then orients and roughly sequences the containers into the plurality of production lines by utilizing the pliant orientation plates that imitate the action of the human hand in sequencing and orienting the containers in a 'bottom up' 'top down' orientation and then transports the 'bottom up' 'top down' containers to a turning plate and drop-chute which turns the 'bottom up' 'top down' container to a 'top up' 'bottom down' configuration in a plurality of production lines before transporting the oriented and roughly sequenced containers to the novel filling and sealing machine in the novel production line of the invention.

In an alternative application of the invention the integrated automated container filling production line includes an embodiment of the novel orientation conveyor which orients randomly oriented containers in a 'top up' 'bottom down' orientation and then roughly sequences the containers in a plurality of production lines by utilizing pliant orientation plates and pivotable rods that simulate the action of the human hand to orient and roughly sequence the containers in a plurality of production lines. The 'bottom down' 'top up' containers are transported in the orientation conveyor to a plurality of drop guide plates disposed in each of the plurality of production lines to assist in dropping the containers in a 'top up' 'bottom down' orientation in a plurality of drop chutes. The 'top up' 'bottom down' oriented and roughly sequenced containers are then deposited on an infeed conveyor that introduces the oriented and rough sequenced containers to a positive positioning screw conveyor having a plurality of production lines in a novel filling and sealing machine.

The novel filling and sealing machine of the novel production line of the invention receives a plurality of 'top up' 'bottom down' flat-bottomed containers from a conveyor that provides a rough sequencing of containers and introduces those containers to a positive positioning screw control conveyor system in a plurality of production lines in which positive conveyor control forces are maintained on the bottom and sides of the container in a screw conveyor that provides a discontinuous travel of the container to a plurality of filling and sealing stations in the novel filling machine. In one operational mode of the invention a plurality of screw conveyors receive a first plurality of oriented and roughly sequenced containers which are then positively engaged around the sides and bottom and then conveyed to the filling portion of the machine. At this point both the screw conveyor is stopped and the advancement of the containers is stopped by the positive controlled conveyor means at which time the first plurality of containers are filled with a filler mechanism providing for the positive control and metering of food, beverage or other fluid materials into the containers.

Once the containers are filled the positive controlled discontinuous conveyor apparatus moves those filled first plurality of containers to a sealing station while a second plurality of oriented, roughly sequenced containers are transported to the fill position previously occupied by the first plurality of containers. At this point the screw conveyor again stops and the first plurality of containers are purged of ambient air and sealed while the second plurality of containers are being simultaneously filled. Once the filling of the first plurality of containers and the sealing of the second plurality of containers has been completed the screw conveyor advances the first plurality of containers to an inspection station for fill and seal inspection and defective containers are optionally marked while the second plurality of containers are sealed in the sealing station and a third plurality of roughly oriented containers that had been transported to the fill station are simultaneously being filled while the screw conveyor remains stopped. At this point the first plurality of containers, inspected for fill and seal requirements, could also optionally be removed at the completion of inspection by opening discard doors at the bottom of the novel filling and sealing machine while the second plurality of containers are sealed and the third plurality of containers are filled.

Once the filling of the third plurality of containers, the sealing of the second plurality of containers and the optional inspecting and tagging of defective containers of the first plurality of containers are completed the screw conveyor again turns to transport the first plurality of containers from the screw conveyor to be removed at a defective container removal station in the novel filling and sealing machine or be discharged from the screw conveyor to be removed further down the production line while the second plurality of containers are transported to the inspection station, the third plurality of containers are moved to the seal station, and a fourth plurality of oriented and roughly sequenced containers are moved to the fill station and the screw conveyor again stops. While the screw conveyor remains stopped all the preceding steps are repeated on each new subsequent plurality of containers. In the preferred application of the invention the filling and sealing operations are provided for simultaneously on both sides along the axial length of a single screw conveyor while the screw conveyor is stopped. In the best mode inspection stations, reject stations and other processing stations may be added along the axial length of the screw conveyor.

The novel filling and sealing apparatus is able to achieve its multiple filling and sealing processes on both sides of a single screw conveyor as a result of the positive conveyor control forces maintained at all times to provide precise positioning of the plurality of containers resulting from the positive conveyor control of forces exerted by the threads of the screw conveyor on the walls of the container as well as the positive conveyor control of forces exerted on the flat bottom of the container and the sides of the container through the use of guide rails and rods or bottom support plates in combination with the threads of the screw conveyor to at all times maintain positive conveyor control forces on the containers along the axial length of the screw conveyor.

The positive conveyor control forces in the preferred embodiment are maintained throughout the transport of the container by the screw conveyor in the novel filling and sealing apparatus which allows additional inspection, rejection and processing steps to be implemented while the containers are being filled and sealed in the novel filling and sealing machine. These positive conveyor control forces in the preferred embodiment are maintained at all times during the discontinuous transport of the containers along the discontinuous operation of the novel positive control conveying means of the novel filling and sealing device of the novel production line.

The filled and sealed containers from the novel filling and sealing machine are thereafter transported to an accumulation conveyor and then to a sleever which sleeves the filled beverage containers which are thereafter transported to a heat tunnel for the final shrinking of the sleeves to provide labeled beverage containers. The sleeve labeled containers are then transported to a novel straw applicator which automatically attaches covered straws to the outside of the beverage containers as the labeled beverage container passes by the novel straw applicator apparatus. The straw applicator apparatus receives a continuous band of straws, advances those straws, cuts the straws from the band into individual sealed straws and, through a combination of vacuum and sequencing applies the individually wrapped straws to the outside of the container as it passes by the novel straw applicator device.

The novel production line is controlled by a computer and software which provides for the positive control of all phases of the novel production line including the monitoring and control of the production line to reject improperly filled or sealed containers by coordinating the sequencing of the containers in the novel automated container filling production line. As will be appreciated by those skilled in the art, the novel automated container filling production line and method of the invention integrates and controls continuous and discontinuous conveyor operations in a plurality of production lines in which the infeed conveyor, feed and orientation conveyors and accumulation conveyor are designed to operate continuously while the novel filler and sealer machine of the novel production line operates in a discontinuous 'stop and go' operation. The sleevers, and heat tunnels are also designed to operate in a continuous production process while the novel straw applicator apparatus includes a 'stop and go' operation in cutting and separating straws. These various operations are integrated into a continuous conveying operation which are controlled by a computer and related software in a downstream flow effect which by back pressure sensing and control increases or decreases the speed of the continuous and discontinous conveyor operations throughout the novel production line.

2. Description of Related Prior Art

The prior art includes numerous types of production lines, methods and apparatus for filling containers and provides these apparatus and methods for discreet operations. The invention, in contrast to the batch and discontinuous prior art processes, provides a full and complete integration of continuous and discontinuous conveyor and filling operations to take unfilled, unoriented containers at one end of the production line and provide filled, sealed and fully completed containers with a packaged straw applied to the outside of the filled sealed containers at the other end of the production line. Further, the individual novel components of the novel production line, including the orientation conveyor component, the novel filling, sealing and screw conveying apparatus, the novel straw applicator, the novel ambient air purging heat-sealing pistons, positive shut-off valves, straw applicator, conveyor belt and other subcomponents of the novel production line have not been shown or illustrated in the prior art.

More particularly, prior art relevant to the orientation conveyor component of the novel production line include Gosney U.S. Pat. No. 4,271,954 and Rheinstrom U.S. Pat. No. 2,183,433 which pertain to bottle orienting conveyor apparatus. In Gosney '954 unoriented bottles are obtained from a bin and oriented from an open end leading position to an open end trailing position for subsequent filling utilizing cams and mechanical devices for conveying the oriented bottles. Rheinstrom '433 provides for the division of oriented bottles in an 'open end up' configuration into a plurality of production lines. Neither Gosney '954 nor Rheinstrom '433 provide a conveying apparatus which receives unoriented containers or bottles from a supply bin and utilizes pliant plates simulating the action of the human hand to orient and provide a rough sequencing of the containers. Further neither Gosney '954 nor Rheinstrom '433 orients containers in a 'bottom up' 'top down' configuration and, once oriented and sequenced, subsequently turns the containers to a 'bottom down' 'top up' configuration for introduction into a filling and sealing apparatus.

Other prior art for conveying articles include Kontz U.S. Pat. No. 4,223,778 which pertains to a parison handling apparatus, Mezey U.S. Pat. No. 3,978,979 which pertains to a light bulb conveyor apparatus and Daleffe, et al. U.S. Pat. No. 3,517,797 which pertains to a thread bobbin tube alignment conveyor system. Kontz '778, Mezey '979 and Daleffe, et al. '797 do not provide for the utilization of pliant plates simulating the operation of the human hand for orienting and sequencing the articles in the conveyor, nor for the complete turning of the articles prior to their being introduced into a novel filling and sealing apparatus in the novel production line of the invention. Daleffe, et al. '797 does provide a conveying system which partially turns bobbins for subsequent stacking in an aligned position by Dalelfe, et al. does not utilize pliant fingers simulating the action of the human hand in orienting and providing a rough sequencing of articles in a production line utilizing continuous and discontinuous conveying systems.

Prior art relevant to the novel conveying, filling and sealing apparatus includes Heyne, et al. U.S. Pat. No. 2,571,036 and Martin et al. U.S. Pat. No. 4,947,979 which represent conveying devices utilizing spiral timing devices for advancing containers in a processing machine. In Heyne, et al. '036 the spiral timing device provides a continuous operation of the spiral timing device in which the spiral timing devices provides for the spacing of the article necessary for the synchronized feed of the article and in Martin, et al. '979 the spiral timing device provides a dwell for the containers at one or more work stations while the containers remain engaged between the rotating feed screws. Unlike Heyne, et al. '036 and Martin, et al. '979 the present invention provides a positioning device rather than a pure timing device. The invention utilizes both sides of a screw conveyor and exercises positive control over the containers on both sides of the screw conveyor to provide multiple work stations along the length of the conveyor. Further the screw conveyor of the invention operates in a start stop fashion and does not provide a dwell or a different sequencing for the containers for only one work station.

The novel filling and sealing machine of the invention provides a positive control conveyor means to capture the sides of containers between threads of the screw conveyor and guide rails (or support plates at the sealing area) both at the sides and bottom to provide a consistent spacing of containers in a discontinuous non-dwelling operation in which the containers are advanced and stopped in a plurality of production lines at precise locations disposed in substantially perpendicular alignment to the screw conveyor. The precise control and stopping of the screw conveyor at simultaneous filling and sealing stations above the screw conveyor for the filling and sealing of a plurality of containers is provided by the novel positioning screw conveyor apparatus of the invention.

Bausch, et al. U.S. Pat. No. 4,605,047 utilizes a conveying device that starts and stops the advancement of containers in a production line. Bausch et al. '047, however unlike the present invention, does not utilize a conveyor device having uniform pitch along the conveyor worm and does not provide multiple work stations or provide constant positive conveyor control forces over the container for both a fill and seal position disposed axially along the length of the worm conveyor. In Bausch, et al. '047 the worm threads are not of consistent pitch since the worm threads include a rest zone to provide positioning of the articles below a filling place or utilizes a reverse turn of the conveyor to remove forces from the container. The Bausch, et al. '047 worm threads may also utilize flat spaces or recesses in the worm which reduce the radius of the worm over part of the circumference of the worm to provide a rest zone in the conveying apparatus.

In addition Baush, et al. '04' does not provide the constant positive control required for the simultaneous filling of one group of containers on the conveyor line along with the simultaneous purging and sealing of another group or containers along the conveyor line as is accomplished in accordance with the novel screw conveyor filling and sealing device of the invention. This difference is particularly important where the filling and sealing operations require different control tolerances. More particularly, the tolerance for the filling operation is far less critical than for the simultaneous sealing operation which in filling and foil sealing operations requires a tolerance of about one thirty thousandth of an inch.

Other spiral conveying mechanisms such as Carter U.S. Pat. No. 3,012,650 like Heyne, et al. U.S. Pat. No. 2,571,036 and Mihail U.S. Pat. No. 4,789,016 provide for the continuous movement of articles along the conveyor as opposed to the discontinuous advancement of articles to a plurality of independent work stations along the length of the screw conveyor. Further the invention, unlike the prior art, maintains positive control over the container during their entire residency at the fill and seal positions in the screw conveyor which makes the multiple work stations possible utilizing the novel filler and sealer apparatus of the novel production line of the invention.

Prior art relevant to the novel straw applicator apparatus of the invention includes Miller U.S. Pat. No. 3,189,171 which illustrates a telescoping straw (FIG. 2), without a poseable neck that is taped to the too of a container. Miller does not illustrate a mechanism for attaching the pre-packaged straw to the container. Other prior art which is more relevant to the machinery for the attachment the pre-packaged straw to a container includes Yokoyama U.S. Pat. No. 5,037,366, Hakansson U.S. Pat. No. 4,969,308, Wild U.S. Pat. No. 4,572,758 and Utsumi U.S. Pat. No. 4,384,915. Such prior art straw applicator apparatus typically rely upon drums (Yokoyama '366) and mechanical arms as illustrated by Yokoyama '366 and Hakansson '308 to attach straws to containers. Wild '758 employs a mechanical plate to press straws up against the side of the container in a batch process.

The invention unlike the prior art is designed to apply straws on a conveyor assembly line utilizing a combination of elastomeric belts, one of which belt includes openings for holding pre-packaged straws in a predetermined position and a vacuum to hold the straw in the belt prior to its being attached to the container. The straw containing an adhesive is then released around a roller disposed perpendicular to but parallel to the continuous travel of the conveyor on which the container is disposed to provide an on demand straw application apparatus.

Other straw applicator devices such as Hakansson U.S. Pat. No. 4,969,308 provides an intermittently pivotable mechanism to pick up individual straws from a drum and then transfer the individual straws to a conveyor mechanism having a vacuum holding mechanism. The vacuum holding mechanism however transfers the straws to a mechanical pivoting arm on a chain to pressure position the individual straws on continuously moving containers. The present invention unlike Hakansson '303 applies straws on demand to containers on a conveyor belt utilizing a plurality of conveyor belts which utilizes a vacuum chamber in combination with a specially designed elastomeric belt for holding the straws until the straws are applied to the outside of the container.

Utsumi U.S. Pat. No. 4,384,915 employs a drum together with a cam gripper with an electric heater to heatbond a straw to the outside package as the package is moved on a continuous conveyor. The invention unlike Utsumi '915 utilizes a combination of an elastomeric belt together with a vacuum to apply the straw to the outside of the container without the necessity of heat sealing the individual wrapped straw to the outside of the container.

Unlike the prior art the novel system and method of the invention provides for the complete automation of a production line controlled by computer software which integrates continuous and discontinuous operations and controls all aspects of the filling, handling, sealing and straw application to a container in combination with an on demand straw application process without requiring exact mechanical timing links and without requiring a batch handling process. The novel method and apparatus of the invention achieves its advantages through the application of a computer control system for increasing and decreasing various phases of the production conveyor systems by increasing or decreasing various continuous and discontinuous processes in the conveyor flow by coordinating individual production rates based upon design production flow rate and backlog at various stages of the production line.

As a result limitations exist in the prior art related to orientation and sequencing conveyors, filling sealing apparatus as well as the apparatus for applying on demand straws to the outside of a container to provide a finished article. Further the prior a failed to provide a fully automated, completely controlled production line facility for taking unoriented containers, orienting and sequencing those containers, filling and sealing those containers, as well as applying sleeves, labels and applying a straw to the outside of the container to provide a finished product in a fully automated and integrated system to reduce the number of handling steps and provide a hygienic food handling production line which reduces the possibility of contamination of the food product through handling as well as providing an easy to clean, continuous production line for producing a filled food container.

There also exists a need in the prior art for a feed and orientation conveyor for hygienically and automatically handling unoriented containers and orienting and providing a rough sequencing of those containers in a way that simulates the action of the human hand without the necessity of human intervention to provide a hygienic handling of the containers and a rough sequencing of those containers in a plurality of individual production lines which can be fed into a machine for filling and sealing a food or other flowable or fluid product.

The limitations of the prior art also make it desirable go provide a single filling and sealing machine which receives a plurality of oriented containers in a plurality of production lines and advances those containers in a precise discontinuous conveying process whereby a plurality of he production line containers are precisely advanced and precisely stopped at predetermined locations in he production line so that one batch of a plurality of containers can be simultaneously filled while a second batch of containers in the same plural production lines can be simultaneously purged and sealed as the precisely controlled conveying mechanism remains stopped for a predetermined period of rime. The positive control further allows for the simultaneous inspection and simultaneous rejection of containers in a single Production line that allows a number of processing steps to be accomplished simultaneously.

The limitations in the prior art also have created a need for a novel straw applicator which positively engages a prepackaged straw and applies the prepackaged straw to passing containers on a production line in an on demand time basis to provide a final product. The novel straw applicator can be controlled by the computer but in the best mode of the invention is a stand alone unit that applies straws on demand to filled, sealed, inspected and sleeved containers. The novel straw applicator includes a novel straw applicator belt for applying straws to filled, sealed and labeled containers as they contact the novel straw applicator belt.

The limitations in the prior art also have established the need for an entire production line controlled by computer control to precisely control the entire production line from the hygienic collection of unoriented containers, the hygienic orientation and sequencing of those containers as well as the hygienic filling and sealing of those containers. The computer control of the production line also provides or the control of the sleever for adding sleeves to the container as well as the heat tunnels for firmly fixing the sleeve to the container in the production line to result in a final product that has been produced with minimum human contact in a hygienic production line for providing a final food product. The computer control of the production line and software for maintaining the operation of the novel production line and novel orientation and infeed conveyors, filler and sealer apparatus and sleever and heat tunnels is achieved by utilizing backflow pressure techniques which manage the entire production line in a real time or near real time mode by increasing or decreasing various phases of the conveyor production line as it is needed to produce a final packaged food product.

SUMMARY OF THE INVENTION

The invention provides a novel method and apparatus for a container filler production line which at one end takes unoriented containers and at the other end provides a final filled product that includes computer control of a conveyor line having continuous and discontinuous modes of operation as well as product flow rates. The novel production line and method of the invention include novel apparatus including a novel container unscrambler which hygienically handles unoriented containers, a novel further sealer machine which hygienically fills and seals those containers, novel heat sealing ambient air purging pistons, novel positive control shut-off valves, accumulation conveyors together with a computer which adjusts rates of low between continuous and discontinuous production line operations in the novel production line. A novel straw applicator and novel straw applicator conveyor belt is also provided for applying straws in an on demand time frame to the outside of the filled and sealed containers. The entire production line other than the novel straw applicator is controlled by computer and related software to integrate and vary the speeds of continuous and discontinuous conveying portions of the production line to maintain flow from the container unscrambling device to the packing of the filled, sealed, inspected and consumer packed product into shipping cartons. In addition the features and advantages of the novel production line include the hygienic handling of the containers from the time they are received from the container bin to the packaging of the final product by eliminating human intervention in the production process while providing for ease of cleaning of various components in the novel production line.

The container unscrambler is designed to take unoriented containers from a supply bin and orient and roughly sequence those containers utilizing pliant plates which simulate the action of a human hand in orienting those containers. In one embodiment of the invention the rough sequencing of the oriented containers are oriented in a 'top up' configuration where the containers have a top of a cross-sectional configuration that is larger than the cross-sectional configuration of the bottom half of the container. In the preferred embodiment of the invention containers having a larger bottom half cross-sectional configuration are first oriented in a 'bottom up' 'top down' configuration. The 'bottom up' 'top down' oriented containers are hen roughly sequenced and advanced to a turning plate for turning the containers from a 'bottom up' 'too down' configuration to a 'bottom down' 'top up' configuration before they are deposited through a drop chute on to an infeed conveyor and then to the novel filling sealing machine. In both embodiments of the invention the bottle unscrambler and orientation conveyor provides a plurality of production lines which are designed to hygienically handle, orient unoriented conveyors and provide a rough sequencing of the containers for the novel filler sealer machine. The novel container unscrambler is designed to provide a rough sequencing utilizing a plurality of resiliently mounted plates simulating the action of the palm of the hand and pivotable rods that simulate the action of the fingers in providing a rough sequencing of containers for the novel filler sealer machine.

The novel container unscrambler is, in the preferred application, designed to provide four separate production lines, each capable of operating independently and each having a clutch assembly to allow them to operate at a different rate of speed or to be individually stopped. This independent rate of operation is achieved through sensors, a computer and computer-controlled clutches which individually control the speed of each of the lines base upon downfeed sensors which increase or slow the rate depending upon the flow characteristics of the containers in that production line and the specific needs of the production line without the necessity of shutting down the entire production line.

The conveyor action in the bottle unscrambler is provided by elastomeric conveyor belts connected to pulleys that support either side of a container and preferably a container of a cylindrical configuration having a base larger than the top and advance the container along the conveyor by means of the elastomeric belts. The elastomeric belts advance and provide a rough sequence for the containers and in the preferred embodiment orient in a 'bottom up' 'too down' configuration until they are advanced to a turning plate which turns the containers from a 'bottom up' 'top down' position to a 'top up' 'bottom down' configuration just before they are deposited through a drop chute for placement on an infeed conveyor to the novel filler and sealer machine. The infeed conveyor in the preferred embodiment is also connected and utilized by the computer similar to the accumulator conveyor to increase and decrease the speed of the orientation conveyor and elevator conveyor to provide additional control over the speed of the novel production line.

The bottle unscrambler and orientation conveyor in both embodiments obtain unoriented containers from supply hopper by the utilization of an inclined elevator conveyor having container support plates which remove cylindrical containers from a supply hopper. The removed containers are randomly oriented on the support plates which may include an excess of containers on the container support plate. Excess containers on a particular support plate are removes from the inclined elevator conveyor by means or a scraper plate which prevents too many containers from being fed into an infeed hopper connected to the orientation conveyor.

The infeed hopper of the orientation conveyor receives the unoriented containers from the inclined elevator support plates and begins the process of orienting and providing a rough sequencing of the containers in the preferred embodiment in a 'bottom up' 'top down' configuration in a plurality of parallel production lines in the orientation conveyor. The containers deposited in the infeed hopper by the combination of gravity and conveyor action of the elastomeric belts of the orientation conveyor allows containers to either fit into the plurality of conveyor lines in a 'top down' 'bottom up' configuration or fall between the plurality of lines when too many containers are bunched up at one time in the elastomeric belts and in the infeed hopper. The conveying motion of the elastomeric belts allows the containers to orient themselves before flowing out of the infeed hopper along the plurality of production lines.

Containers that are properly oriented in the preferred embodiment in a 'bottom up' configuration or in the alternative embodiment in a 'bottom down' configuration may also be bunched up too close together in any one production line to be properly sequenced for the filling and sealing machine further down the production line. In such case a plurality of pliant plates which simulate the action or human hands push excess containers along the orientation conveyor line until they have the proper rough sequencing and spacing between the containers as they move along the orientation conveyor. Drop chutes are provided at the end of each of the production lines of each of the orientation conveyors. In one embodiment a plurality of drop guide plates assist in guiding containers in a 'top up' 'bottom down' orientation into the drop chutes. In the preferred embodiment 'bottom up' 'top down' oriented containers contact turning plates before being deposited into the drop chutes to provide containers in the 'top up' 'bottom down' orientation for the novel filler and sealer machine. The novel feed and orientation conveyors also include individually controllable means that can slow down or stop the conveying action of a particular lane depending upon the flow characteristics of the oriented containers through the novel filling and sealing apparatus and flow characteristics and requirements of he various production lanes down to the completed filled, sealed, labeled and straw containing product.

The novel filling and sealing apparatus includes an infeed conveyor for feeding the oriented and roughly sequenced containers to three pair of screw conveyors for positively engaging and then precisely moving a plurality of containers in the novel filler sealer apparatus. The screw conveyors are preferably made of Delrin® and have a uniform thread angle from end to end which together with guide tails and container biasing rods and flat plates in the seal position precisely position and move a plurality of containers through the novel filling sealing machine. The uniform thread angle of the screw conveyor provides a precise positioning means for a plurality of work stations disposed in substantial perpendicular alignment with spaces between the threads of the screw conveyors, when the screw conveyors are stopped, at a plurality of work stations disposed along the length of the novel screw conveyors of the filler sealer machine.

The novel filling sealing machine turns the screw conveyors in a discontinuous operation so that a plurality of containers move in a spaced relationship defined by the uniform spiral angle of the threads of the screw conveyor to precise positions and work stations within the novel filler sealer machine. Teflon® guide rails are provided on the sides opposite the screw conveyor and base support rods or plates at the seal area both reduce friction for plastic containers and aid in the precise positioning and movement of the containers through the machine and during the stopping and starting of the screw conveyor.

The screw conveyor provides a plurality of lanes in which containers along the length of the screw conveyor are in a precise positional relationship to one another and in relation to the spiral distance between each axial section of the screw conveyor. This spaced relationship allows the incremental advancement of the screw conveyor to precisely move a plurality of containers and stop the motion of the plurality of container in precise positions along the length of the screw conveyor. This also allows a plurality of containers along the length of the screw conveyor to be filled in one portion along the length of the screw conveyor while another group of containers further along the length of the screw conveyor are simultaneously purged and sealed at another area along the length along the screw conveyor. Associated with the filling area are a plurality of sensors that sense the presence of a container in the screw conveyor corresponding to the fill position of each container. In the event a container is not present at a particular fill area, the fill meter piston for that position is not activated to prevent spilling or wasting fill materials.

In one embodiment of the invention the screw conveyor is turned to advance containers to a fill station and advance containers at the filling station to be advanced to a fill inspection station while the sealed containers are moved to a seal inspection station and previously inspected containers are removed from the production line at a reject station that failed either seal inspection or fill inspection. At this point the new set of containers are filled, the previously filled containers are inspected for fill, the previously inspected containers for fill are being sealed, and the containers at the reject station are being removed for improper fill or seal. After the screw conveyor again starts, it advances a second set of new containers to the filling area, the filled containers to the inspection area, the inspected containers to the seal area and the sealed containers to the seal inspection area, and the container previously inspected for fill and seal are moved to a reject area to be rejected for improper fill or seal. When the screw conveyor again turns, the containers having a proper fill and seal are conveyed from the novel filling and sealing machine while the preceding containers are moved to the new stations in a continuation or the filling sealing production process.

The novel screw conveyors and their incremental advancement and positioning of the containers at various stages along the novel filling and sealing apparatus of the invention allows the novel apparatus to be divided into a plurality of precise work stations disposed in axial and substantially perpendicular alignment to the screw conveyor. The first work station is the filling station which provides for the precise metering of a beverage, food material such as baby food, yogurt or a yogurt beverage or other flowable product into the container at the filling portion of the screw conveyor.

In a further embodiment of the invention multiple inspection and rejection positions can be provided where containers are filled and a few turns of the screw conveyor advances a new set of containers to the fill station and the filled containers to an inspection area where the filled containers are inspected with sensors to determine whether they have been filled to a proper level. While the filled containers are being inspected for proper filling the new set of containers advanced to the filling area are being simultaneously filled.

The novel screw conveyor then turns again and then stops again to advance a new set of containers to the fill area, the filled containers to the inspection area and the inspected containers to a drop area where drop doors open to drop one or more of the containers into a discard bin, if any of the containers have not been filled to the proper level. Thereafter the novel screw conveyor turns again to advance a new set of containers to the fill area, filled containers to the inspection area and precisely move in position only the properly filled containers to a sealing station which surge the properly filled containers of ambient air and replaces the ambient air with nitrogen, moves a shuttle plate to move sealing foil to a position above only the properly filled containers present in the production line and heat-seals the foil to the container while the previously filled and inspected containers are placed over the reject door and rejected if they have not been properly filled, the previously filled containers are being inspected and the new set of containers are being filled.

Thereafter the screw conveyor is turned again to move the sealed containers to a seal inspection station to determine whether the filled and sealed containers have been properly sealed, the previously properly filled containers remaining over the discard doors of the conveyor are then moved to the sealing portion of the conveyor, the containers at the filling inspection position are advanced to the fill drop position, containers in the fill area are moved to the fill inspection area, and a new group of containers are moved into position under the filling area.

The screw conveyor stops and simultaneously the containers in the seal inspection position are inspected for proper seal, containers in the seal position are sealed, containers in the fill drop station that failed inspection are dropped through drop doors, containers in the L inspection position are inspected for proper fill and containers in the fill position are filled.

Thereafter the screw conveyor turns again and advances the containers over the seal inspection area to a seal reject door position, the containers in the seal position are advanced to the seal inspect position, the containers remaining over the fill drop station are advanced to the seal position, containers in the fill inspect position are moved to the fill drop position, the previously filled containers are moved to the fill inspection position, and a new set of containers are moved to the fill position. The screw conveyor again stops and any container above the seal reject door failing seal inspection is removed through the seal reject door, containers in the seal inspect position are inspected for proper seal, containers in the seal position are sealed, any container that failed fill inspection above the fill drop door is removed, containers in fill inspection position are inspected and containers in the fill position are filled.

The screw conveyor turns again and advances containers remaining over the seal reject door that have a proper seal out into an accumulation conveyor and the previously seal inspected containers are moved into the seal rejection area, the previously sealed containers are moved to the seal inspection area, the containers over the hill reject doors that have not been discarded over the reject area are advanced to the sealing area, and the previously fill inspected containers are moved over the fill reject area and the previously filled containers are moved to the inspection area, and a new group of containers are placed under the filling portion of the screw conveyor. This process continues as the screw conveyor incrementally advances oriented containers through the novel filling and sealing apparatus.

The novel filling and sealing apparatus includes at the filling station a clean in place apparatus for hygienically cleaning the filler portion of the novel filler and sealer apparatus. The filler portion of the novel filler and sealer apparatus includes a food product or fill reservoir connected to a piston cylinder combination that precisely meters the fill product into the containers by advancing a tapered piston to a mating tapered valve seat to provide a positive shut-off valve for depositing the food or fill product into the containers. Thereafter the positive shut-off valve is closed with the mating of the tapered piston to the tapered valve seat and the fill reservoir piston is retracted to its fill position and more product is placed into the product reservoir piston cylinder combination.

A further embodiment of the novel positive shut-off valve is provided for dispensing fluid food products that includes a variety of nozzles for precisely metering and controlling the dispensation of food products while minimizing dripping, splashing and sloshing of the fluid food product. The novel positive control shut-of valve includes a housing having a flowable product inlet intermediate the ends of the positive control valve. At one end of the positive control valve is an air line fitting communicating with a plenum on one side of a diaphragm and at the other side of the diaphragm an inlet for the product dispensing nozzle. Disposed at the other end of the positive control shut-off valve is a nozzle for dispensing food product having a channel communicating with the nozzle inlet and the diaphragm.

The novel positive shut-off valve operates by having a flowable food product pumped in the flowable product inlet which flows into the housing, past the diaphragm and into the nozzle inlet and out the nozzle outlet into the container. Once the metered amount of fluid has been dispensed air pressure is applied to the plenum on the other side of the diaphragm to close off the nozzle inlet and prevent further product from flowing through the nozzle. The novel positive control valve includes a variety of nozzles for metering a variety of flowable food products that accommodate a variety of viscosities.

A novel clean in place apparatus allows the pistons and cylinders to be cleaned by pumping cleaning solutions through the filler manifolds, filler valves and to the filler pumps and positive shut-off valves before the fluid is returned to the CIP-manifold. The closed loop clean in place system is also computer-controlled to provide for the periodic cleaning of the novel filler apparatus. Similarly the sealer portion of the machine is designed to allow t he periodic pivoting away of the heat-sealer and purge pistons for cleaning.

The sealing portion of the novel filling and sealing apparatus employs a multifunctional heater head which includes a nitrogen port for purging ambient air from the containers disposed below the heater head before a shuttle plate bearing a foil is placed directly above the container. Once the shuttle place is in place directly under the heater head and over the container the heads are extended downwardly pushing the foil through the shuttle plate and applying it to the container positioned directly below the foil opening in the shuttle plate. Thereafter, for an appropriate amount of time, the heater heads are activated to heat-seal the foil to the container to seal the container. The heater heads are designed to retract and cooperate with the retraction of the shuttle plate in such a manner as to turn a tab on the foil over the top of the container which later is surrounded by a plastic sleeve applied by the sleever and a straw is applied to the side of the sleeve by the novel straw applicator apparatus.

The novel screw conveyor precisely and discontinuously moves the containers in a start stop discontinuous operation that is sufficient in the preferred embodiment of the invention to position the container over the heat-sealing pistons that require a tolerance of about $1/30{,}000$ of an inch. This precise tolerance is necessary for heat-sealing foil closures to plastic containers in accordance with the preferred embodiment of the invention. The preferred application of the intention is for filling yogurt beverage containers. As will be recognized by those skilled in the art many types of sealing apparatus can be utilized such as the application of screw caps, crimped cans and other types or closure devices can be applied where the tolerances are not as close as in the utilization of a heat-seal roil in accordance with the preferred embodiment.

After the filled and sealed container exits fine novel filler sealer apparatus the container is preferably deposited upon an accumulation conveyor which functions as a controller conveyor. Depending upon the number of filled containers on the accumulation conveyor, the speed of the feed in the orientation and infeed conveyors and the delay period the discontinuous operation of the screw conveyor is stopped can be increased or decreased within limits. The entire production line can be integrated by a computer and time rates of the various production phases modified based on flow and backlog of the containers. Containers are transported from the accumulation conveyor to a sleever which applies a label or sleeve containing a label around the filled container. Once the sleever applies the label to the container, the container is transported to a heat tunnel which shrinks the seal onto the container. The sealed and labeled container is then transported to the novel straw applicator.

The novel straw applicator automatically applies straws on demand to the outside of the container as the container passes on a conveyor past the novel straw applicator. The novel straw applicator is disposed perpendicular to the conveyor production line and secures an individually wrapped straw to the outside of the filled and foil-sealed container. The novel straw applicator receives a band of individually wrapped straws in a cellophane band and first tensions the band before the band is introduced to the novel straw applicator conveyor belt of the novel straw applicator apparatus. At the introduction of the straws to a set of opposing conveyors, the straws are drawn in the band past a first set of laterally adjacent rollers which are connected to a second set of laterally adjacent rollers by two separate conveyor bands. At the first set of adjacently disposed conveyor rollers an adhesive tape is applied to one side of the band of straws to provide a sticky adhesive backing from a roll of tape which may be disposed in the housing of the tensioning element of the novel straw applicator device.

The straws are advanced in the first set of conveyors to a straw band cutter blade which severs the straws from the band and advances the individually wrapped straws to a novel straw applicator conveyor belt which has a plurality of straw applicator notches on one side and on the other side a series of timing notches together with vacuum ports for holding the individually cut straws in the plurality of straw openings while a vacuum box provides a vacuum for securely holding the individually cut straws with the adhesive as it travels along the straw applicator conveyor. The novel straw applicator conveyor belt is disposed between the second pair of opposing pulleys in the straw applicator conveyor to a straw applicator release pulley and the tensioning idler pulley. The novel straw applicator conveyor belt advances the cut straws to the application pulley at which point the vacuum is released and at the same time a filled and sealed container passes adjacent to the novel straw applicator conveyor belt which results in the adhesion and transfer of the adhesive tape backed straw to the side of the container to provide a final filled and sealed product with a straw applied to the outside surface of the filled and sealed container.

Associated with the straw applicator is a sensor to determine whether a filled and sealed container is properly sequenced with the operation of the straw applicator conveyor belt. The sensor determines when a container is in a proper sequenced position upstream and synchronously and on demand starts the straw applicator conveyor belt to time the release and attachment of the straw to the filled and sealed container. Once the sealed straw is applied to the outside of the container the container is ready for packaging and shipment.

The novel method and apparatus for the automated container filling and sealing production line produces a filled, sealed and packaged container from a group of unoriented containers at one end with the minimum intervention of human handling and processing. The novel software provides for the fully automated process by integrating continuous and discontinuous conveyor processes for assuring containers have been properly filled and sealed in the automated production process. In addition the novel container filling, sealing and handling equipment of the invention provides for easy cleaning and hygienic product handling in accordance with the highest food handling quality standards.

The automated production line integrates continuous and discontinuous processes together with the rejection of containers not meeting specification to assure that only containers meeting product standards are further processed in the novel production line to conserve materials and increase the quality control of the finished product. These advantages are provided in a computer controlled integrated production line to provide a continuous production process from continuous and discontinuous variable rate production processes utilizing continuous and discontinuous variable rate conveyor production lines that provide the highest standards of quality control at various stages of the filling and sealing operation.

BRIEF DESCRIPTION OF THE DRAWINGS

The objects and advantages of the invention will become further apparent to those skilled in the art from the following detailed description of the invention when read in conjunction with the accompanying drawings in which:

FIGS. 8 and 8A are side elevational views of the novel orientation conveyor in which FIG. 8 illustrates the preferred embodiment with the turning plate and drop chute portion of the novel container orientation apparatus and FIG. 8A illustrates the drop guide plates and drop chute portion of an alternative embodiment of the novel container orientation apparatus;

FIG. 22 is an exploded side views of the preferred embodiment of the heat-sealing ambient air purging piston of the invention illustrating a piper bearing attachment for increasing the maneuverability of the novel pistons;

FIGS. 22A, 22B, 22C and 22D are alternative embodiments of pivot bearings for increasing maneuverability of the novel heat-sealing ambient air purging piston of FIG. 22;

Figure 1A:
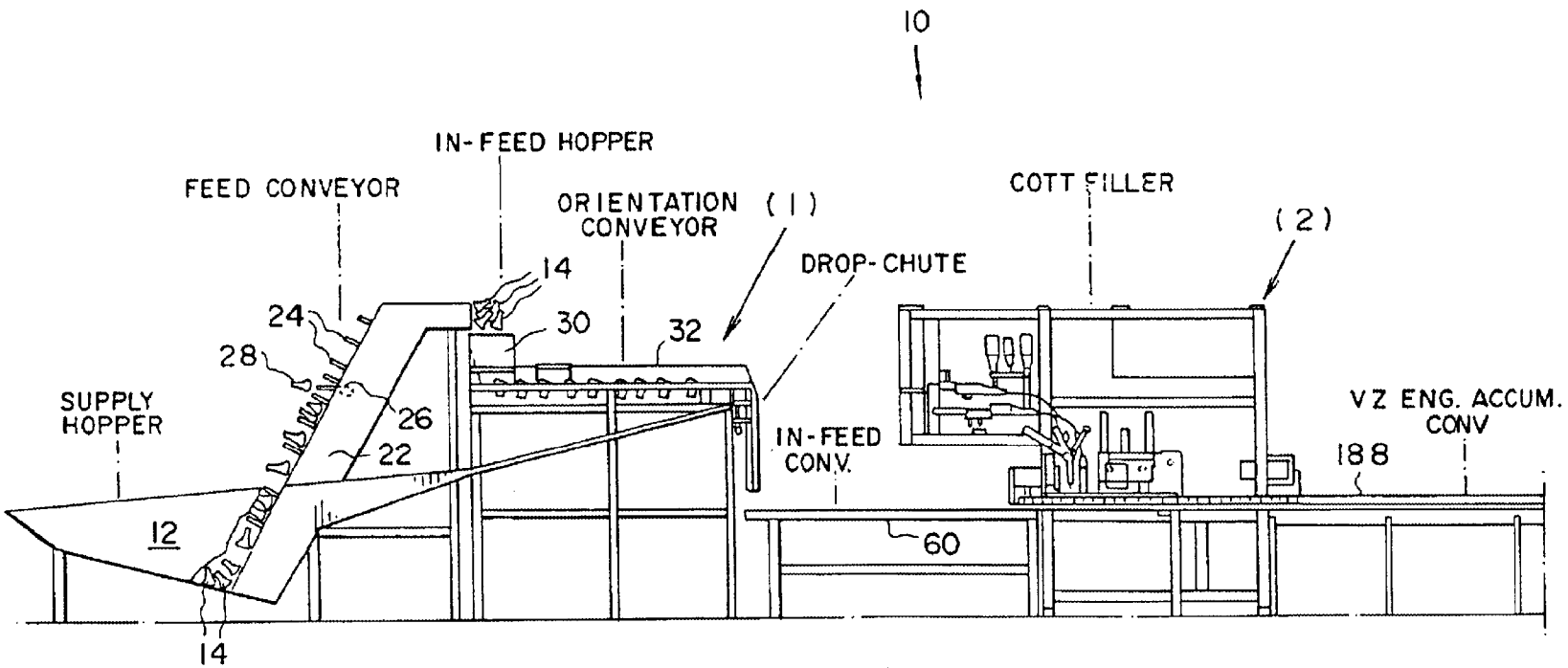
FIGS. 1A and 1B are side elevational views of the novel production line in accordance with the best mode of the invention.

Picture 1 is a photograph of a prior art packaged product with a folded straw;

Picture 2 is a photograph of the prior art product of Picture 1 without the straw and sleeve illustrating the prior art sealed and crimped foil seal;

Picture 3 is a close-up view of the prior art crimped foil seal;

Picture 4 is a photograph of the new packaged product with an attached telescoping straw produced in accordance with the best mode of the invention;

Picture 5 is a photograph of a new packaged product without the straw and sleeve illustrating the seal and crimped foil of the novel product produced in accordance with the invention; and Picture 6 is a close-up photograph illustrating the crimped foil and seal of the novel product produced in accordance with the invention.

DETAILED DESCRIPTION OF THE PREFERRED EMBODIMENT

The invention pertains to a novel integrated automated production line having continuous and discontinuous conveyor operations integrated into a continuous production line which takes randomly oriented containers from a supply hopper, orients and roughly sequences those containers in a continuous conveyor operation and fills and seals those containers in a novel filler sealer machine utilizing a screw conveyor operating in a discontinuous conveying action which then deposits those filled and sealed containers on an accumulation conveyor which provides information to a computer for regulating the entire production line. The filled and sealed containers are transported from the accumulation conveyor to a sleeving device for applying sleeves, optional heat tunnels for shrinking the plastic sleeves and a novel straw applicator which applies a pre-packaged straw to the outside of the filled, sealed and labeled container. The novel automated production line having continuous and discontinuous conveyor operations is integrated into a continuous production operation utilizing computer software which obtains information at various points in the production line from various types of accumulation conveyors to increase and decrease various processes and control the operation of the production line at every stage of the container filling sealing operation.

The novel integrated production line includes novel devices for the filling and sealing operations together with the computer integration of those devices into a production line designed for continuous production. The novel devices incorporated into the novel production line include a novel orientation conveyor for orienting containers, a novel filler sealer screw conveyor device which is designed for simultaneously filling and sealing operations each time the screw conveyor is stopped and novel ambient air purging heat-sealing pistons, a novel positive control shut-off valve and a novel straw applicator apparatus and novel straw applicator belt. In the preferred embodiment of the invention the positioning screw conveyor also provides for the simultaneous inspection of the filled and sealed containers and in the best mode of the invention the rejection of any improperly filled and sealed containers before the improperly filled or sealed containers are further processed down the production line. In addition to the novel orientation conveyor and filling sealing apparatus, a novel straw applicator is provided in the production line to automatically attach an individually wrapped telescoping straw to the outside of the container to complete the production process of the invention. The novel straw applicator includes sensors and sequence timing devices to deliver a pre-packaged straw cut from a continuous band having an adhesive applied to one side for attachment to the filled and sealed and packaged container at the end of the novel integrated production process.

The invention is a product of an extensive research and development investigation into providing a fully automated production line integrating continuous and discontinuous conveyor operations to provide a fully automated hygienic production device meeting the highest requirements of the food processing industry. The invention provides for an ease of cleaning parts in direct contact with food materials as well as for the ease of cleaning all portions of the production line. As a result all of the parts which come in contact with food materials are composed of high quality stainless steel, plastic and other materials that can be easily cleaned in the production process. The novel integrated automated production line as a result simulates the mechanical equivalents of the human hand at various stages in the production process without introducing the disadvantages of contamination by human handling.

The novel automated integrated production line and the novel filler sealer apparatus were developed to provide a fully automated container filling production line which is compact and includes a number or processing stations or simultaneously filling, sealing, inspecting and, in the best mode, discarding containers that do not meet inspection requirements. The novel filler sealer machine is particularly adapted to food containers that are filled with liquid or semisolid food materials such as puddings, pie fillings, baby food, beverages and other types of fluid food material which can be metered into a container and sealed and then inspected on a fully automated container filling and sealing production line.

In the best mode of the invention the filler sealer machine and orientation conveyor are designed to handle containers having a base of a larger size than the rest of the container. In the best mode the container can have any type of cross-sectional configuration as long as the outside upper portion of the container is not larger than the size of the base. This application of the invention allows containers to not only be filled, sealed and inspected but also rejected in the novel container filler and sealer apparatus in accordance with the best mode of the invention. In accordance with other embodiments of the invention the novel container filler sealer machine of the invention is adaptable to fill and seal all types of containers and provide for he rejection of those containers by utilizing either a modified screw conveyor in the novel filler sealer machine or provide for the rejection of faulty containers outside of the novel filling, sealing and inspecting machine by providing a means for removing containers that did not meet inspection requirements somewhere further down the production line.

While the invention is applicable to all types of production lines for the handling of foods, beverages, pie fillings, baby food and other types of fluid materials the invention will be hereinafter described with respect to its best mode which pertains to a yogurt filling production line and, more particularly, to a yogurt drink filling production line in which randomly oriented containers are taken from one end of the production line and filled, sealed, labeled and provided with a pre-packaged straw attached to the outside of the labeled container at the other end of the production line.

Figure 1B:
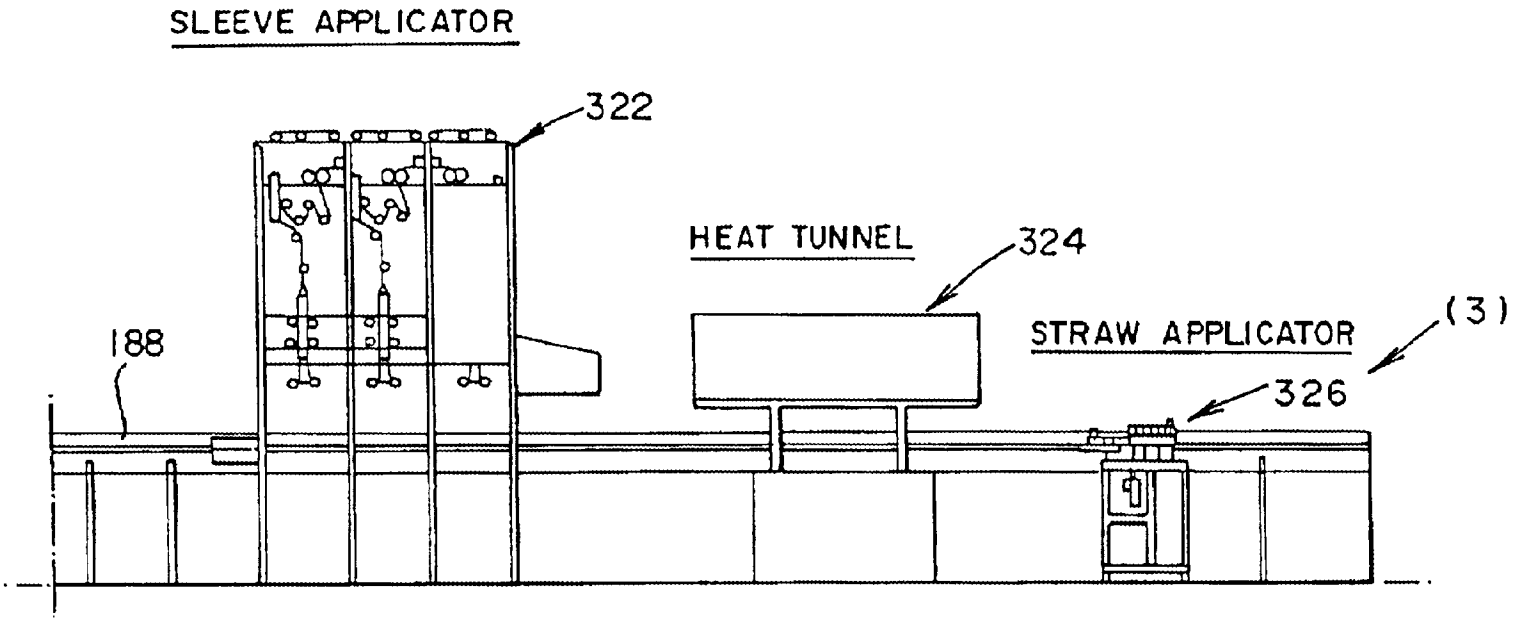
Figure 5:
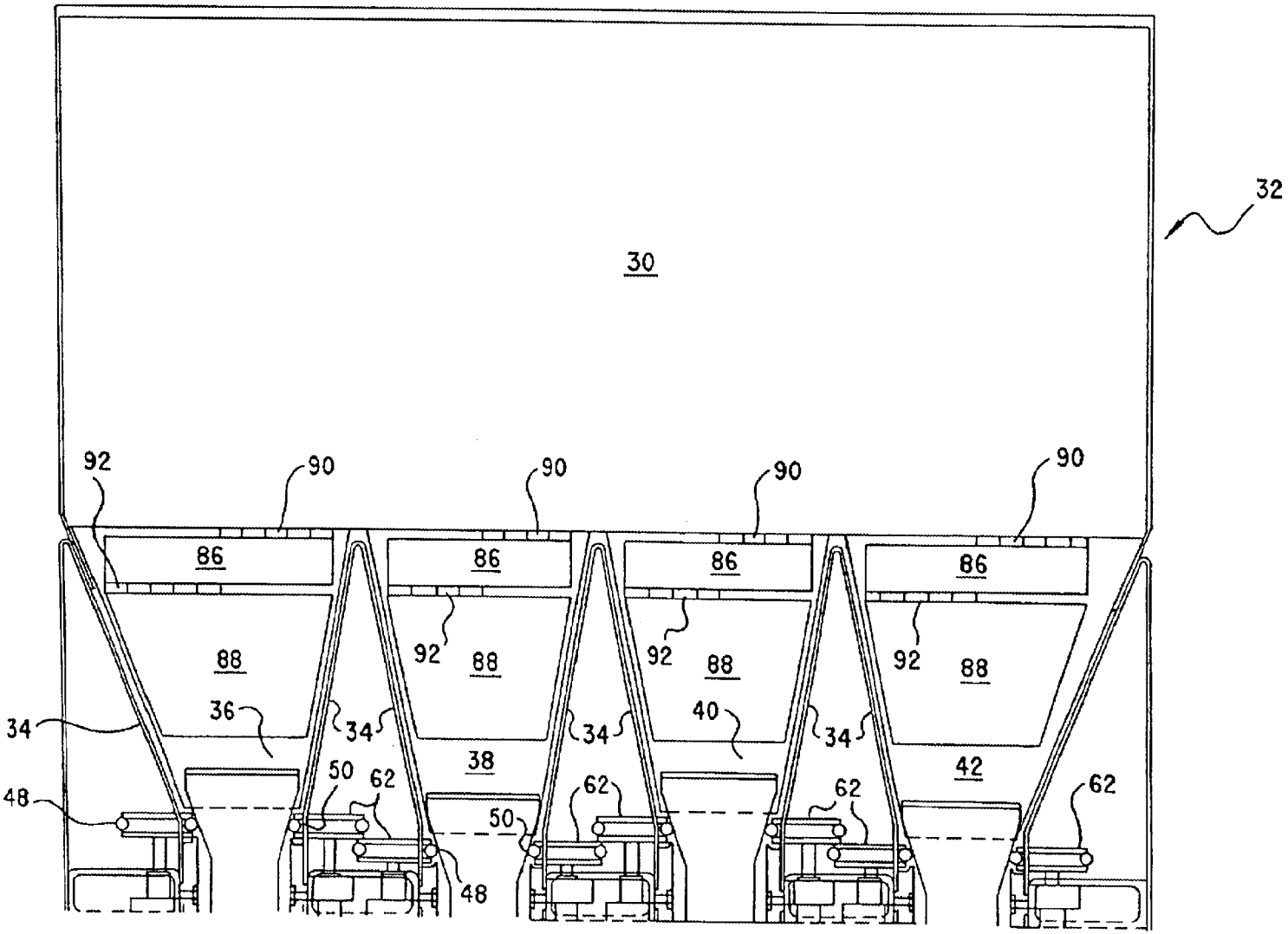
FIG. 5 is an elevational view of the novel container orientation apparatus taken along the line 5—5 of FIG. 4.

Referring now to FIGS. 1A and 1B the novel integrated production line 10 is illustrated having at one end a supply hopper 12 having a plurality of randomly oriented containers 14 for filling, sealing, inspecting and completing in accordance with the invention. Randomly oriented containers 14, as illustrated in FIG. 5, preferably have a base 16 with flat bottom 18. The base 16 of the container is preferably of a size greater than the open filling end 20 so that the container can be filled, sealed, inspected and is capable of being rejected while the container is on the novel filler sealer positioning screw conveyor as will be described hereinafter in greater detail.

Figure 2:
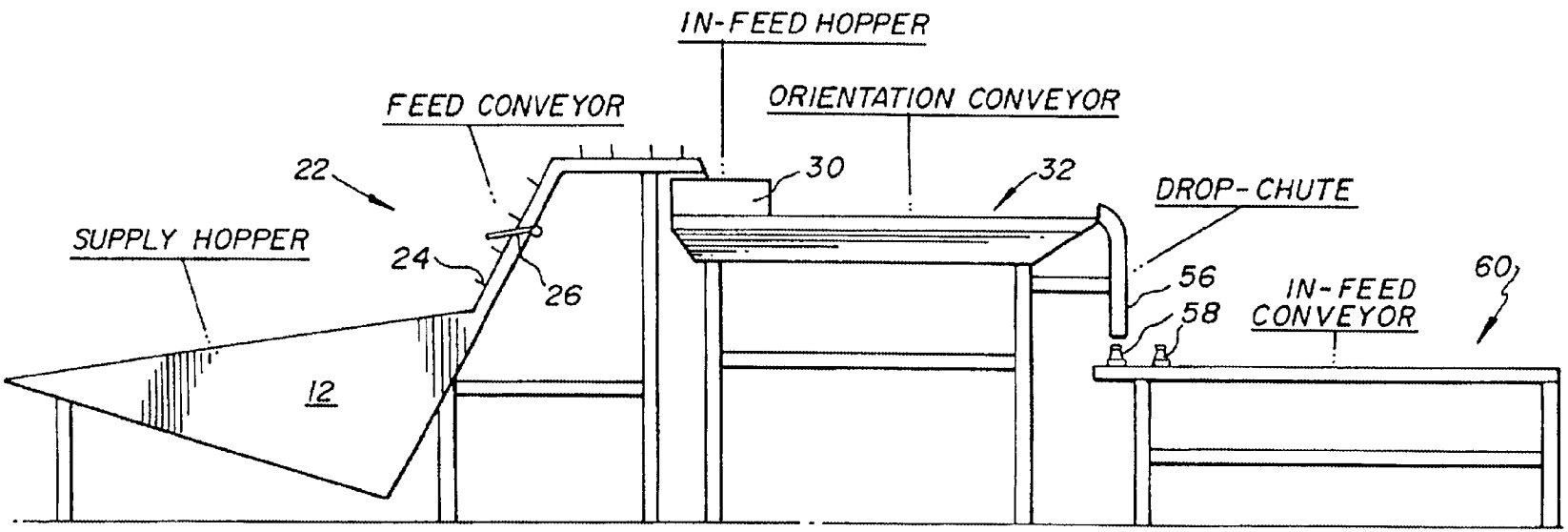
FIG. 2 is a side elevational view of the novel container orientation apparatus including an elevator infeed conveyor constructed in accordance with the invention.
Figure 3:
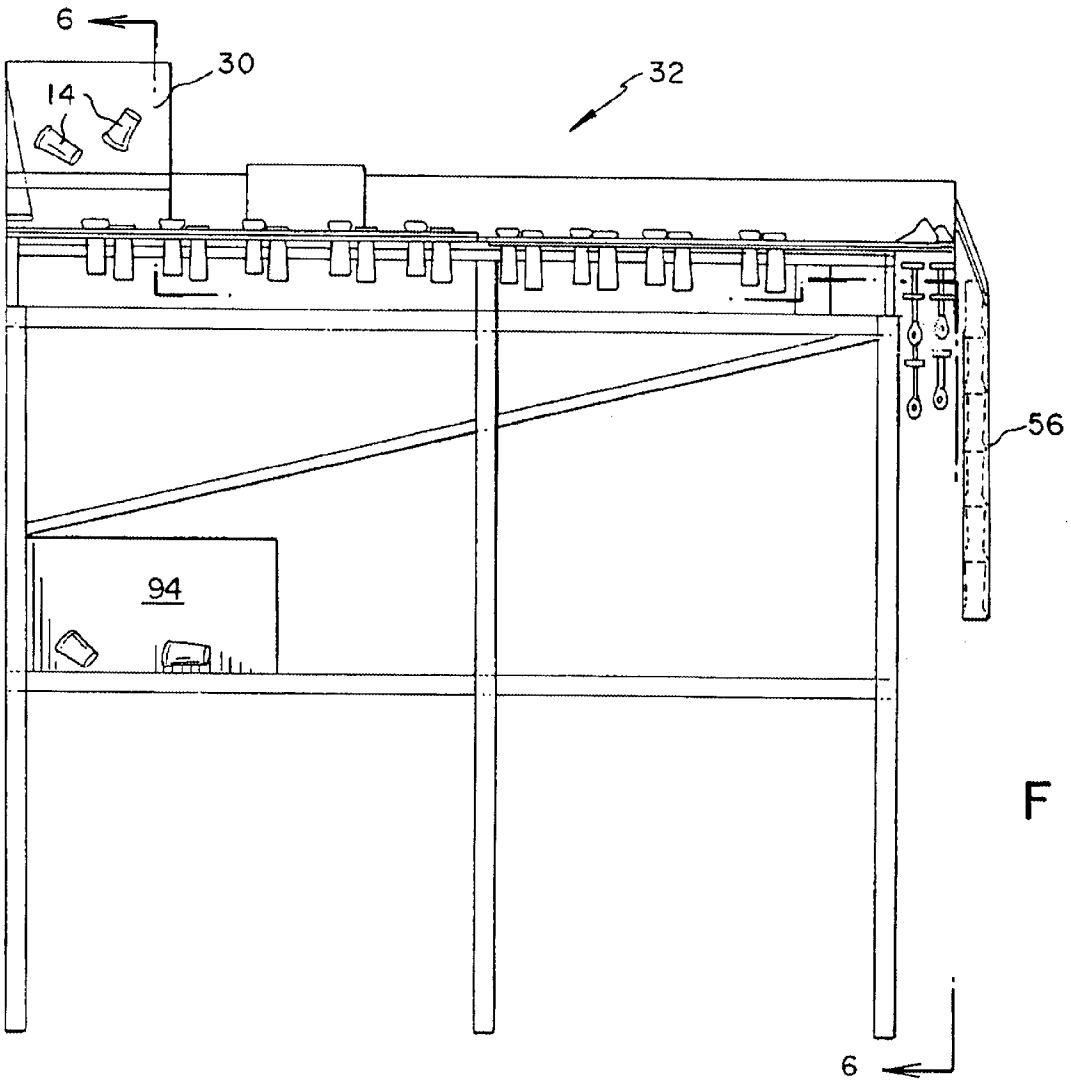
FIG. 3 is an elevational view of the novel container orientation apparatus in accordance with the best mode of the invention.
Figure 4:
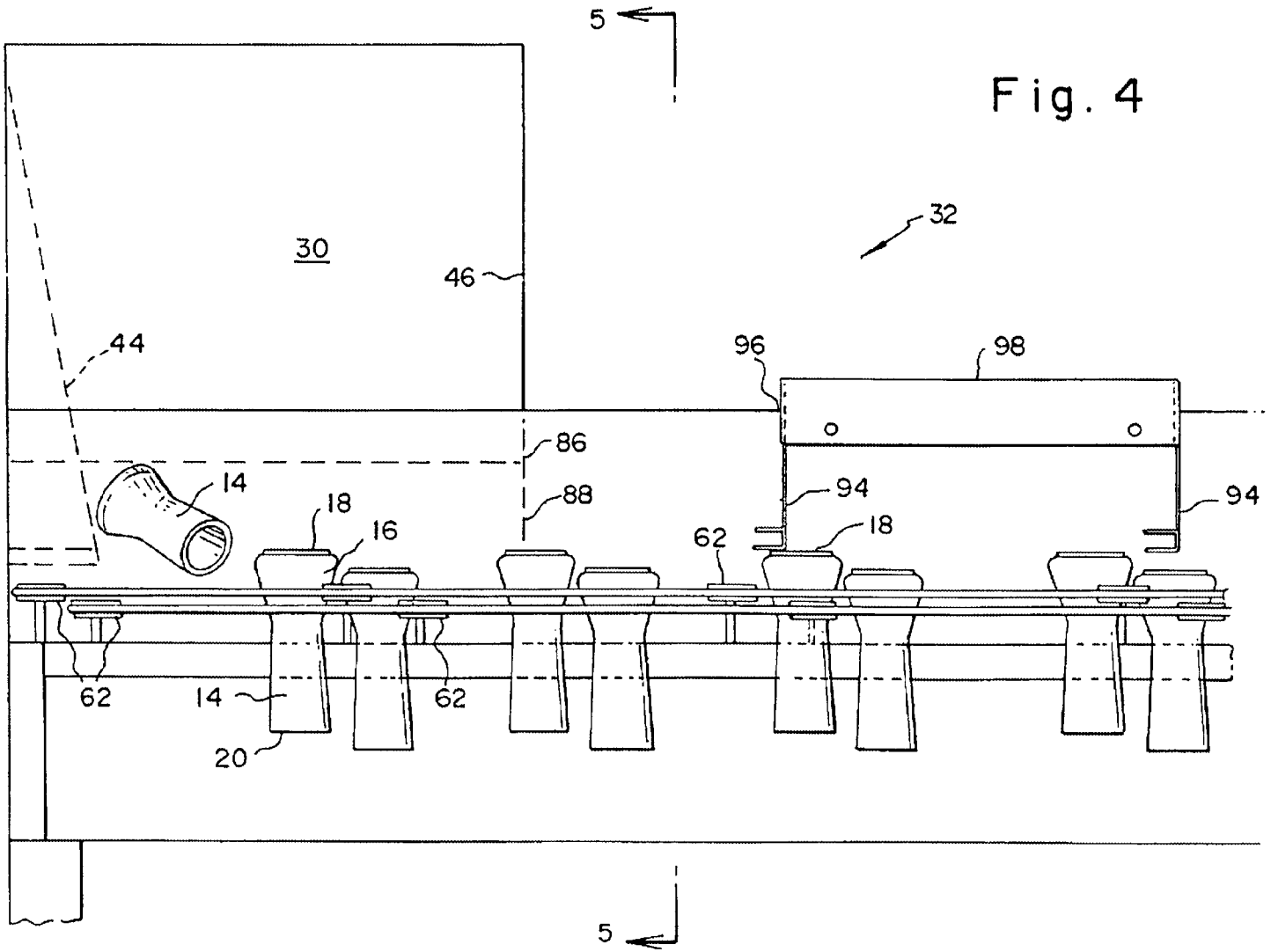
FIG. 4 is an elevational view of the infeed hopper area of the container orientation apparatus.

Referring again to FIGS. 1A and 2 the supply hopper 12 is connected to an elevated feed conveyor 22 having a plurality of container transport plates 24 for removing randomly oriented containers 14 from supply hopper 12. Attached to the side of elevated feed conveyor 22 is a spring-mounted removal plate 26 which pivotally moves in response to the conveyor action of container transport plates 24 to remove excess containers 28 from the container transport plates 24 before the randomly oriented containers 14 are deposited in infeed hopper 30.

Referring now to FIGS. 2–8 the novel orientation conveyor 32 is illustrated connected to elevated feed conveyor 22. As randomly oriented containers 14 are gravity fed into infeed hopper 30 they may free-fall before contacting a plurality of lane divider plates 34 which define a plurality of production lines 36, 38, 40 and 42 (FIG. 5). Alternatively the container may contact sloping end plate 44 or housing wall 46 before falling into the plurality of production lines 36, 38, 40 and 42.

Once the plurality of containers have entered the plurality of production lines 36–42 by the action of gravity, the plurality of lane divider plates 34 and the conveying action of laterally opposing elastomeric belts, the container 14 falls between a pair of laterally opposing elastomeric belts 48 and 50 to capture base 16 of container 14 to orient the container between elastomeric belts 49 and 50 as elastomeric belts 48 and 50 continuously travel along the length of the conveyor. In this embodiment of the orientation conveyor the containers are transported in a 'bottom up' 'top down' orientation to a plurality of turning plates 54 (FIG. 8) which terminate in a plurality of drop chutes 56. The plurality of turning plates turn the 'bottom up' 'top down' oriented containers 52 to a 'bottom down' 'top up' orientation containers 58 which are deposited on continuously moving infeed conveyor 60.

Orientation conveyor 32 provides a rough separation or sequencing in the preferred embodiment of 'bottom up' 'top down' oriented containers 52 where containers have a base 16 are filled and sealed in the novel filling and sealing screw conveyor apparatus which includes a rejection door for rejecting improperly filled and sealed containers. However, where an oriented and rough sequenced container 57 (FIG. 8A) is oriented which has a bottom 59 smaller than the top 61 with an opening 63 is filled and sealed in the novel filler sealer screw conveyor apparatus of the invention the plurality of turning plates 54 are replaced by a plurality of drop guides 65 which stabilize bottom 59 of container 57 to maintain the 'bottom down' 'top up' orientation of container 57 into and through drop chute 56. In such applications orientation conveyor 32 orients the containers in a 'bottom down' 'top up' configuration utilizing the novel pliant plates and pliant rods simulating the action of the human hand to provide rough sequencing of the oriented containers. In both embodiments of the novel orientation conveyor all the components are the same except for the utilization of a plurality of drop guides 65 in place of the plurality of turning plates 54 to accommodate containers having a top larger than the bottom. The method of operation of both embodiments of the novel orientation conveyor to provide orientation and rough sequencing of containers are the same and the oriented and rough sequenced containers in both embodiments are deposited in a 'top up' 'bottom down' configuration in drop chute 56 before those rough sequenced containers are deposited on infeed conveyor 60.

In either embodiment of the novel orientation conveyor, randomly oriented containers are deposited in infeed hopper 30 and transported by laterally disposed elastomeric belts 48 and 50. Each lane 36, 38, 40 and 42 includes a separate transposing elastomeric belt 48 and 50 for each of the plurality of production lines 36–42. Elastomeric belts 48 and 50 are disposed between a plurality of pulleys 62 for transporting oriented containers from the infeed hopper area 30 to the plurality of drop chutes 56. The orientated containers are continuously moved along the plurality of production lines 36–42 in a continuous operation to provide a rough sequencing of containers that are deposited on infeed conveyor 60.

The rough sequencing of the plurality of containers transported by elastomeric belts 48 and 50 by the plurality of pulleys 62 in each of the plurality of production lines 36–42 is provided by pliant plates and rods in combination with the travel of elastomeric belts 48 and 50 which are further controlled by a computer which controls each lane through an individual sensor 64 which is connected through a clutch assembly 68 for controlling the speed or stopping each or the plurality of production lines 30–42 in the event a particular lane needs to be slowed or stopped due to a problem further on down along the production line.

Figure 6:
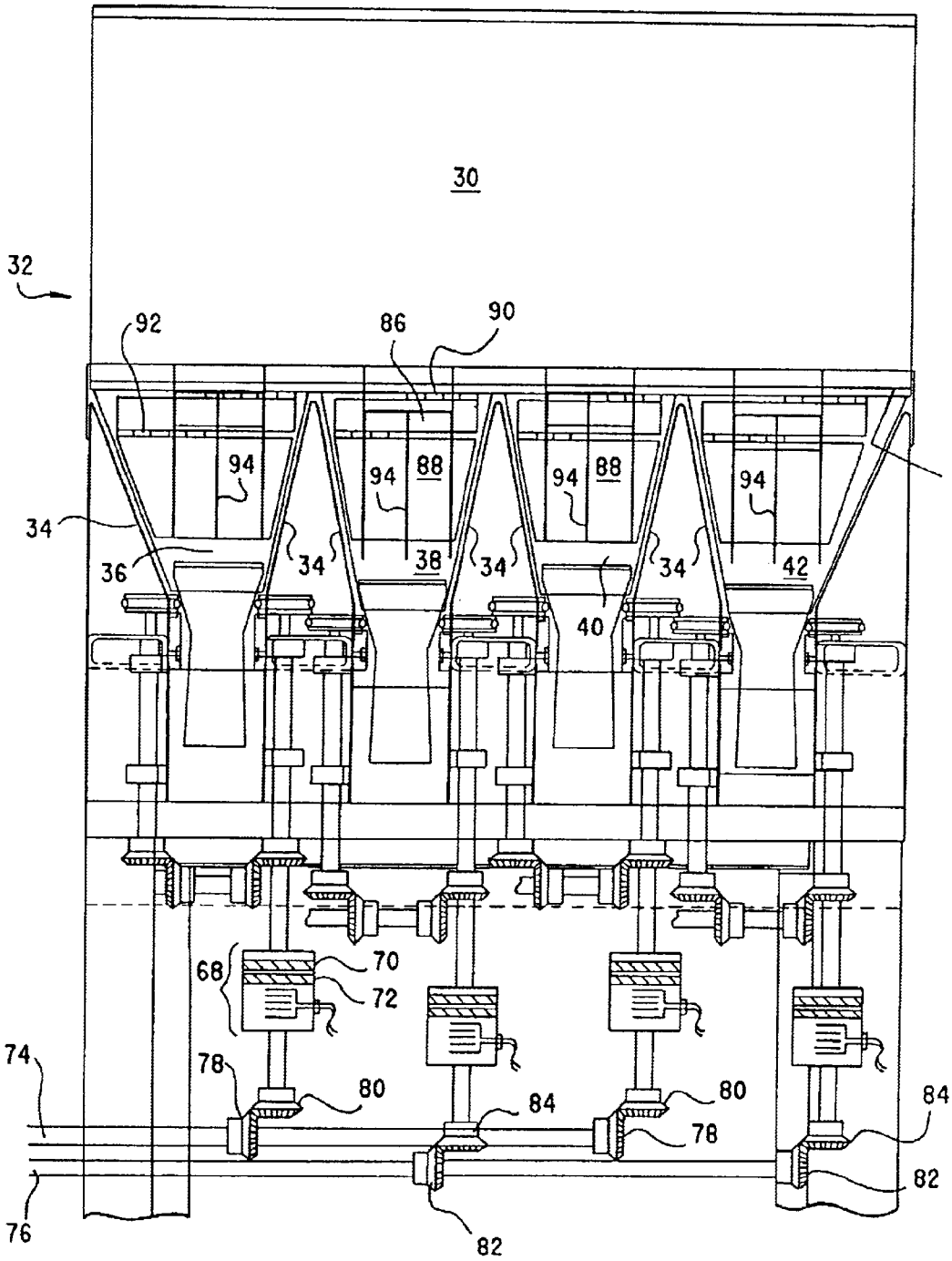
FIG. 6 is an elevational view of the novel container orientation apparatus taken along the line 6—6 of FIG. 3 without a turning plate and drop chute.
Figure 8:
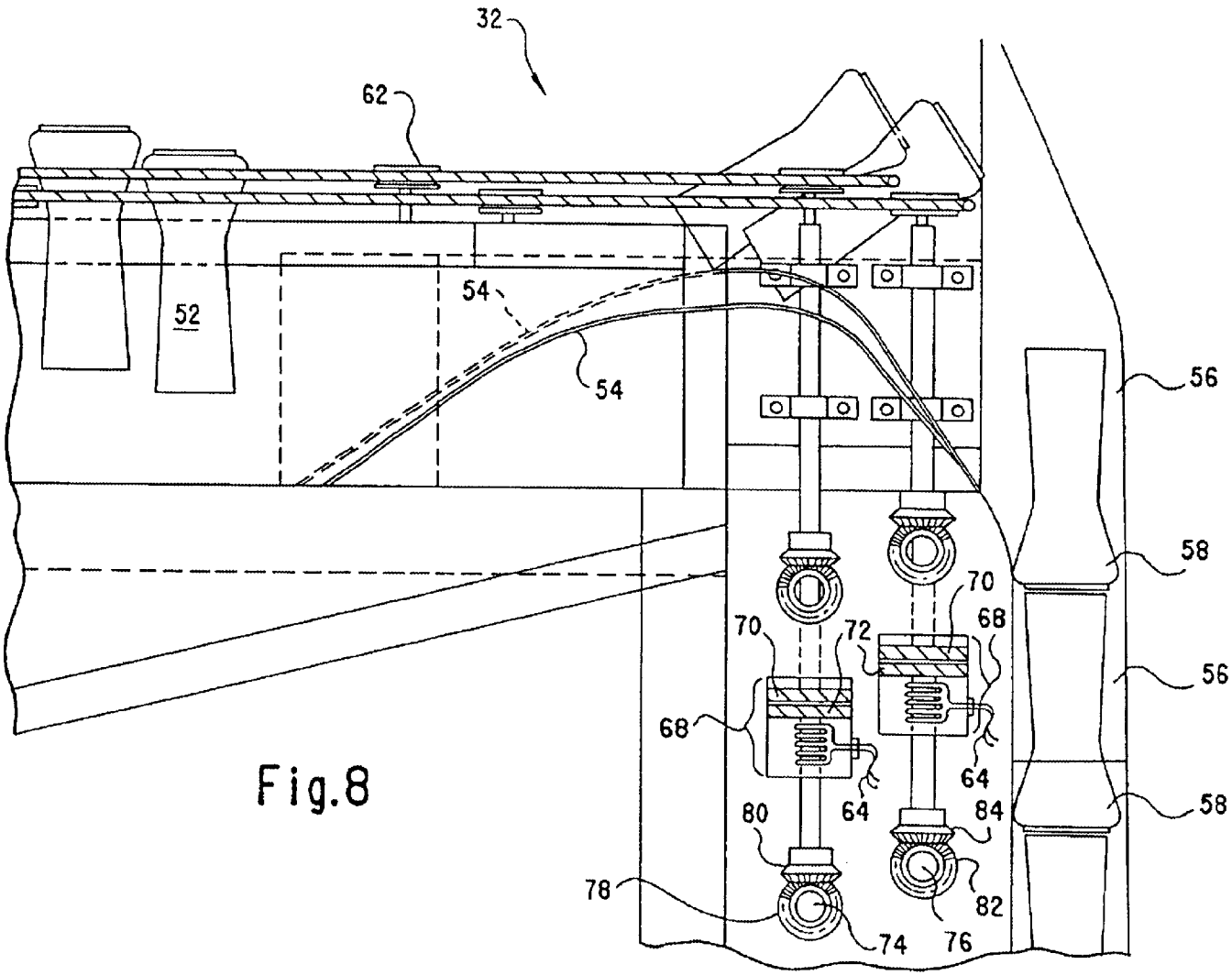

Clutch assembly 68 includes clutch plate 70 and 72 for controlling each of the plurality of production lines 36–42 through-orientation conveyor drive shafts 74 and 76 through bevel gears 78 and 80 (FIG. 6 and FIG. 8). Bevel gears 78 and 80 on drive shaft 74 provide a drive for lanes 36 and 40 through each clutch assembly 68 which may individually slow down or shutoff production line 36 or 40 in operation while drive shaft 76 is connected via beveled gear 82 and 84 to clutch assembly 68 which is connected to production lines 38 and 42 to individually control or shut down the speed of production line 38 and 42 through each of the clutch assemblies 68 similar to those connected to drive shaft 74. Clutch assemblies may also be connected to variable speed drive assemblies for further increasing or decreasing individual lane speeds in a manner known to those skilled in the art.

Referring now to FIGS. 4–7 the novel orientation plates and fingers simulating the mechanical action of the hand in orienting the containers in accordance with the invention will be further described. The plurality of divider plates 34 separate the plurality of production lines 36–42 from which the gravity fed randomly oriented containers 14 are captured by elastomeric belts 48 and 50 in the area of infeed hopper 30. The continuous motion of each of the elastomeric belts 48 and 50 and their continuous conveying action eventually removes containers from hopper 30 even if hopper 30 is filled to capacity. Elastomeric belts 48 and 50 in the plurality of lanes 36–42 together with the utilization of a pivotal plate 86 and 88 which mechanically simulate the action of the human hand assist in the orientation and the rough sequencing of randomly oriented containers 14 and prevents excess containers from escaping hopper 30. First pivotal plate 86 is hinged to housing wall 46 by pivotal hinge 90 which may include a spring-biasing means. Plate 86 is pivotally attached to second pivotal plate 88 through a second hinge 92 to allow plates 86 and 88 to resiliently swing and prevent too many containers from exiting hopper 30 in a bunched up or unsequenced configuration.

Excess containers are thereby maintained in hopper 30 or can fall through the area below hopper 30 in a collection box 94 (FIG. 3) where too many containers are fed into infeed hopper 30 by elevated feed conveyor 22 or where the container strikes elastomeric belts 48 and 50 in an angular fashion that allows part of the base 16 (or the top portion 61 in the FIG. 8A embodiment) to fall between elastomeric belt 48 and 50. The swinging motion of first pivotal plate 86 in combination with the swinging motion of second pivotal plate 88 in reaction to the travel of elastomeric belts 48 and 50 in exiting infeed hopper 30 prevents unoriented bunched up containers from moving out of infeed hopper 30 in a bunched up unoriented configuration.

Figure 7:
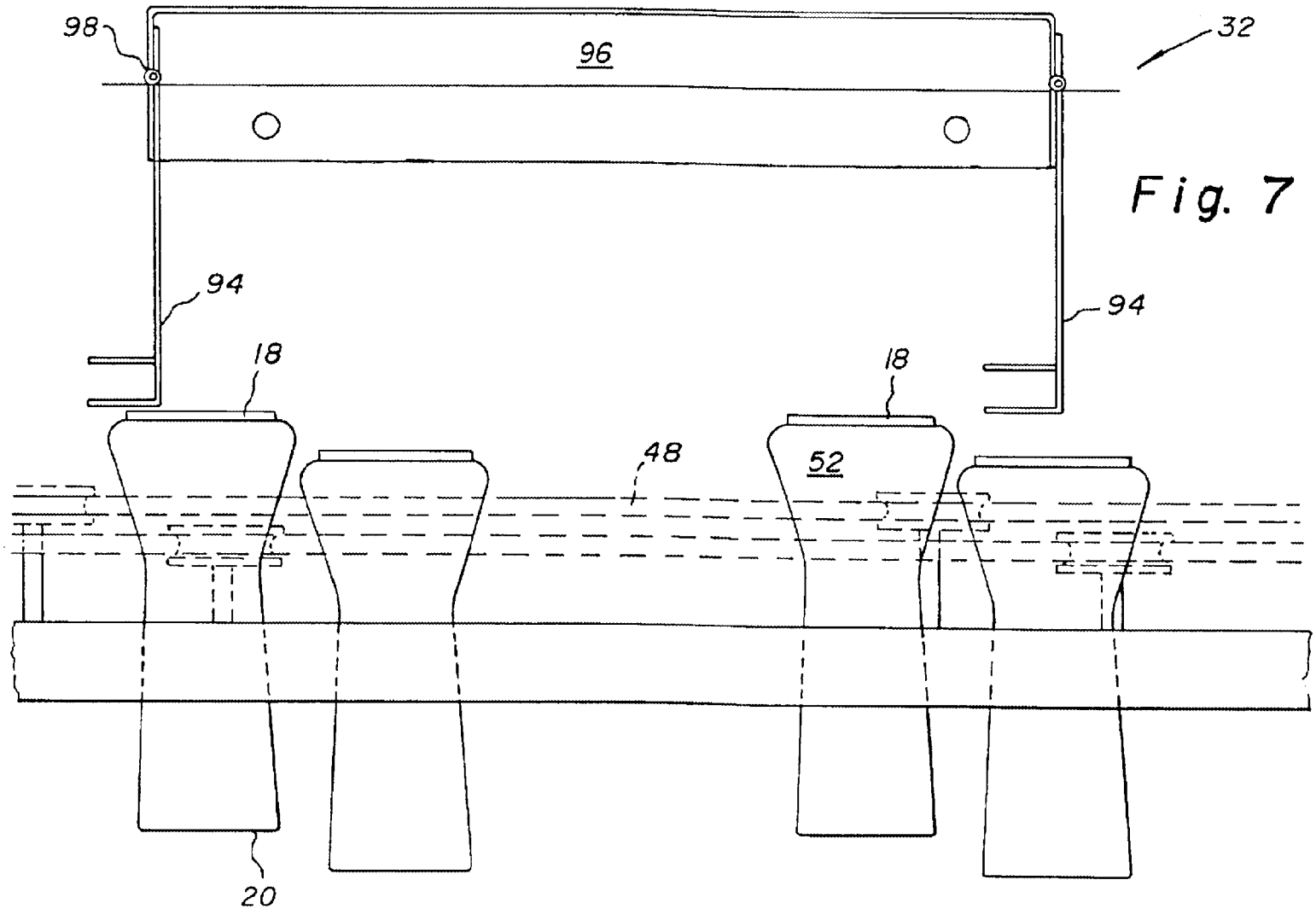
FIG. 7 is an elevational view of the pliant orienting fingers of the novel container orientation apparatus.

Once the oriented containers 52 exit first pivoted plate 86 and second pivoted place 88 they are introduced to a pivoting finger assembly 94 disposed in each of the plurality of production lines 36–42 (FIGS. 5, 6 and 7). The plurality of pivoting fingers 94 simulate the action of the human fingers in making certain the containers are properly oriented and assist in the rough sequencing of the containers by contacting first the side, if the container is not properly oriented, and then running over the flat bottom 18 (FIG. 5) to make certain the container is in a substantially perpendicular oriented configuration. The plurality of pivoting fingers 94 are hinged to a bracket 96 through a hinge 98 to allow each of the plurality of pivoting fingers to pivot and assist in the rough sequencing of containers in each of the plurality of production lines 36–42.

Figure 8A:
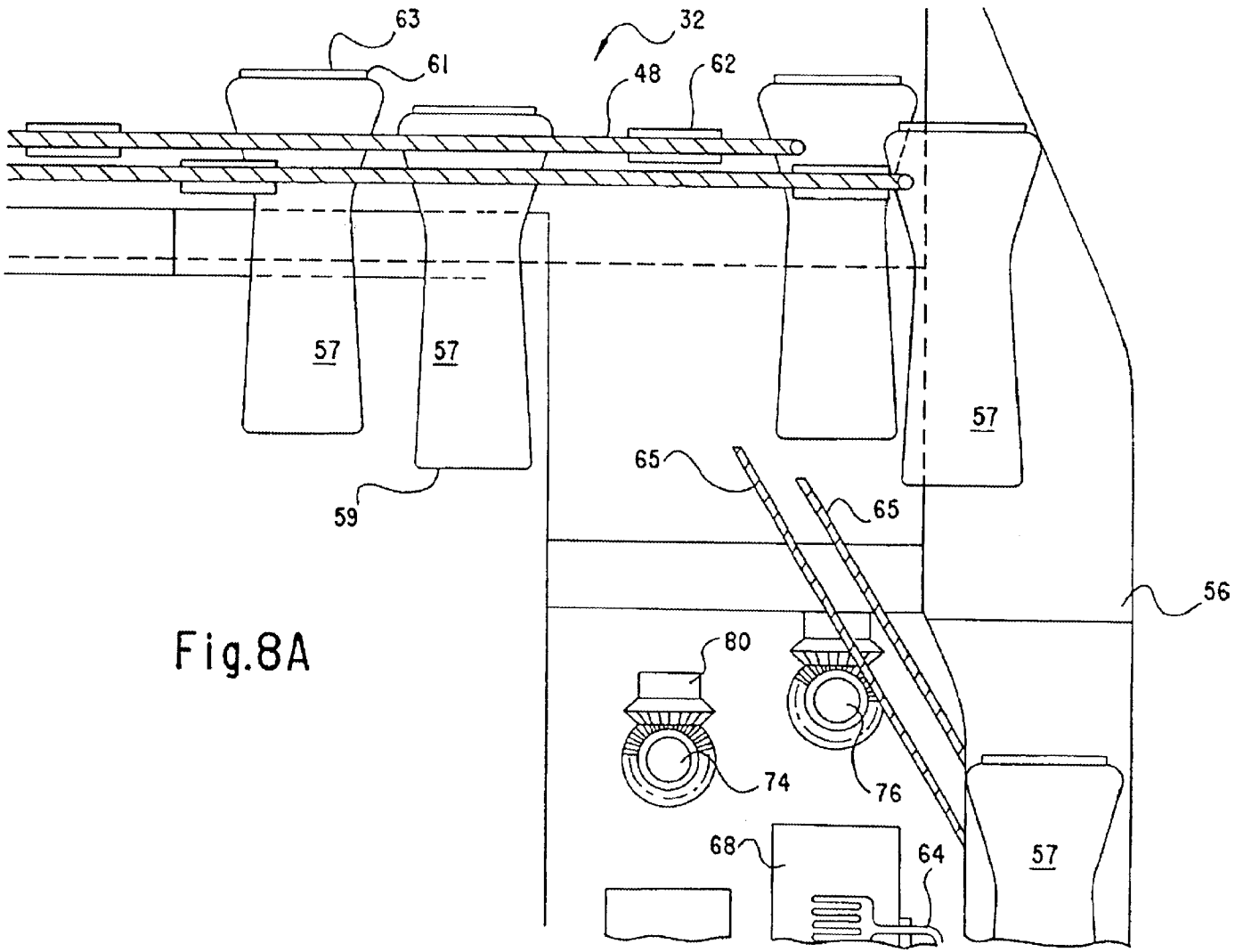

As will be recognized by those skilled in the art the rough sequencing provided by the novel orientation conveyor in the operation of pliant plates and fingers in combination with the computer control and motion of the elastomeric belts can be used for 'bottom up' 'top down' orientation and sequencing or 'top up' 'bottom down' orientation. The rough sequencing provided for containers with larger tops than bases can easily be provided for where such containers have opening 20 and flat bottom are reversed as illustrated in FIG. 8A. However, in the best mode of the invention the 'bottom up' 'top down' oriented containers are transported to the plurality of turning plates 54 (drop guides 65 in the alternative embodiment) and deposited through drop chutes 56 in a 'top up' 'bottom down' oriented configuration on continuous infeed conveyor 60. Infeed conveyor 60 is connected to the computer and in the preferred embodiment operates like an accumulation conveyor by providing information as to container flow which is used to increase and decrease the speed of elevator conveyor 22 and control the speeds of the plurality of lanes of the orientation conveyor 32. Infeed conveyor 60 then transports and introduces the 'top up' 'bottom down' oriented and roughly sequenced containers 58 to the novel filling and sealing apparatus 100 at one of the screw conveyors 102, 104, 106, 108, 110 and 112 (FIG. 11).

Figure 9:
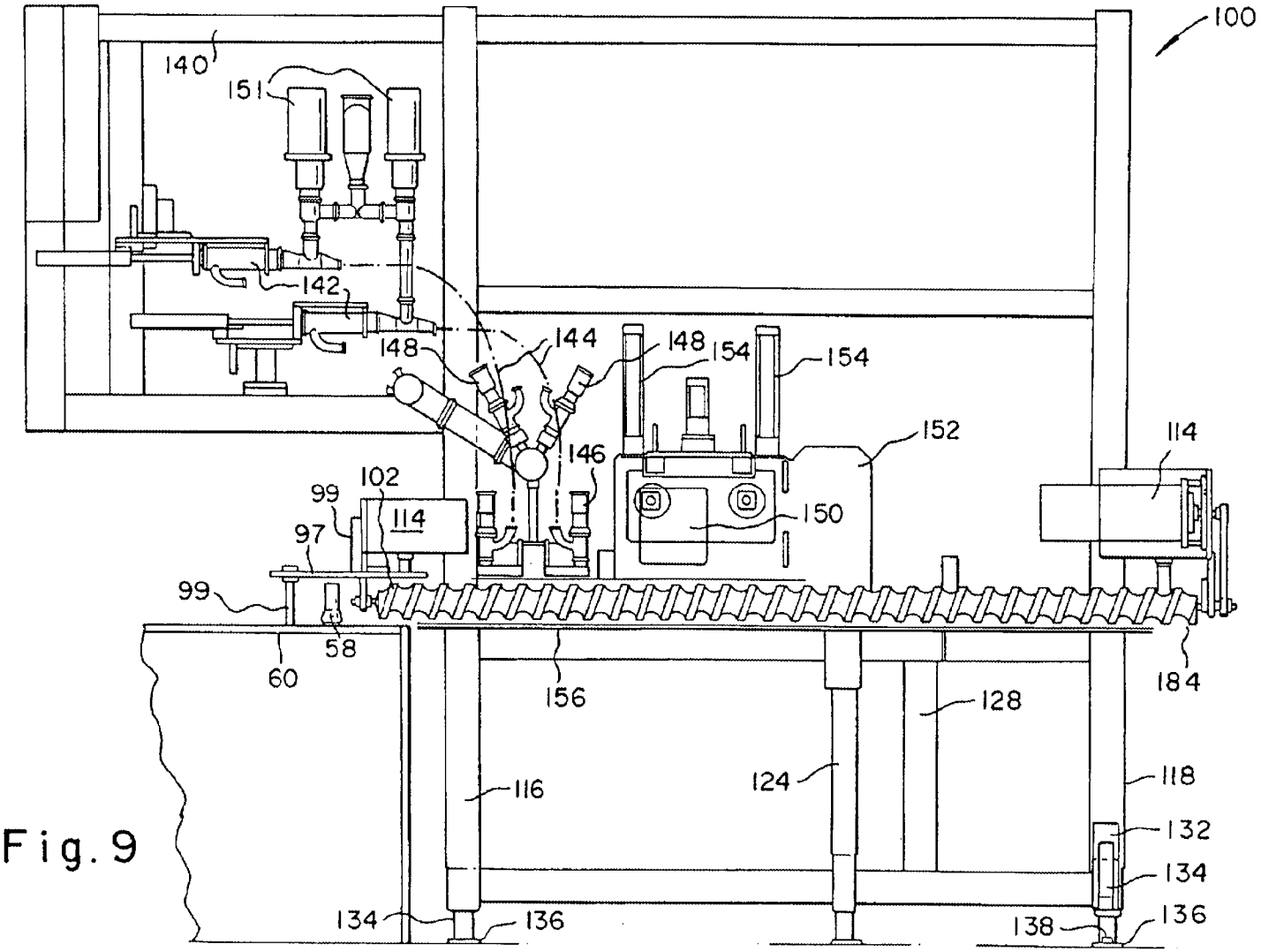
FIG. 9 is a side elevational view of the novel filling and sealing apparatus of the invention.

Referring now to FIG. 9 the novel filling and sealing apparatus 100 includes three drive motors 114 for driving each set of screw conveyors 102–112 (FIG. 11) which are precisely positioned to turn each set of two conveyors 102–112 to advance oriented containers 58 along the length of the screw conveyors to a plurality of inspection, filling and sealing and rejection stations along the length of the novel filling and sealing apparatus 100. The novel filling and sealing apparatus includes supports 116–134 for supporting the novel filling and sealing apparatus 100. At the end of each support 116–130 is a cylinder 132 piston 134 combination to provide for the precise leveling of the novel filling and sealing apparatus. The piston 134 terminates in a support flange 136 that is bolted to a floor via bolt 138. Supports 116, 118, 120 and 122 extend from the floor to provide a frame 140 for supporting each product reservoir 142 which is connected by hoses 144 to the individual filler heads 126. Individual filler heads 146 may be pivoted to a cleaning position as represented by filler heads 148. The novel filling and sealing apparatus 100 also includes a foil transfer mechanism 150 and sealing mechanism 152 for sealing containers 58 win a foil from each or a plurality of foil tubes 154.

Figure 10:
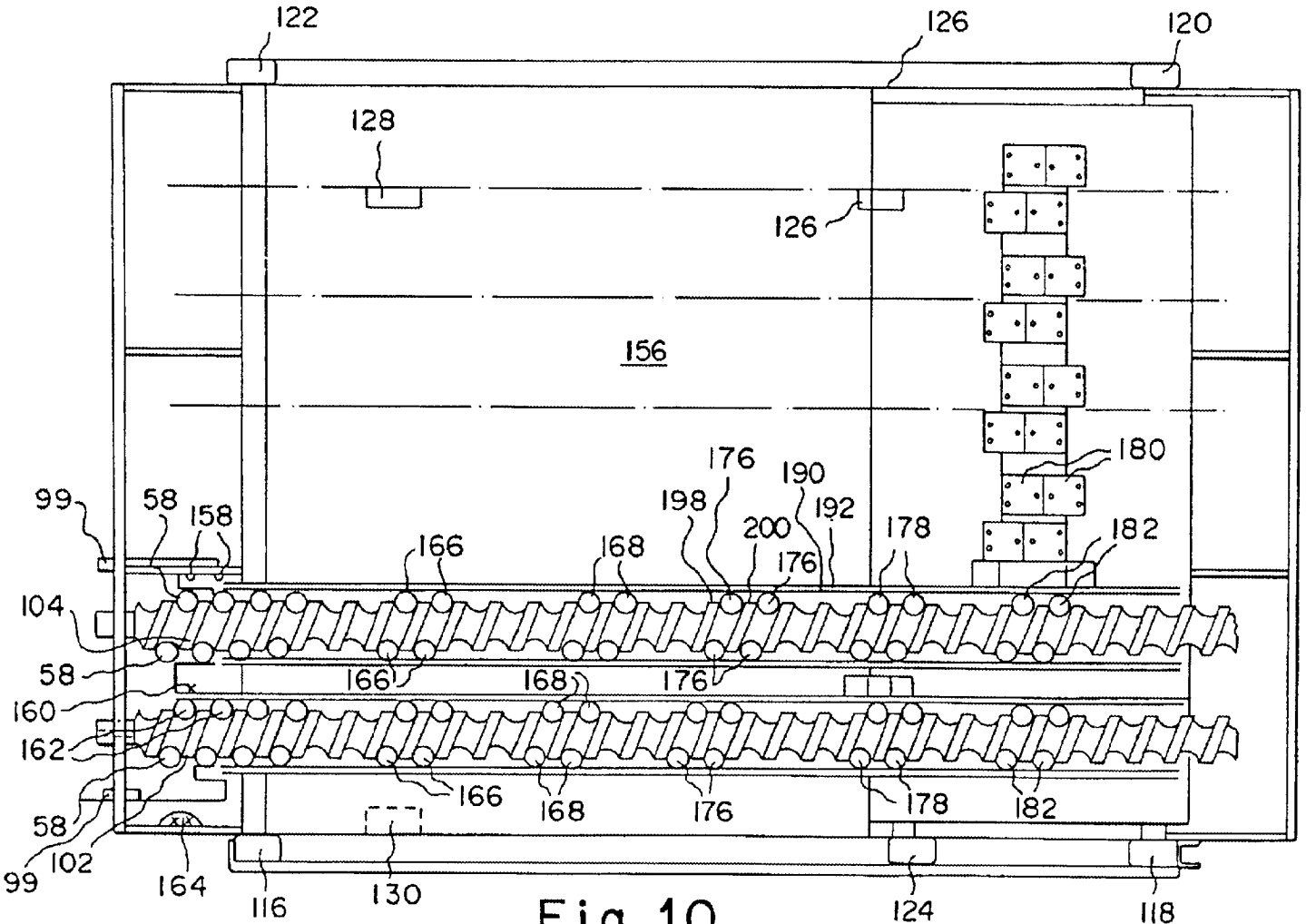
FIG. 10 is a top plan view of the novel screw conveyor layout in accordance with the preferred embodiment of the invention illustrating container sensor areas, filler areas, fill inspect areas, seal areas, seal inspect areas and fill and seal reject areas of the invention.
Figure 11:
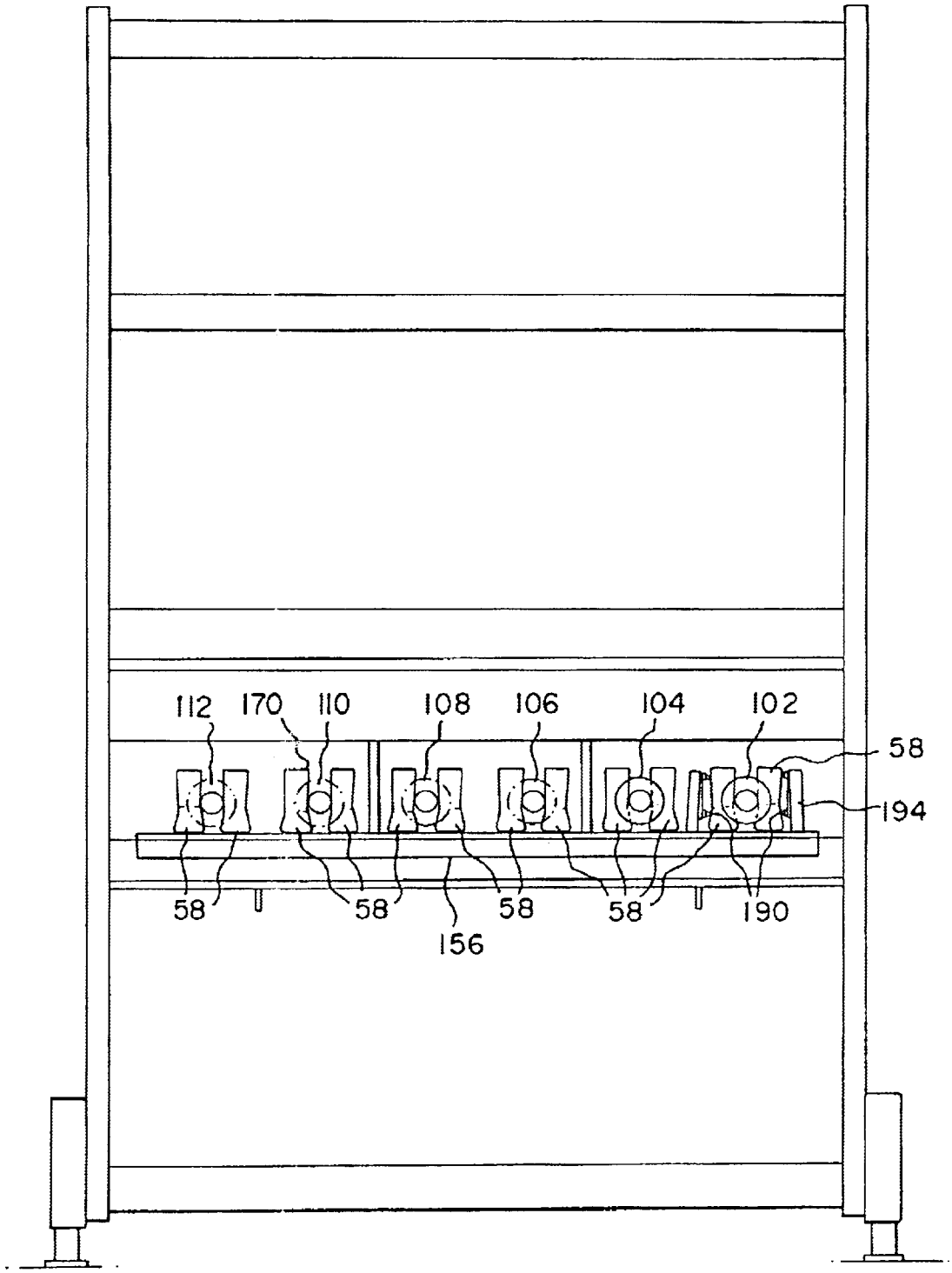
FIG. 11 is a side elevational views from the input end of the novel screw conveyor layout of FIG. 10.

Referring now to FIGS. 9, 10 and 11 containers 58 supplied by continuous infeed conveyor 60 are introduced to screw conveyors 102–112 and are transported in a discontinuous conveyor action along the length of the bed 156 of the novel filling and sealing apparatus 100. For purposes of illustration the discontinuous operation of positioning screw conveyors 102–112 will be described with respect to screw conveyors 102 and 104 (FIG. 10) which illustrate the plurality of stations along the length of the novel filling and sealing apparatus. In the novel filling and sealing apparatus in accordance with the best mode of the invention a plurality of independent filling, sealing, inspection and rejection stations and associated processes are accomplished along the length of each of the positioning screw conveyors 102–112.

Figure 10A:
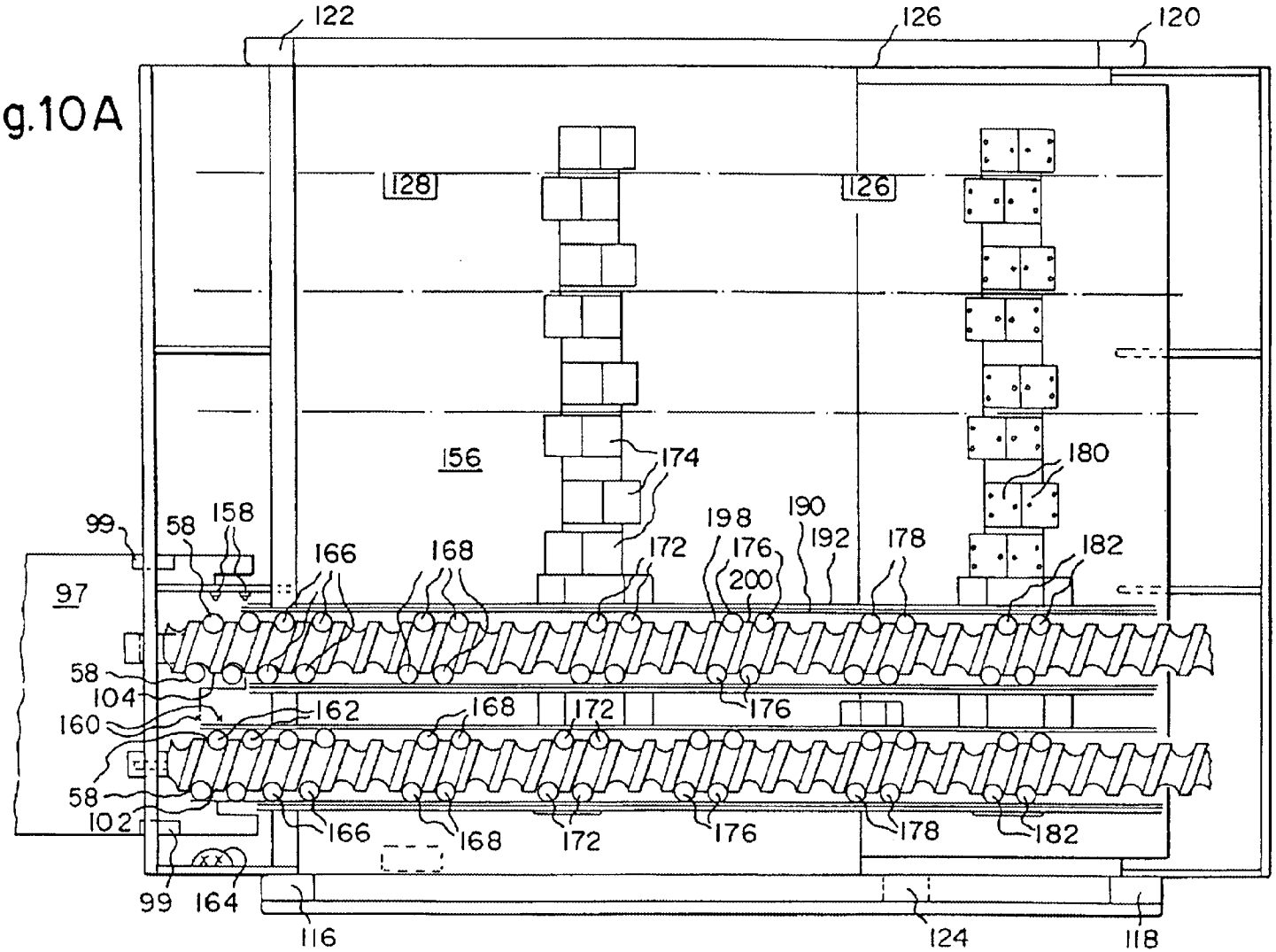
FIGS. 10A and 10B (schematic) are top plan views of an alternative embodiment of the invention illustrating container sensor areas, fill areas, fill inspection areas, fill reject areas, seal areas, seal inspection and seal reject areas in accordance with an alternative embodiment of the invention.

As the containers are introduced to the screw conveyors 102–112 which, for the purposes of illustration, will be discussed with respect to screw conveyors 102 and 104, the containers are optionally stabilized by a stabilization cover 97, which is preferably made of clear plastic material such as lexan is supported by a pair of adjustable brackets 99 which serve to stabilize containers 38 from wobbling or tipping as illustrated in FIGS. 9, 10, and 10A. The optional stabilization cover 97 is generally attached to the infeed conveyor 60 as illustrated in FIG. 9. Optional stabilization cover can be eliminated where metal, class or other containers of sufficient mass are filled in the novel filling and sealing apparatus 100. In either application the containers 58 are then position sensed by paired fill position sensors 158, 160, 162 and 164. Paired position sensors 158, 160, 162 and 164 determine the positions of the containers 58 in both screw conveyor 102 and 104 and provide the information to the computer for later use when containers 58 are advanced by screw conveyors 102 and 101 by motors 114 to the fill position 166 on both sides or the position screw conveyors.

If the position sensors 153, 160, 162 and 164 have determined both containers 58 are in proper tandem positions on both sides of screw conveyors 102 and 104 are in fill position 166, then all four of the filler heads are activated to meter a fluid food product or other fillable material into the containers 58 in fill position 166 that have been advanced to the fill position. In the event the fill position sensors 158, 160, 162 and 164 do not detect all the containers 58 in the proper tandem or lateral position or that one or both or all of the containers are missing, the information supplied by fill position sensors 158–164 to the computer prevents the release of food materials or other fluid fillable materials into the one or more missing containers 58 in fill position 166. The novel filler and sealing apparatus fills only the containers present in direct perpendicular alignment with filler heads 146 to prevent spillage or unnecessary release of materials through a positive shut-off valve as will be described hereinafter in greater detail.

For the purposes of illustration certain containers have been omitted between the various work stations. Containers are present in operation in every space between each of the threads of the screw conveyors 102 and 104 and in accordance with the invention may be positioned intermediate one or more of the work stations until the spiral conveyor advances them into one of the work station positions. As illustrated in FIGS. 10, 10A and 12 one or more containers may be disposed on screw conveyors 102–112 at positions between work stations. Containers between work stations are advanced to work stations and filled, sealed, inspected and removed in alternate sets.

In the preferred embodiment of the invention the novel filler sealer machine has sensors for sensing and providing information to the computer as to whether containers are present in their proper tandem and lateral positions. Additionally, the preferred embodiment of the invention, in addition to having position sensors 158, 160, 162 and 164, also has a fill position 166, a fill inspection position 168, a seal position 176, a seal inspection position 178 and a single reject position 182 that serves to reject all containers 58 that do not pass inspection at fill inspection position 168 or pass inspection at seal inspection position 178. These defective containers are all rejected through reject doors 180. In the preferred embodiment containers 58 that do not pass fill inspection are not sealed at seal position 176 and are rejected through reject doors 180 without a seal as well as containers that have been identified as having a defective seal. In operation the positioning screw conveyors 102 and 104 precisely position a plurality of containers simultaneously at each of the positions and the conveyor then stops while operations are performed substantially simultaneously at each of the various positions.

In operation in the preferred embodiment conveyors 102 and 104 are stopped and containers 58 are sensed bag sensors 158, 160, 162 and 164 as another group of containers in the fill position 166 are being filled and a second tandem set of containers on each side of conveyors 102 and 104 are being inspected in the fill inspection position 168. While in fill inspection position 168 containers being inspected for proper fill may also be inspected for the absence of fluids or materials on the foil seal ridge area 170 on each of the containers 58.

As fill inspection position 168 containers are being inspected the results of the inspection are sent to the computer. In seal position 176 containers that have been inspected for proper fill and have passed fill inspection are then purged of the ambient air with a purge gas and foil seals are moved in perpendicular alignment to the containers in seal position 176 and heat-seal pistons are advanced to seal the containers in seal position 176.

As containers in seal position 176 are being sealed previously sealed containers in seal inspection position 178 are being inspected for proper seal and the results of the inspection are sent to the computer. At the same time previously seal-inspected containers as well as unsettled containers that did not pass fill inspection are above reject doors 180 in reject position 182. Information from the results of the seal inspection and fill inspection are used to open the appropriate reject door 180 below the defective container.

Once the steps of sensing or the existence of a container in position, filling containers in place, inspecting containers filled, sealing property filled containers, inspecting previously sealed containers, rejecting containers for improper fill and a bad seal have been completed, the positioning screw conveyor again turns to move the containers from the idle stations between the work stations to the work stations where once again the containers in fill position 166 are filled while filled containers in fill inspection position 168 are being inspected for fill, properly filled containers in seal position 176 are being sealed, containers that were sealed are inspected in seal inspection position 176 and defective containers in the reject position 182 are being removed from the production line. This process again starts over with the turning of the positioning screw conveyor and the advancement of a new set of containers at the work stations. The properly filled, sealed and inspected containers are then discharged from output end 182 of the novel filling sealing apparatus and are transferred from the novel filling sealing apparatus 100 onto the accumulation conveyor 183. The novel filling sealing apparatus is designed to handle about 600 containers a minute along the multiple work areas along the novel screw conveyors 102–112.

Figure 10B:
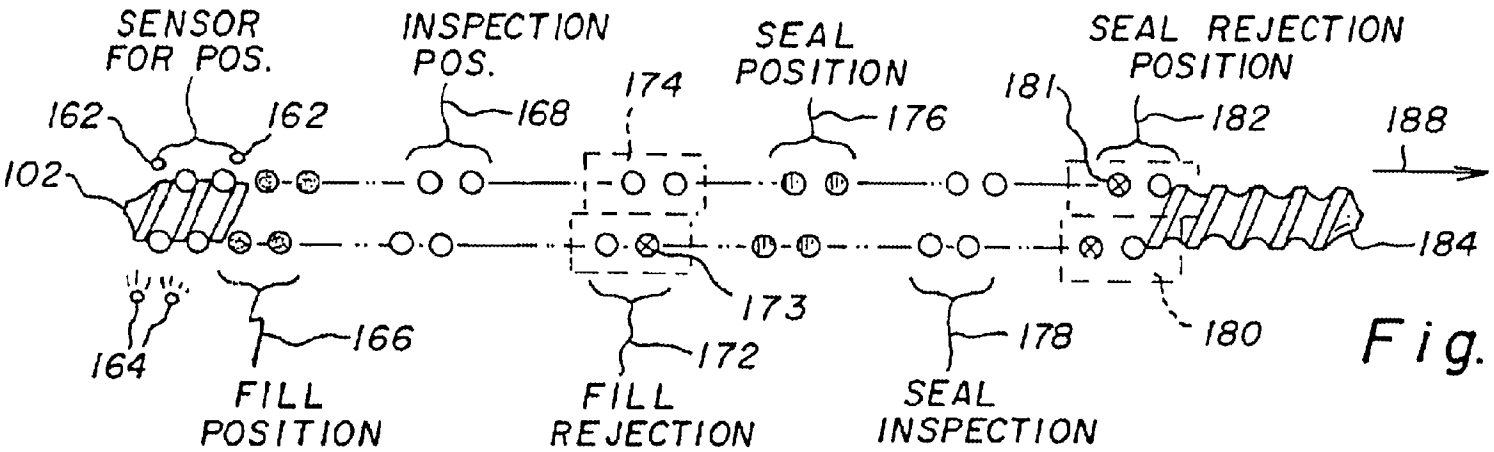

Referring now to FIGS. 10A and 10B an alternative embodiment of the invention is illustrated having an optional fill reject position 172 and optional fill reject doors 174. The fill reject position 172 is disposed between fill inspection position 168 and seal position 170 so that containers displaying fill problems are removed through fill reject doors 174 so that only properly filled and inspected containers are transferred to seal position 176. In the example in FIG. 10A container 173 was rejected through door 174 due to an improper fill and is not advanced to seal position 176. In this embodiment of the invention only containers which fail seal inspection such as container 181 are removed through reject doors 180. In this embodiment of the invention as well as in the best mode of the invention only properly filled and sealed containers complying with the highest quality control standards are transported out of the output end 182 of the novel filling sealing apparatus and are transferred from the novel filling and sealing apparatus 100 onto the accumulation conveyor 188.

The simultaneous filling, sealing, inspection for fill and seal compliance, optional rejection for improper filling and rejection for defective fill or seal takes place simultaneously along the length of conveyors 102 and 104 every time conveyors 102 and 104 are stopped to provide a full and complete filling, sealing, inspection and rejection of containers not properly filled or sealed in the novel filling and sealing apparatus of the invention. Once all of the steps of determining whether containers are in place, filling containers, inspecting filled containers, optionally removing improperly filled containers, sealing properly filled containers, inspecting seals of sealed containers and removing containers not meeting inspection standards are completed, the screw conveyors 102 and 104 turn to advance a new pair of tandem containers to sensing positions, filling positions, inspection positions, sealing positions and rejection positions to again begin the process of filling, sealing, inspection and rejecting containers that have not been properly filled or sealed in the novel filling and sealing apparatus.

As will be recognized the simultaneous filling, sealing, inspection and rejecting of containers in the novel filling and sealing apparatus requires precise positional control of the rotational positions of each of the screw conveyors 102–112 as the containers are moved from the continuous infeed conveyor 60 through the screw conveyors 102–112 to the output end 184. Not only is the rotational position of the screw conveyor 102–112 critical, but also is the substantially perpendicular alignment of the containers with each of the inspection, filling, sealing and reject station along the bed 156 of the novel filling and sealing apparatus. The most critical positional alignment position is the containers in seal position 176 which must be positioned in substantially perpendicular alignment to the heat sealing piston to within one thirty thousandth of an inch tolerance to provide a proper heat-seal to the container.

The critical importance of the rotational position of the critical importance of the rotational position of the screw conveyors 102 and 104 at the multiple filling, sealing, inspection and reject stations as well as the perpendicular alignment of the containers 58 at each one of the stations is assisted by the utilization of a plurality of guide rails disposed on each side of the screw conveyor 102–112 These guide rails 190 together with the action of the crew conveyor and bottom guide rods and seal position plates under seal position 176 along with a substantially flat bottom surface of the container provides the combination of positive control forces necessary to provide a positive position control over containers without crushing, bending or binding containers in the novel filling sealing machine of the invention.

Figure 14:
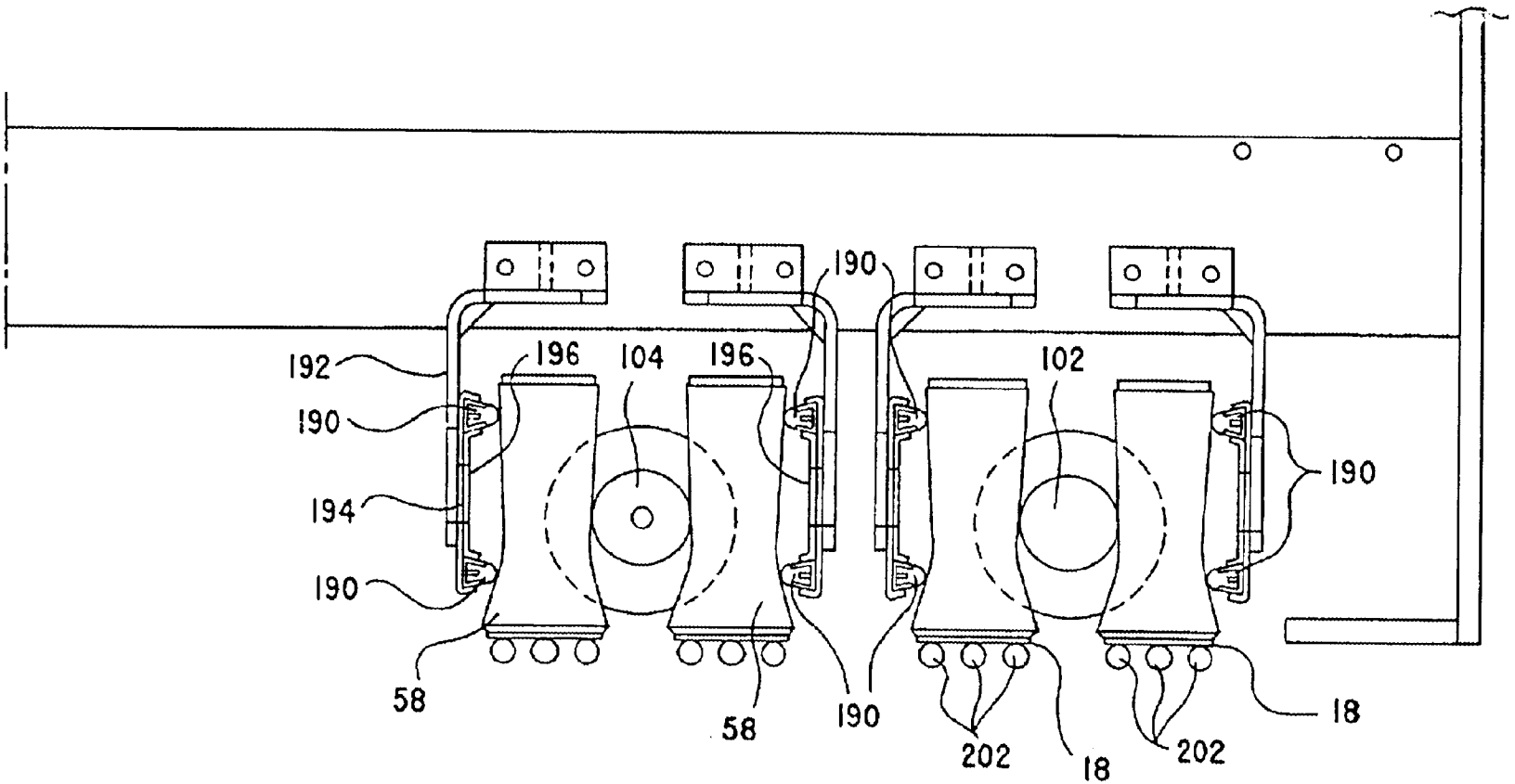
FIG. 14 is a side view from the input end illustrating the relationship between the container, screw conveyor, guide rails and support rods in accordance with the preferred embodiment of the invention.

Referring now to FIGS. 10, 11 and 14 the guide rails 190 are supported in place by brackets 192 and 194 together with anchoring brackets 196. Guide rails 190 are designed to provide minimum resistance, maximum perpendicular alignment for container 58 in screw conveyors 102 and 104. The perpendicular alignment assistance provided by guide rails 190 along with the relationship of the container between the threads 198 and 200 (FIG. 10) of the screw conveyors 102, 104 assist in the perpendicular alignment of container 58 at each of the filling, sealing, inspection and rejection station along the bed 156 of the novel conveyor apparatus 100. In addition a plurality of rods 202 are provided to provide minimal resistance to the flat bottom 18 of container 58 as it moves along conveyors 102 and 104. Rods 202 in the preferred embodiment extend from between the input end (FIG. 11) to the seal position 176 at which point flat plates or a flat bed extends to reject doors 180 to assist in the positive positioning of the container and balance or control forces utilized to hold the container at close tolerances at the seal position 176 work station. Rods 202 are replaced by flat plates at seal position 176 to assist in providing a flat support for flat bottom 18 of container 58 at seal position 176.

The clockwise rotation of screw conveyors 102 and 104 exert downward forces on the container on the right side of conveyors 102 and 104 from the input end (FIG. 11) and upward forces on the container 58 on the left side of screw conveyors 102 and 104. These forces are dissipated and controlled by the utilization of guide rails 190 together with rods 202 and the angular relationship between thread 198 and 200 and profile of the container. The control of forces are also assisted by the materials of which the screw conveyors and guide rails are constructed. In the preferred embodiment the guide rails are constructed of Teflon® and the screw conveyor is constructed of Delrin® plastic. In the preferred embodiment the six screw conveyors are powered by three drive motors 114, each of which drive motor synchronizes two of the six screw conveyors. The screw conveyors are supported by bearings, both at the ends and the center of each of the screw conveyors. The drive motors 114 provide a drive index at a range of 2.4 to 2.5 seconds per cycle per screw conveyor, producing a range of about 192 containers to 200 containers per minute per module, or an output range of about 576 containers to 600 containers per minute per all three modules.

Figure 15:
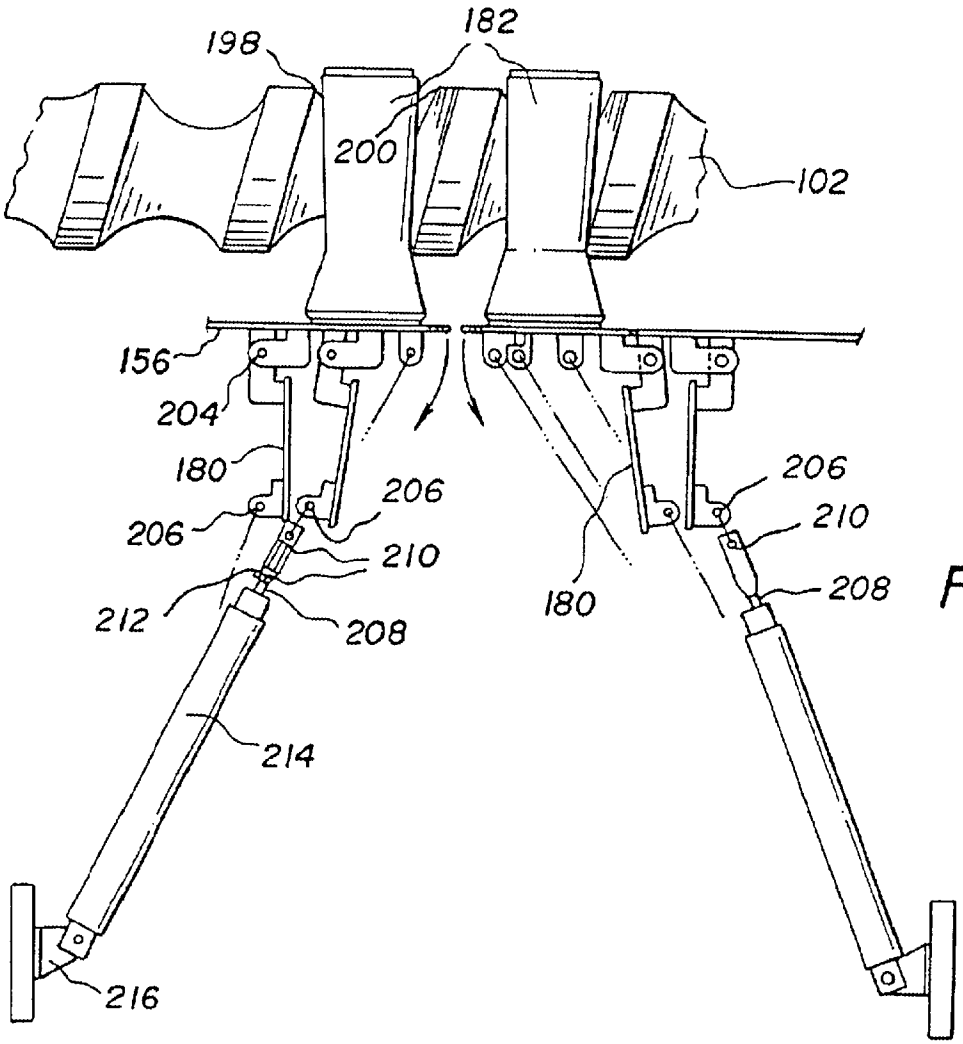
FIG. 15 is a side elevational view of a mechanism for activating a reject door in accordance with the preferred embodiment of the invention.

Referring now to FIG. 15 the reject doors are illustrated in which both the optional fill reject doors 174 and the fill and/or seal reject doors 180 operate in the same manner. For the purposes of illustration only the reject doors 180 will be described since optional fill reject doors are configured and operate in the same manner. Containers in reject position 182 on either side of screw conveyor 102 in tandem are permitted to fall through the four individually controllable and activated doors 180, two of which doors 180 are on either side of screw conveyor 102. Bach of the doors 180 are pivoted to bed 156 at a pivot 204 and are connected to a pivot bracket 206 and to a piston 208. Piston 208 preferably includes an adjustable mating bracket assembly 210. Mating bracket assembly 210 can be secured by a nut 212 to impart adjustability between adjustable bracket assembly 210 and piston 208. Piston 208 is activated through cylinder 214 which is attached to bracket assembly 216 to open and close reject door 180. As heretofore discussed, information from fill inspection position 168 and seal inspection position 178 are used to determine whether a particular fill or seal is defective and, if so, once the defective container in the fill inspection position 168 or seal inspection position 178 has been moved to reject position 182, the corresponding reject door is opened to remove that container from the screw conveyor 102 production line.

Figure 16:
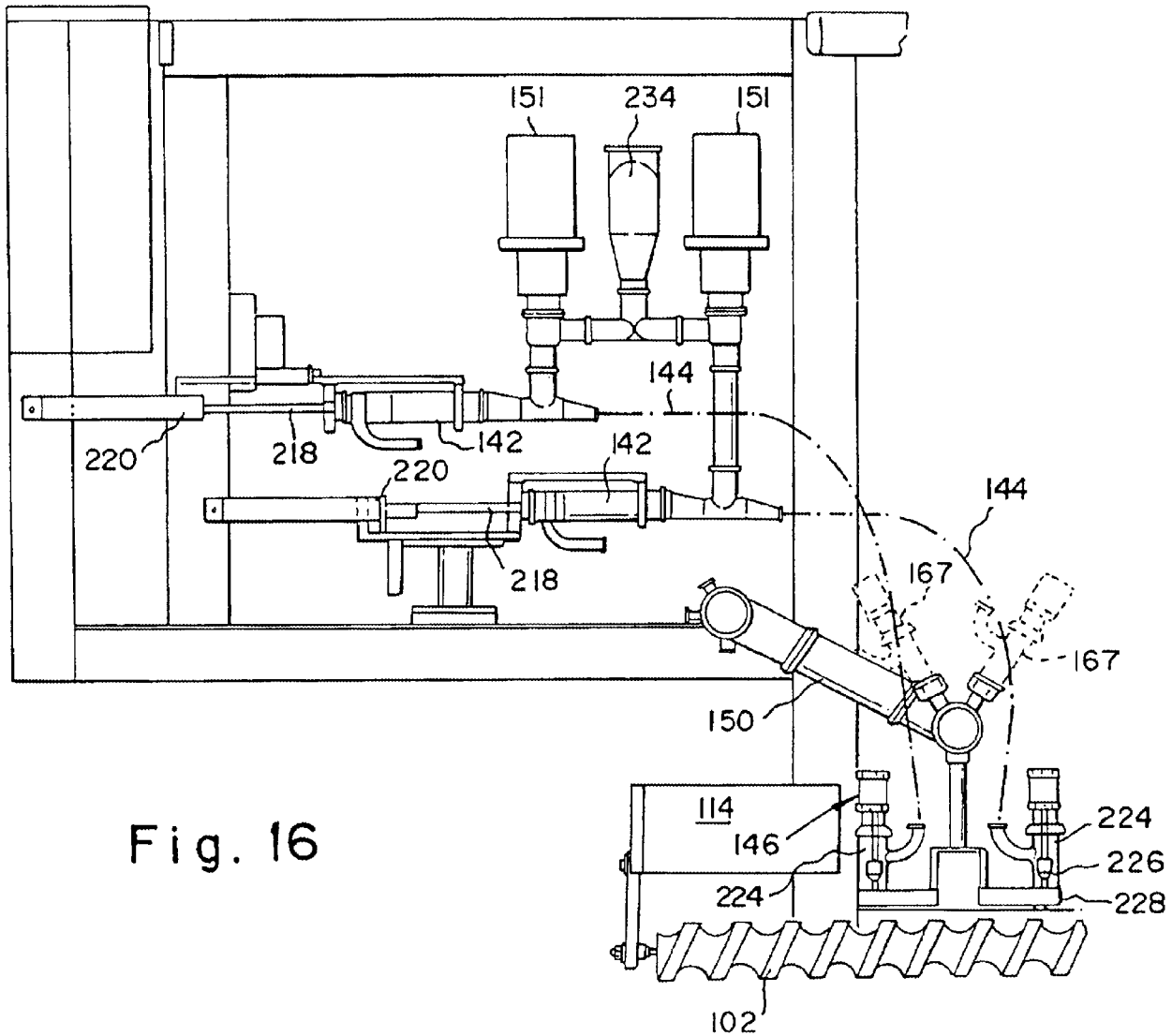
FIG. 16 is a side elevational view illustrating the filler assembly of the novel filler sealer machine of the invention.

Referring now to FIGS. 9 and 16 the filling device for filling containers 58 will be further described. Fluid materials such as a flowable foes product are pumped from a product supply 151 to a piston cylinder product reservoir 142 and then are transported through four hoses 144 by four independently controllable pistons 213 to he four independently controllable filler heads 146. The independently controllable pistons 218 are controlled by individual switches 220 for metering the fluid product to filler heads 146 through hoses 144. Filler heads 146 each contain a further piston 224 with a tapered head 226 which fits into a tapered piston seat to form a positive control shut-off valve 228 for precisely metering flowable materials into fill containers 38 in fill position 166.

Figures 16A, 16B, 16C, 16D:
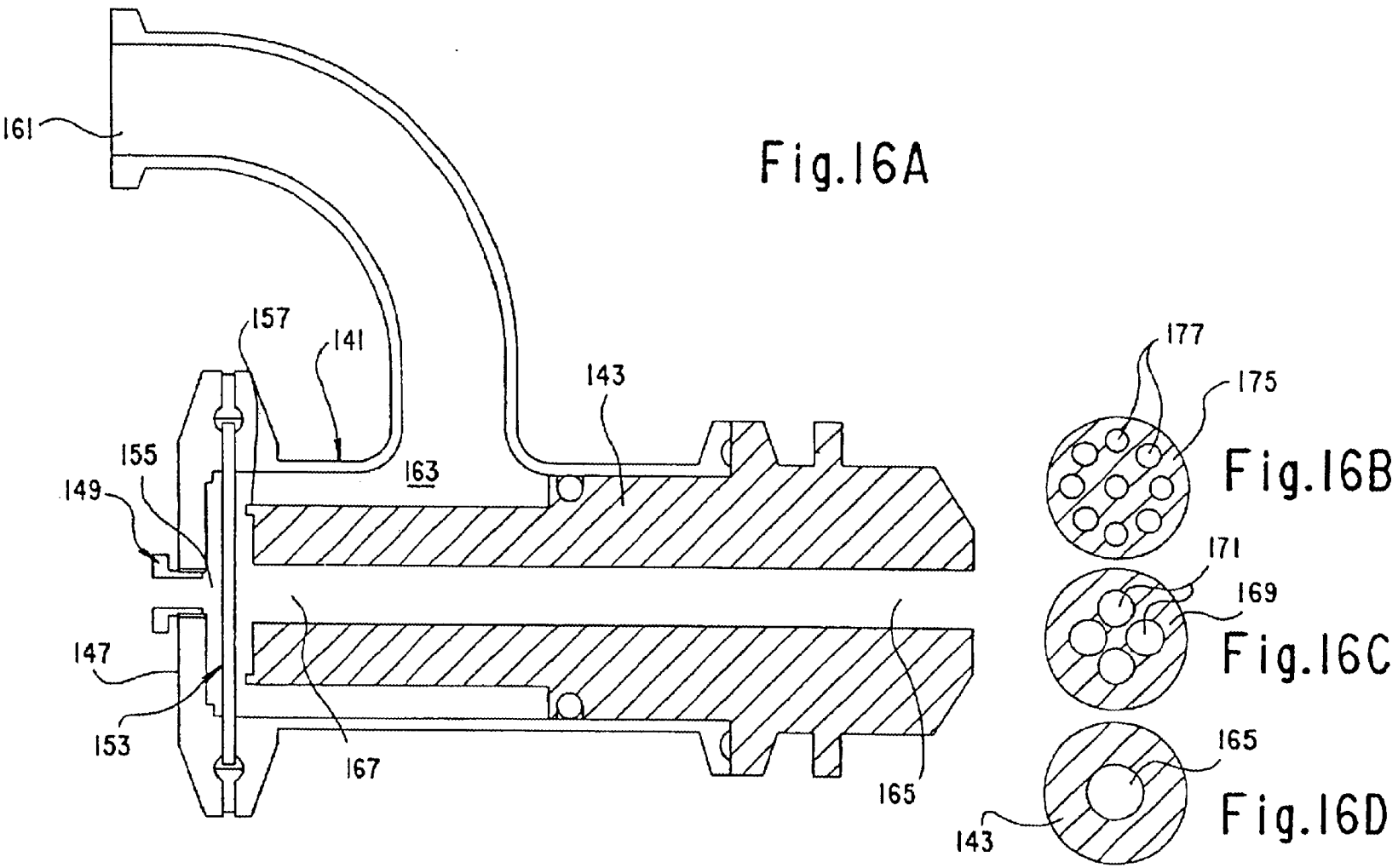
FIG. 16A is a side elevational views of a novel positive shut-off valve constructed in accordance with the invention.
FIGS. 16B, 16C and 16D are alternative embodiments of cross-sections of nozzles for the novel positive shut-off valve of FIG. 16A.

Referring now to FIGS. 16A and 16D a modified filler head 141 is illustrated having a positive shut-off valve in accordance with the preferred embodiment of the invention. The piston 224 and piston seat forming positive shut-off valve 228 of filler head 146 were replaced by Delrin® nozzle 143 sealed to modified filler head 141 by an O-ring seal 145. Modified filler head 141 also includes an end plate 147 with an air inlet fitting 149. A resilient diaphragm 153 and plenum space 155 is provided between end plate 147 and modified filler head 141. A rim 157 on nozzle 143 is designed to mate with diaphragm 153 when air pressure is provided through inlet fitting 149 into plenum space 155 to form a positive shut-off valve in accordance with the preferred embodiment of the invention.

Modified filler head 141 functions as the positive shut-off valve of the preferred embodiment by receiving a fillable product from product supply 151 through product reservoir 142 by the operation of piston 218 to pump the fillable product through product reservoir 142 and hose 144 into inlet 161 of modified filler head 141 which fillable product flows into chamber 163 around nozzle 143 and past diaphragm 153 and through passage 165 into container 58 in fill position 166 (FIG. 10). Once the proper amount of fillable product is metered into container 58 in fill position 166 air pressure is introduced through inlet fitting 149 and into plenum space 155 to force diaphragm 153 down over rim 157 of nozzle 143 to close off passage 165 and prevent further product from flowing down passage 162.

Referring now to FIGS. 16A, 16B and 16D alternative embodiments of nozzles 143 are illustrated having a variation of passages 165. The body of the nozzles in 16B and 16C are the same as the nozzle in 16A with a rim 157 and an inlet 167 which in the case of nozzle 169 divides into four passages 171 and in the case of nozzle 175 terminates in nine passages 177. The additional passages 171 and 177 in nozzles 169 and 175 are provided to suit the flow viscosities and characteristics of various flowable products to provide additional control over dripping and sloshing of fillable products during the filling of containers 58 in fill position 16.

Figure 17:
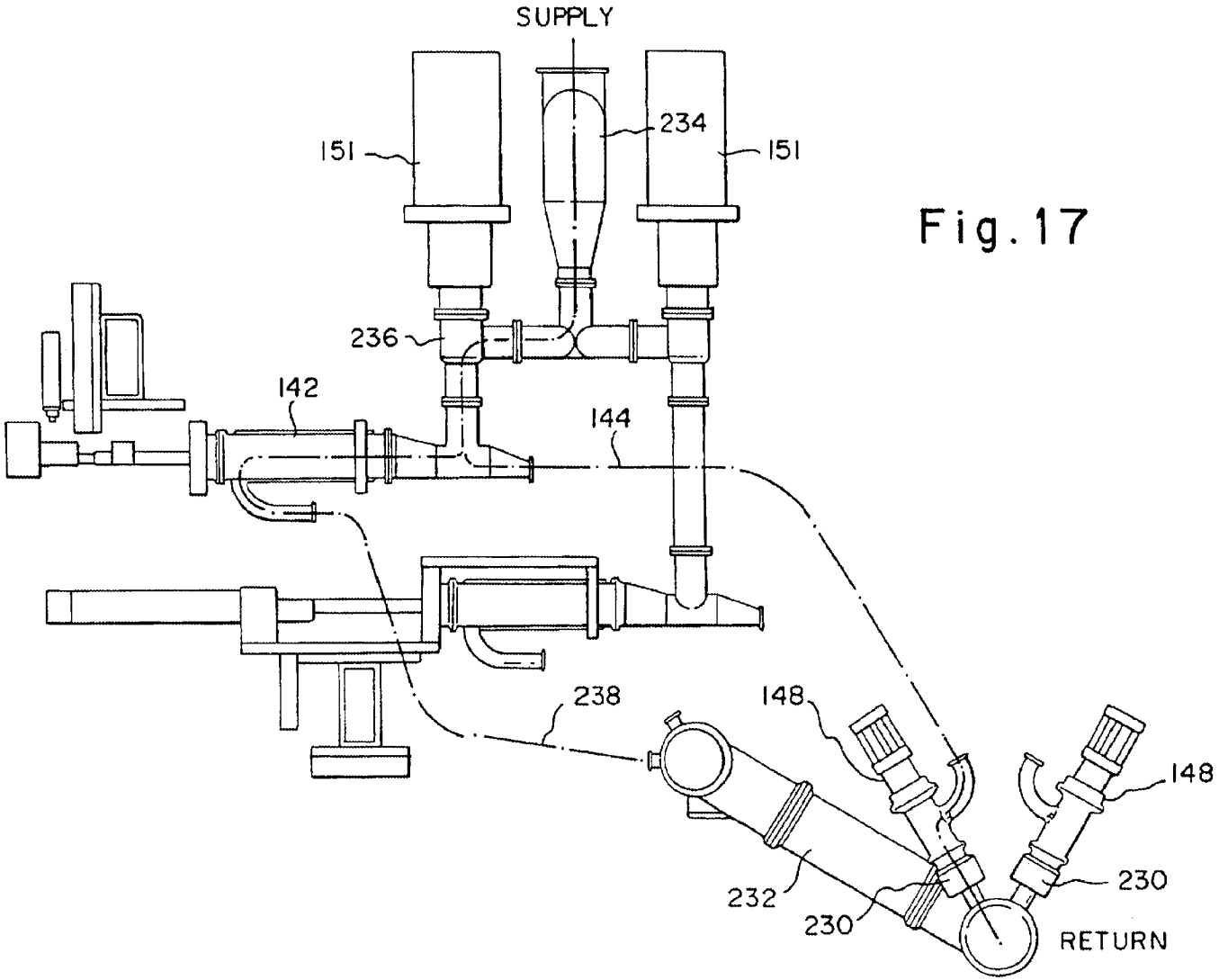
FIG. 17 is a cleaning fluid circulation flow diagram of the clean in place system which periodically provides for the circulation of a cleaning fluid through the piston and cylinder and positive shut-off valve to clean the novel filler sealer machine.

Each of the filler heads 146 including modified filler heads 141 can be moved from is fill position 166 to a cleaning position as represented by filler heads 148 in clean position for cleaning (FIG. 17). Referring now to FIG. 17 the cleaning of the novel filling and sealing apparatus will be described for only one of the filler heads 146 in the clean position 148 since all the other filler heads are cleaned in the same manner at the same time. Filler head 146 is connected to filling head cleaning port 230 of cleaner housing 232 and a cleaning solution from cleaner reservoir 234 is pumped through the outlet 236 of product supply 151 and through piston and cylinder product reservoir 142. Product reservoir 142 is connected with a cleaning hose 238 to cleaner housing 232 and through filler head cleaning pore 230 into filler head 146 in cleaning position 148 and through hose 144 back to anti through the piston cylinder combination of product reservoir 142. Cleaning solution from cleaner reservoir 234 may be circulated in both directions to provide cleaning of the product filler elements. In addition the positive shut-off valve 228 may include special cleaning ports in filler head cleaning port 230 to assist in the cleaning of the positive shut-off valve. Modified filler head 141 as well as the various nozzles 143, 169 and 175 as well as diaphragm 153 and chamber 163 may be cleaned in a similar manner. Additional cleaning may be provided for the entire area by cleaning showers to clean all areas exposed to fill materials and the foil sealing pistons or other sealing means utilized. The novel ambient air purging foil sealing pistons are mounted to a pivotal housing to allow the foil sealing pistons to be pivoted away from the sealing position for cleaning.

Referring now to FIGS. 18, 18A, 18B, 18C, 18D, 18E and 19 the operation of sealing mechanism 152 is illustrated together with the foil transfer mechanism 150 that in the preferred embodiment includes a pick and place mechanism 240 together with a shuttle plate 258. The pick and place mechanism 240 and shuttle plate 258 coordinate their operation when containers 58 are moved into seal position 176 below the novel sealing and purging pistons 242. The pick and place mechanism 240 which includes a 180 degree turnable transport mechanism 244 has four vacuum-activated suction cuss 246 that upon the application of a vacuum to each individually controlled suction cup 246 takes an individual circular foil seal 248 from each of the foil seal supply tubes 250. As heretofore described, when one or more of the containers 58 are not in seal position 176, a vacuum is not applied to the particular suction cup 246 corresponding to the missing container in seal position 176. As a result, whichever container is missing, the 180 degree turnable transport mechanism 244 with suction cups 246 does not advance a foil seal 248 to the opening in shuttle plate 258 that corresponds to the particular seal position 176 missing a container or that has a container that has failed fill inspection.

Figure 18:
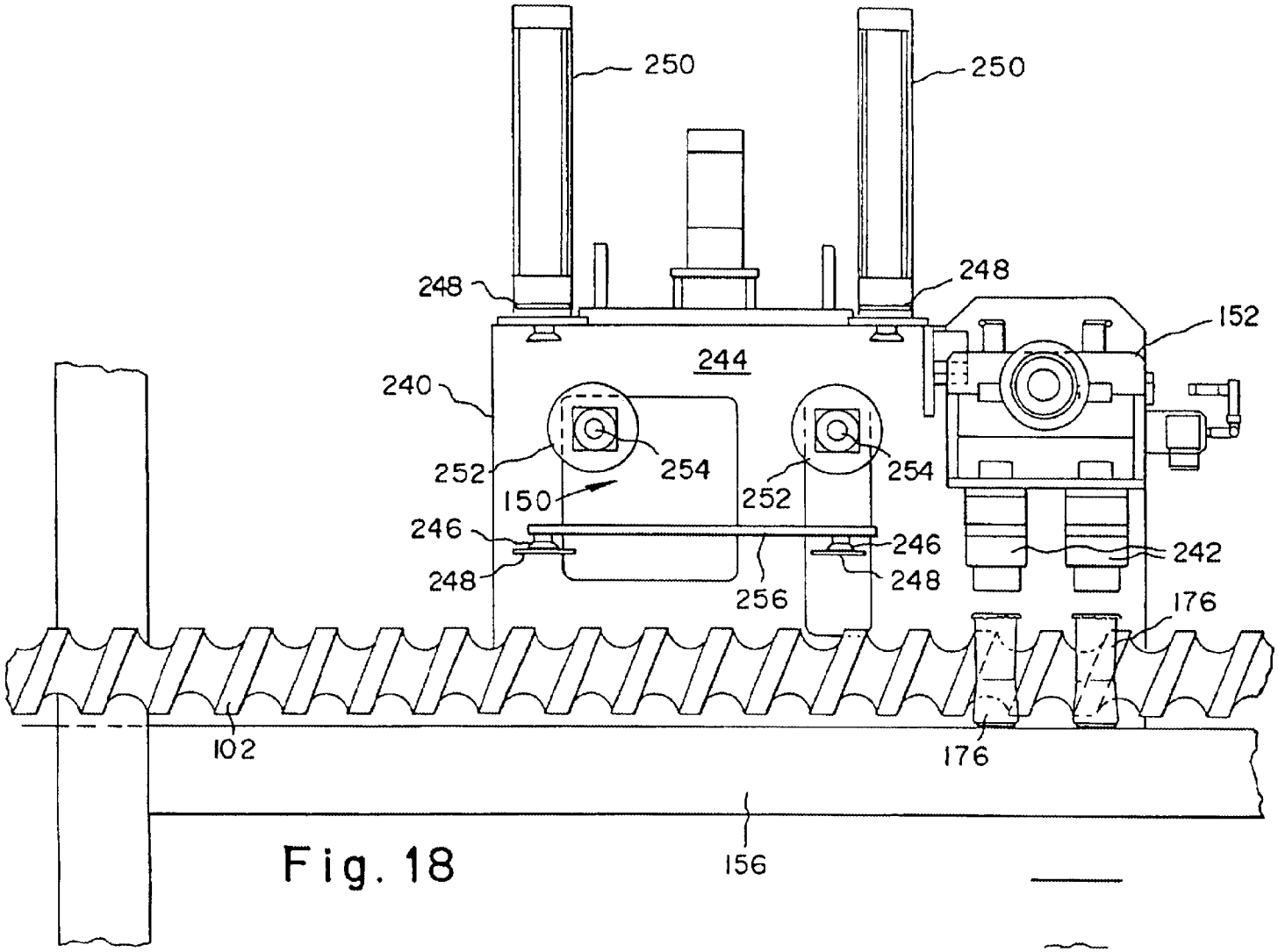
FIG. 18 is a side elevational views of the pick and place and shuttle plate mechanisms for advancing a foil to a container at the sealing area.
Figure 18A:
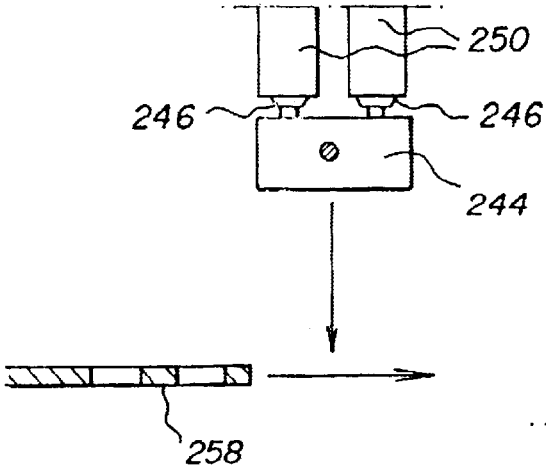
FIGS. 18A, 18B, 18C, 18D and 18E are schematic side elevational views illustrating the operation of the pick and place and shuttle plate mechanisms for advancing a foil to a container at the sealing area.
Figure 18B:
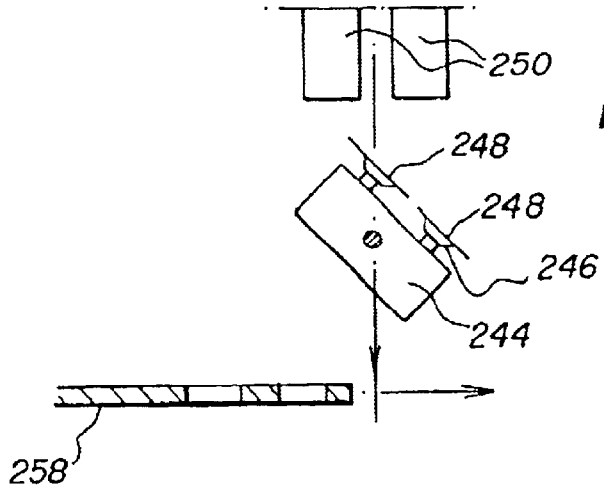
Figure 18C:
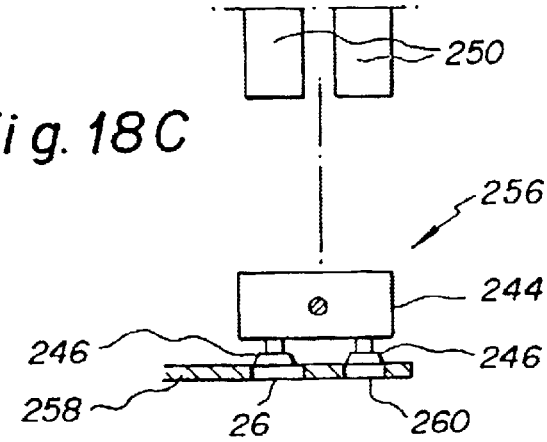
Figure 18D:
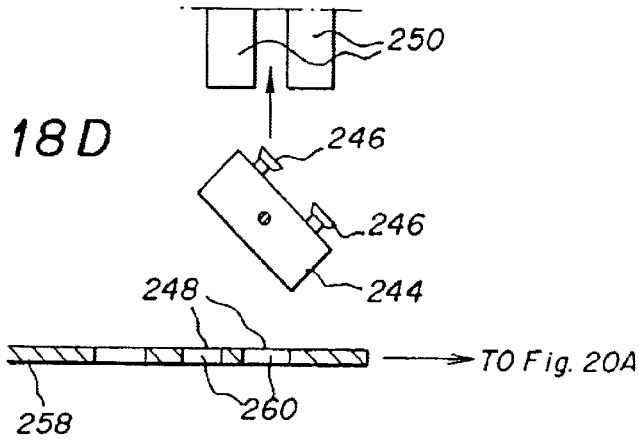

Once 180 degree turnable transport mechanism 244 receives the precise number of foil seals 248 needed to seal, containers 58 in seal position 176, the 180 degree turnable transport mechanism 244 travels down a cam 252 (FIG. 18) with cam followers 254 and pivots transport mechanism 244 from the suction cup 246 'up position' (FIGS. 18A and 18B) with foils 248 in place to the suction cup 246 'down position' 256 (FIG. 18C). At the suction cup 'down position' suction cups 246 deposit the necessary foil seals 248 by the release of vacuum on suction cups 246 onto shuttle plate 258 (FIG. 18D) in openings 260.

Figure 18E:
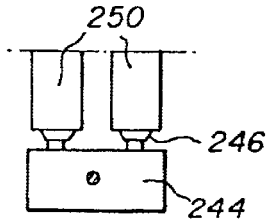
Figure 20A:
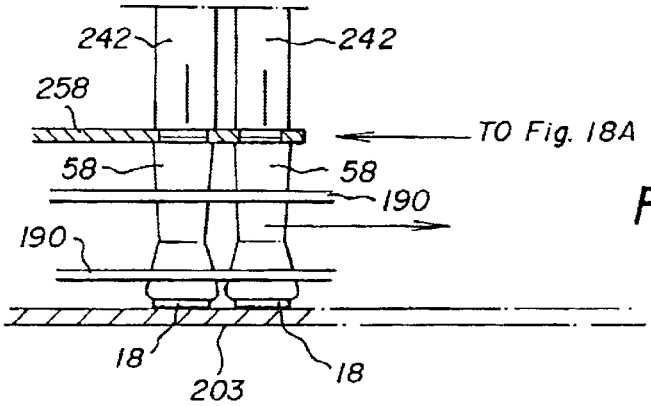
FIGS. 20 and 20A (schematic) are side elevational views of the pivotal heat-sealing and ambient air purging assembly of the novel filling and sealing apparatus of the invention.
Figure 19:
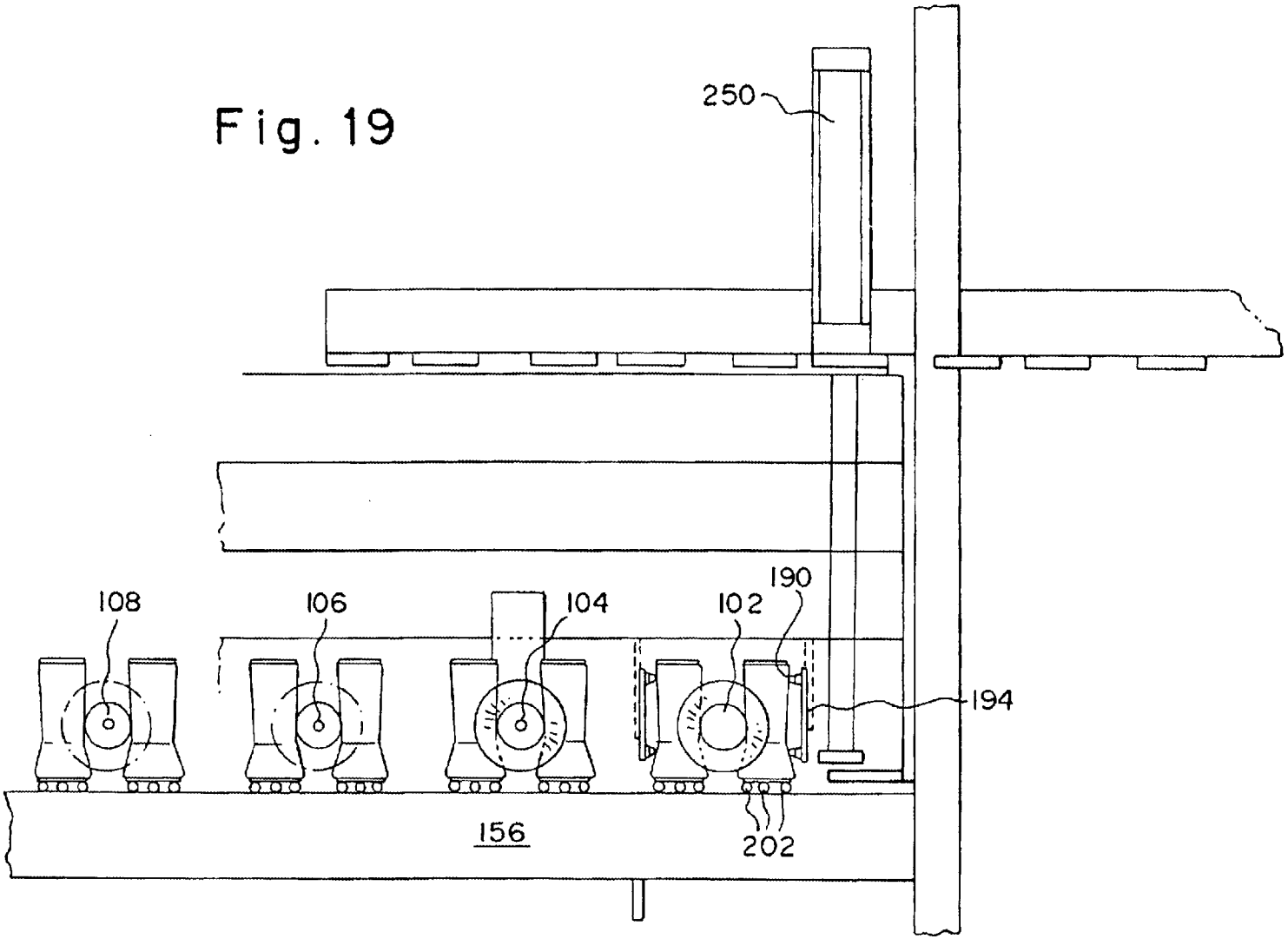
FIG. 19 is an input side elevational view of FIG. 18.

Openings 260 containing the requisite foil seals 248 are moved by shuttle plate 258 (FIG. 18D) to above containers 58 in seal position 176 (FIG. 20*a*) below sealing and purging pistons 242. Just prior to shuttle plate 258 moving foil seals 248 into position above the containers in seal position 176 sealing and purging pistons 242 purge ambient air from containers 58 (FIG. 2G) through a center purge port 262 while transport mechanism 244 returns to its position below seal supply tubes 250 (FIG. 18E). Purge port 262 purges ambient air from containers 58 in seal position 176 wish nitrogen gas just prior to the arrival of shuttle plate 258 with foil seals 248. Once shuttle plate 258 is in position with foil seals 248, the sealing and purging pistons 242 are advanced toward containers 58 in seal position 176 which push foil seals 245 through openings 260 (FIG. 20A) and crimp foil seals 248 around necks 264 of containers 58 in seal position 176 (Picture 3). A comparison of prior art Picture 2 and 3 with Picture 5 and 6 shows the difference in appearance of the product and foil seal produced in accordance with the invention utilizing the novel sealing and purging pistons 242.

Once the foil seals 248 have been pushed through openings 260 and crimped around neck 264 of containers 58, tapered lip 266 (FIGS. 21C, 21D) of sealing and purging pistons 242 assist in pressing foil seal 248 in place around the circumference of neck 264 (FIGS. 21A, 21B) and heating element 268 is activated to heat-seal foil seal 24S to lip 270 of containers 58. Heating element 268 is spring-biased and is allowed to free-float within opening 274 of the sealing and purging piston 242. The free-floating heating element 268 in opening 274 allows the heating element 268 to resiliently conform to the position of containers 58 in seal position 176 to provide a positive seal. Flat plates 203 are utilized in place of rods 202 under seal position 176 to provide a more stable support for bottom 18 of container 58 during sealing of foil seal 248. Sealing and purging piston assembly 276 which holds sealing and purging pistons 242 allows pistons 242 to be pivoted from its position perpendicular to screw conveyor 102 for cleaning purposes as illustrated in FIG. 21F.

Figure 20:
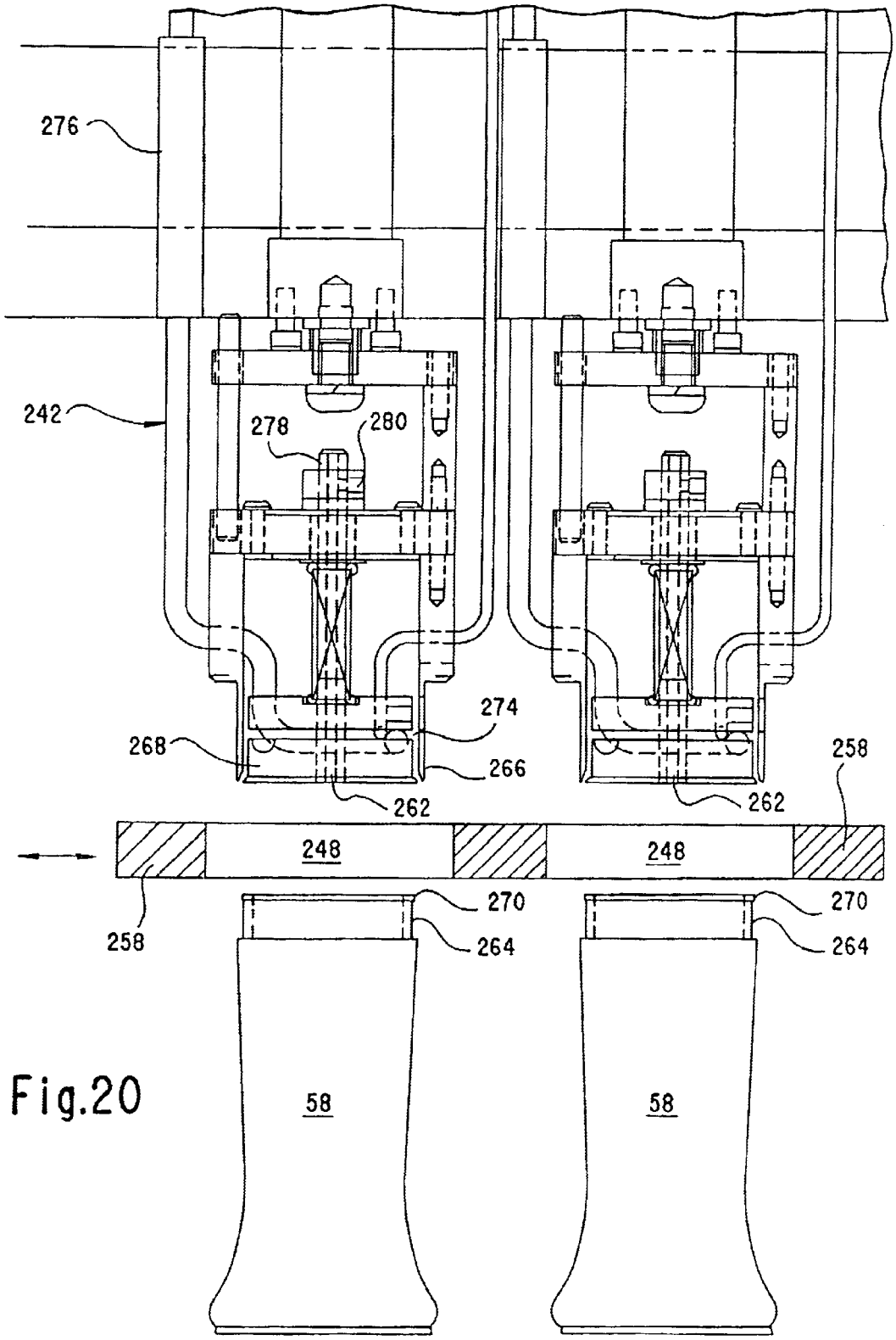
Figure 21:
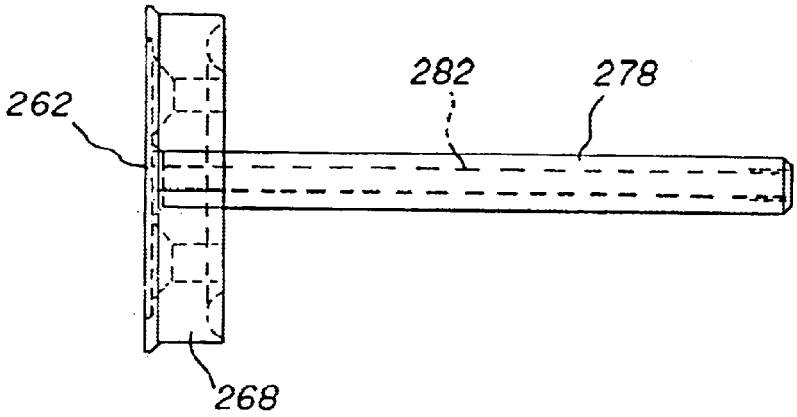
FIGS. 21, 21A, 21B, 21C, 21D, 21E and 21F (21A–21F schematic) are side elevational views of a novel heat-sealing ambient gas purging piston of the invention.
Figure 21A:
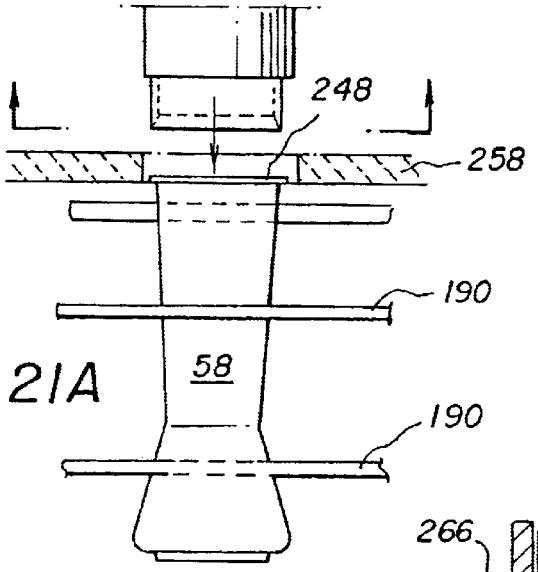
Figure 21C:
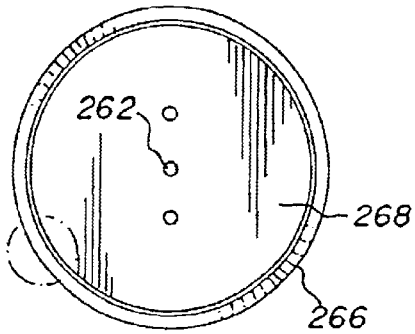
Figure 21D:
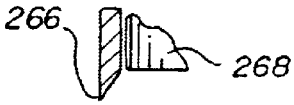
Figure 21B:
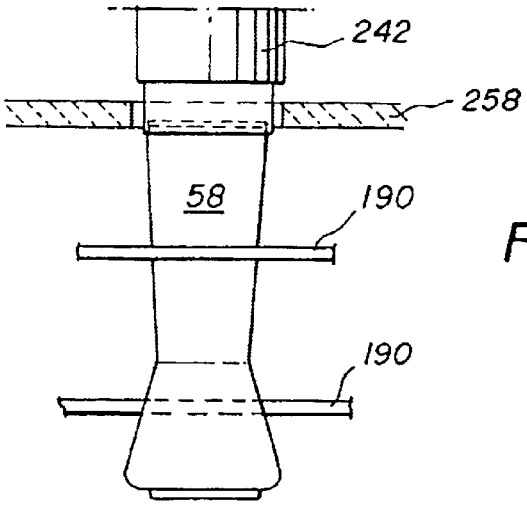
Figure 21E:
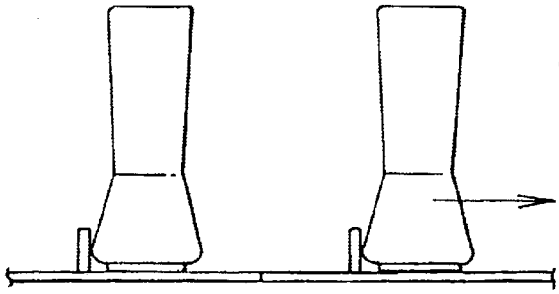
Figure 21F:
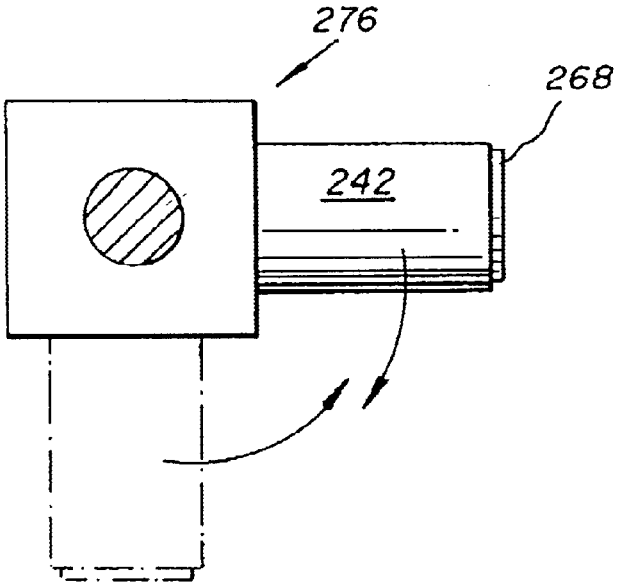
Figure 23:
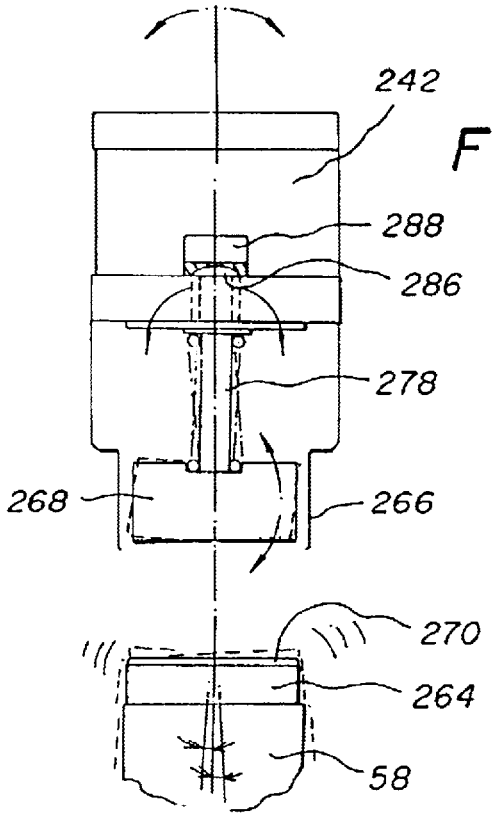
FIG. 23 is a side elevational view part y in section illustrating the advantages of the novel heat-sealing ambient air purging piston utilizing pivot bearing of the preferred embodiment of the invention.

Referring now to FIGS. 20 and 21 sealing piston 242 includes a cylindrical shank 278 which is attached by fastener 280 to the purging and sealing piston assembly 270. Cylindrical shank 278 includes a passage 282 to provide a purge gas to purge port 262. The fastening of cylindrical shank 278 in purging and sealing piston assembly 276 limits the movement of cylindrical shank 278 and requires all of the resiliency in heating element 268 to be borne of the interface between lip 270 of container 58 and free-floating heating element 268.

Figure 22A:
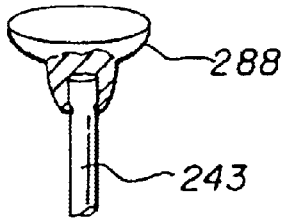
Figure 22B:
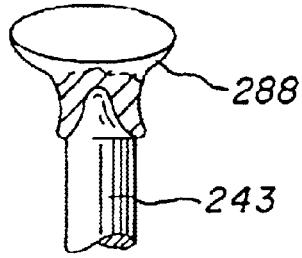
Figure 22C:
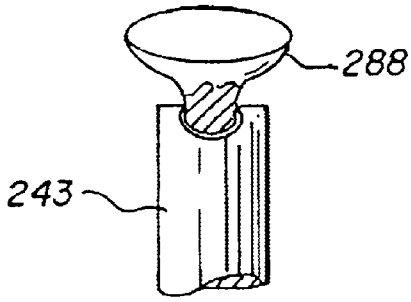

A modified purging and sealing piston 243 is illustrated in FIG. 22 in which cylindrical shank 278 is no longer fastened to purging and sealing piston assembly 276 by fastener 280. Instead cylindrical shank 278 of purging and sealing piston 243 terminates in a bill or pivot bearing. As illustrated in FIG. 22 the pivot bearing is provided by the rounded or tapered end 286 in combination with slightly cupped disk 288 which is attached to purging and sealing piston assembly 276 in place of fastener 280. It will be recognized the additional pivotability provided by a pivot beating at the base of the cylindrical shank 278 extends the pivotability of the floating heat element 268. Other types of pivot bearings or ball and socket bearings are illustrated and include a tapered rod pivot bearing, FIG. 22A, a Schiele's pivot bearing, FIG. 22B and a ball and socket bearing illustrated in FIG. 22C and FIG. 22D. Other types of pivot or ball bearings may be provided at the end of cylindrical shank 278 to impart pivotability and provide greater resiliency in providing a seal on containers 58.

After containers 58 in seal position 176 are sealed they are then moved to seal inspection position 178 for seal inspection (FIG. 10). The results of the seal inspection are stored in a computer along with he results of the fill inspection so that, when the containers are moved to reject position 182, a reject door under the defective container is activated by the computer to remove the defective container from the assembly line. As a result only containers meeting fill and seal inspection requirements are transported out of output end 184 onto the accumulation conveyor 188 of the novel production line of the invention.

As will be recognized by those skilled in the art, the precise positioning of the container at each of the filling, sealing and inspection stations is critical to provide the simultaneous filling and sealing of containers along the length of screw conveyors 102 and 104. It will also be recognized that the shape of the container in relation to the configuration of screw conveyor 102 is important in positioning and also removing containers through reject doors 180 and also through optional fill reject doors 174 where fill reject doors are used. The advantage of utilizing fill reject doors is to remove containers from the production and not waste resources on handling and possibly sealing containers that may not be properly filled or by allowing such containers to remain in the production line. The shape of the container is important to allow its removal through reject doors 180 since, if the too portion of the container is larger than the bottom nor ion of the container, the container will not be able to fall through reject doors 180.

As a result in the best mode of the invention a tapered cylindrical container having a base of a larger diameter and having a decreasing taper to the top is preferred. The preferred tapered container is preferred in the best mode because the container is held in positive position all along the length of the screw conveyor by not only threads 198 and 200 of each of the screw conveyors against the sides of the container but also the coaction between the guide rails 190 against the side of the container and rods 202 or bottom support plates on the bottom of the container. This positive engagement along the entire length of the screw conveyor provides the advantages of the invention in precisely positioning the container at all work stations along the length of the screw conveyor and allows the close sealing tolerances of about one thirty thousandth of an inch to be achieved where the containers are sealed with a foil heat-seal.

The advantages of positive control over the containers along the entire length of the screw conveyor can be a disadvantage in removing containers having a larger top from being removed from the screw conveyors since the screw conveyors are not reversed and the tension upon the sides of the containers is designed to be a positive force to hold the containers in a positive position throughout the length of the screw conveyors. This positive force on the screw conveyor is provided in the best mode of the invention by utilizing a screw conveyor having a uniform diameter from end to end and spiral threads of a uniform spiral angle to uniformly maintain pressure on the container at each of the work stations along the length of each screw conveyor.

In alternative embodiments of the invention containers having a top larger than the base of the container can be filled and sealed in the novel filler sealer machine. In such alternative embodiments of the invention containers having a uniform diameter or a larger top than base can be filled and sealed in the novel filler sealer apparatus by either utilizing a modified screw conveyor or by not removing defective containers from the screw conveyor.

Figure 12A:
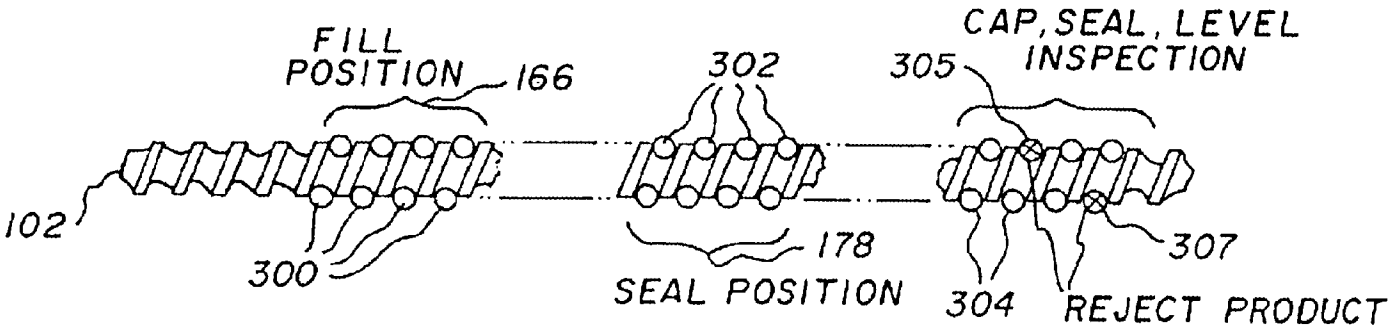
FIGS. 12 and 12A (schematic) are top plan views of a screw conveyor layout in accordance with an alternative embodiment of the invention utilizing filler areas, seal areas and inspection areas of the novel filler sealer machine of the invention.
Figure 12:
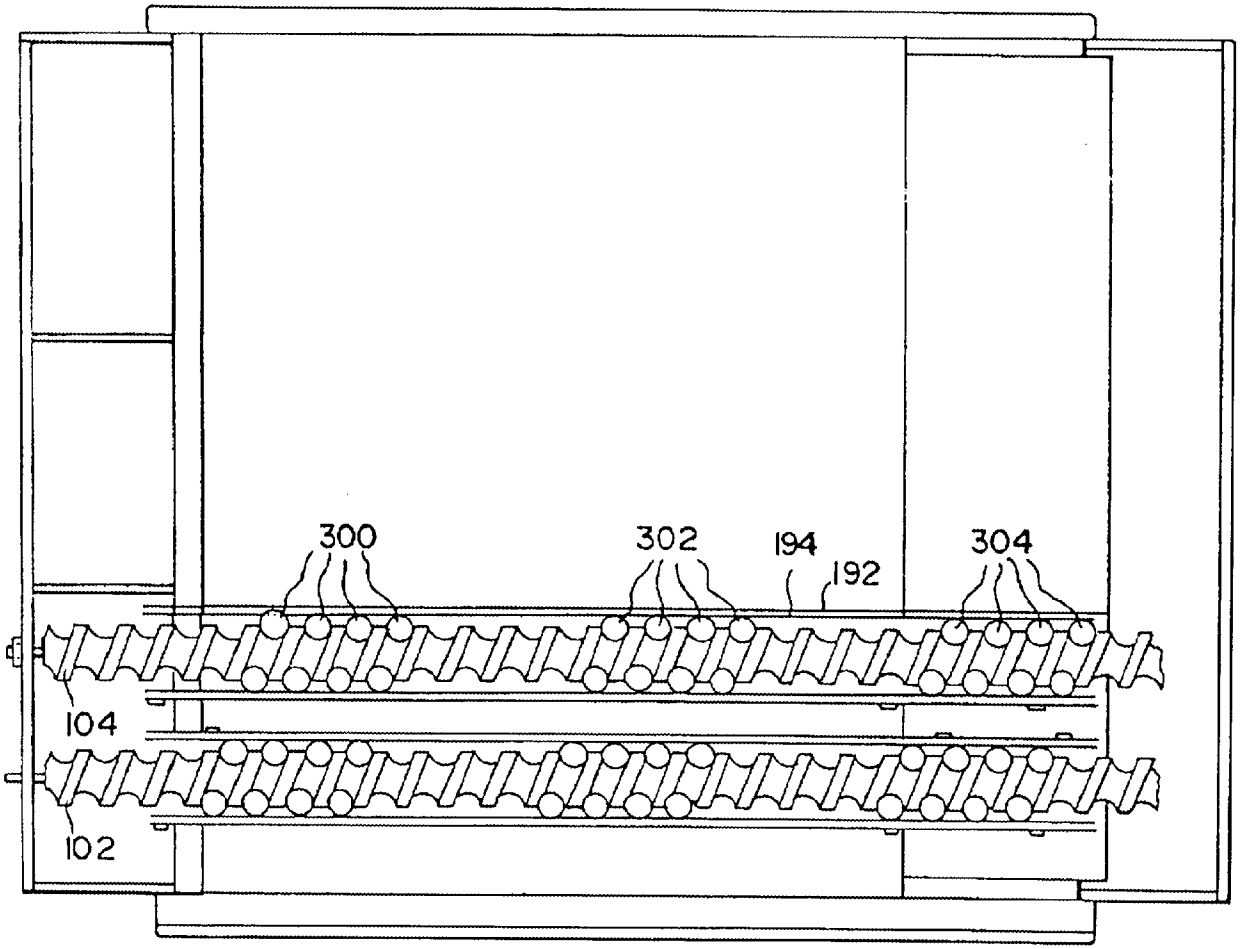

Referring now to FIGS. 12 and 12A an alternative embodiment of the invention is illustrated, where a plurality of containers 300 are simultaneously filled on both sides of screw conveyor 102 and 104. Containers 300 have a top larger than the bottom of the container and may be similar in configuration to containers 57 in orientation conveyor 32 of FIG. 8A. The simultaneous filling in this case of eight containers 300 per conveyor lane coincides with the stopping of the conveyor while containers 302 are simultaneously being sealed while an additional group of containers 304 are simultaneously being inspected for fill and seal and marked with a dye or ink if the containers did not pass a filling and sealing inspection. For example, in FIG. 12B container 305 did not pass fill inspection and container 307 did not pass seal inspection and are marked with a dye.

Containers 304 not marked and pass inspection, are moved out of the novel filler sealer apparatus and subsequently packaged or handled. Containers 305 and 307 that do not pass inspection and that have been marked with an ink or dye may be subsequently removed at another point in the production line after they exit screw conveyor 102 and 104. The embodiment in FIGS. 12 and 12A may be utilized in applications of the invention where glass or transparent containers are filled that accommodate sight inspection for fill while the container is being inspected for seal.

Figure 13:
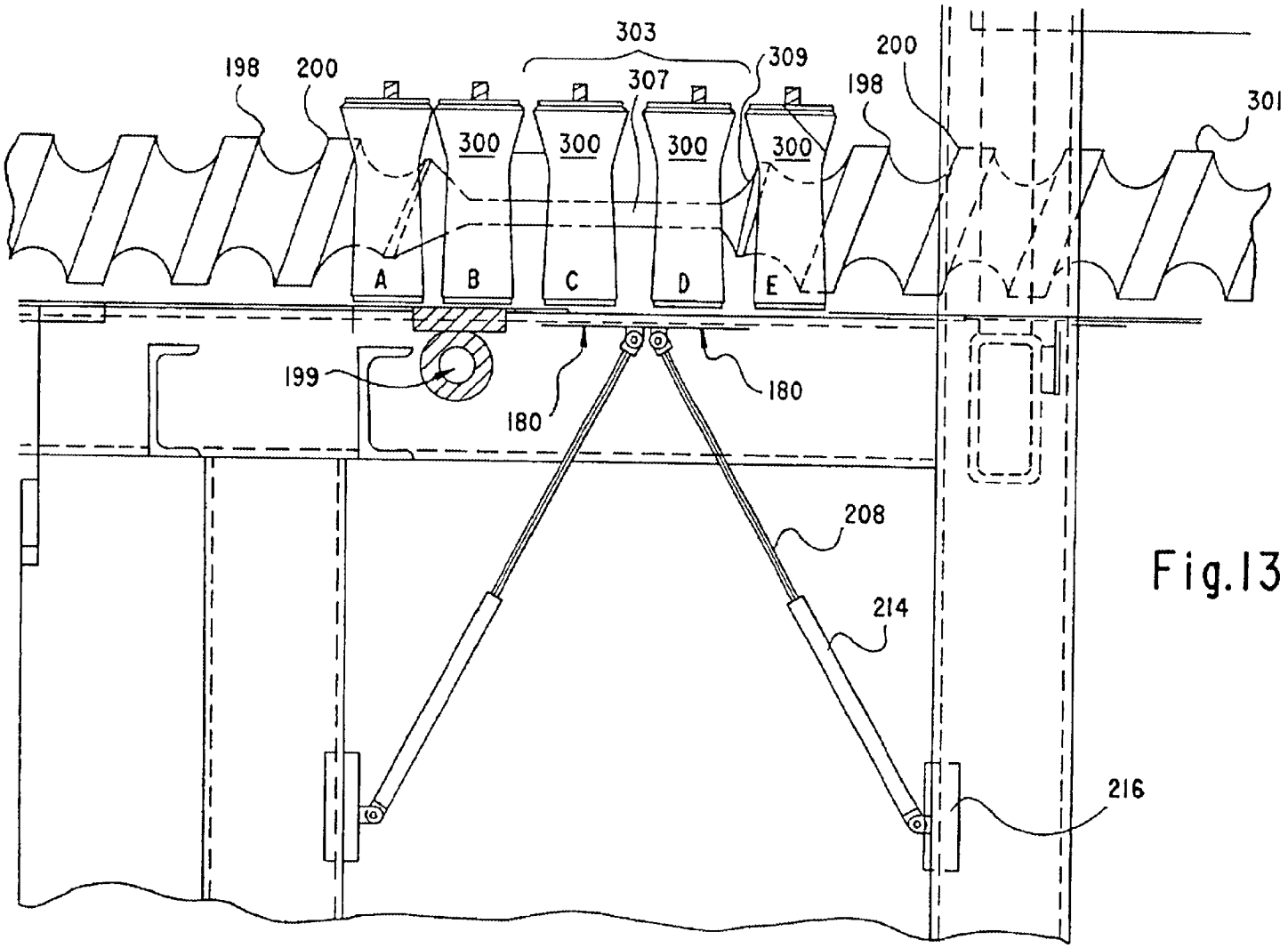
FIG. 13 is a side elevational view of an alternative embodiment of a screw conveyor that provides for he removal through reject doors of containers having a top larger than the bottom in accordance with the invention.
Figure 13A:
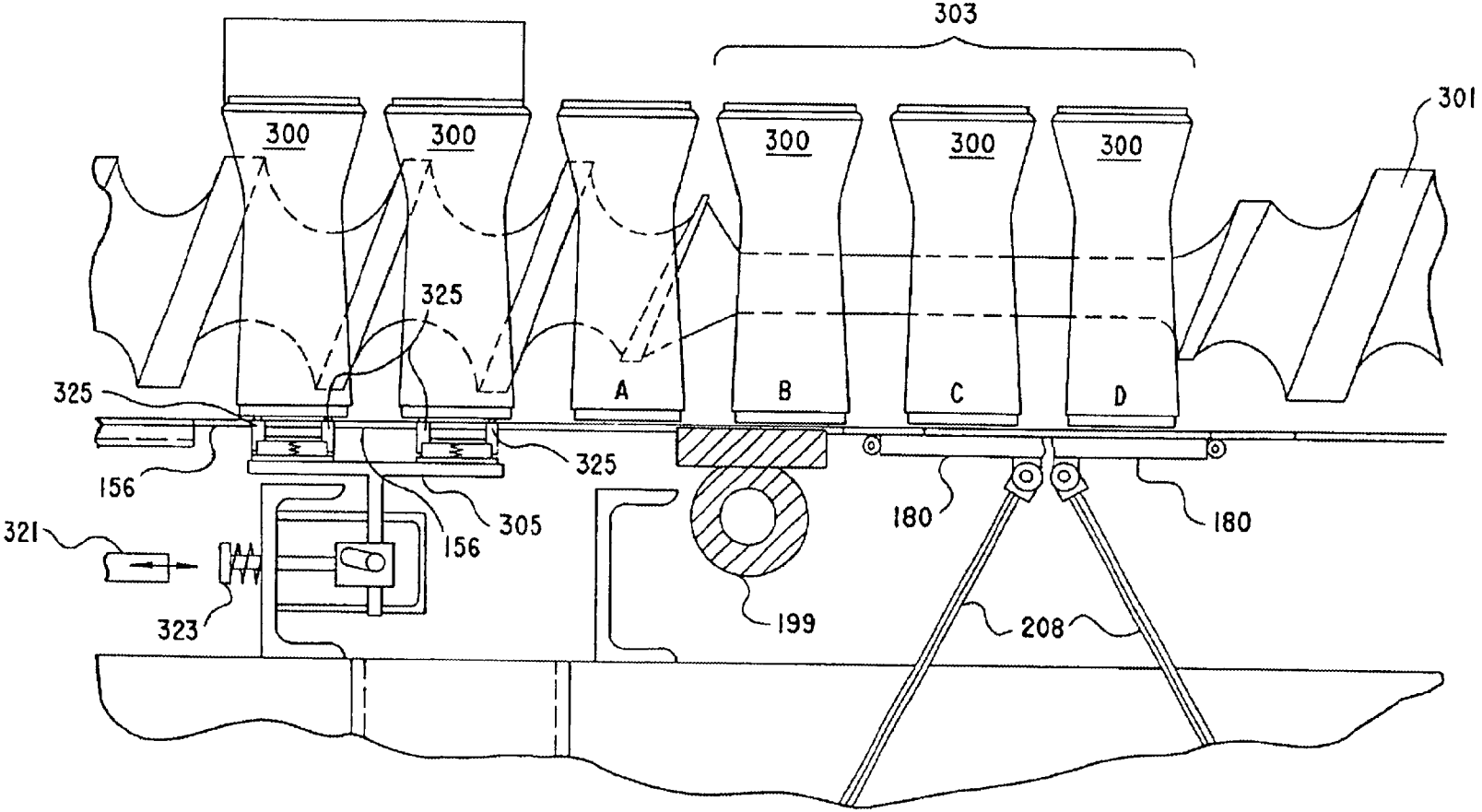
FIG. 13A is a side elevational view of an alternative embodiment of a screw conveyor that provides for the weighing of containers in accordance with the invention.

FIGS. 13 and 13A illustrate further alternative embodiments of the invention for providing the simultaneous filling and sealing of containers 300 having a top larger than the base and simultaneously removing defective containers 300 from the screw conveyor utilizing a modified screw conveyor 301. Modified screw conveyor 301 includes threads 198 and 200 together with guide rails 190 and rods 202 for positively engaging containers 58 at positions requiring positive control such as the fill position 166 and seal position 176. Modified screw conveyor 301 includes one or more shaft recessed areas 303 extending across one or more work stations that do not require positive control over the containers such as fill reject station 172, seal reject station 182 or a weigh station 305 (FIG. 13A). Modified screw conveyor 301 spans shaft includes a narrow shaft 307 that spans recessed areas 303 and interconnects screw conveyor 301 across recessed areas 303 to maintain positive positioning control over the containers in fill position 166, seal position 176 and inspection positions 168 and 178.

Containers 300 having a top of a larger diameter than the base as represented by containers A, B, C, D, and E are transported along the length of modified screw conveyor 301 as in the manner as previously described except when the containers enter recessed areas 303. Containers first enter shaft recessed area 303 by the action of threads 198 and 200 and are advanced by container A pushing container B which pushes container C which pushes container D which pushes container E. The pushing of container C and D by container B is assisted by a motion vibrator 199 which vibrates the bottom of container C pushing container C over a reject door such as reject door 174 or reject door 130. Container C and D can be removed from screw conveyor 301 even though the tops are larger than the bottom due to the extra space provided in recess area 303 due to the reduced circumference of narrow shaft 307. Alternatively a scale 305 (FIG. 13A) could be substituted for doors 180 and containers C and D could be weighed since control forces have been removed from the sides of the container by threads 198 and 200.

Referring now to FIG. 13A a further embodiment of a weigh station 305 and reject areas is illustrated. The weigh station 305 includes a shuttle plate shaft 321 that operates in unison with shuttle plate 258 and depresses button 323 while shuttle plate 258 is supplying foil seals to sealing and purging pistons 242. The depression of button 323 by shaft 321 raises scale support 325 under each container 300, temporarily raising the container from out or engagement with threads 198 and 200 to allow an accurate weight to be made of the filled container. The return of shuttle plate 253 results in the return of shuttle plate shaft 321 which retracts scale supports 325 below bed 156.

Container D (FIG. 13A) and container E (FIG. 13) may be assisted with partial spiral thread 309 on the end of narrow shaft 307 which engages container D (FIG. 13A) and E (FIG. 13) when screw conveyor again turns and assists container D (FIG. 13A) and E (FIG. 13) back into threads 198 and 200 on modified screw conveyor 301. Partial spiral thread 309 may extend partly or entirely across the entire recessed area 303 to assist in the movement of containers in recessed area 303. Since partial spiral thread 309 is also of a significantly reduced diameter and of a greater spiral angle than threads 198 and 200 sufficient slop in threads exist to allow removal of containers with larger tops as well as the weighing of containers by the removal of positive control forces in the recessed areas 303. The constant transfer of energy from container A to container B to container C to container D to container E also assists to continue to advance containers in recessed areas 303. In this manner positive control forces are maintained by threads 198 and 200 in areas requiring positive control such as sealing, inspection and filling areas or modified screw conveyor 301 and positive control forces are reduced or removed from the containers in recessed areas 303 so that all types of containers can be weighed and containers with a top of greater upper size can be dropped through reject door 174 and 180.

Figure 13B:
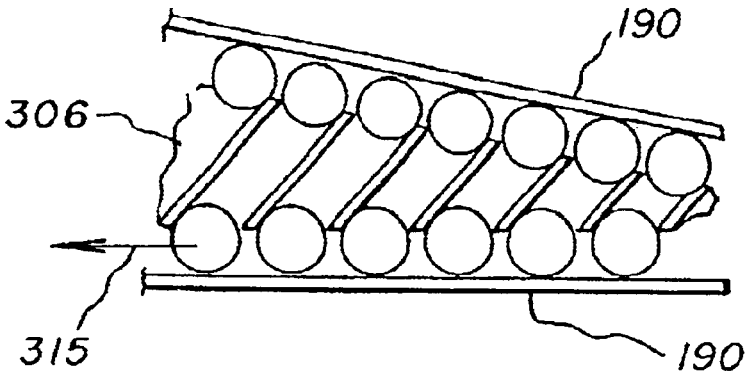
FIGS. 13B and 13C are alternative embodiments utilizing a screw conveyor for simultaneously filling and sealing containers in accordance with alternative embodiments of the invention.
Figure 13C:
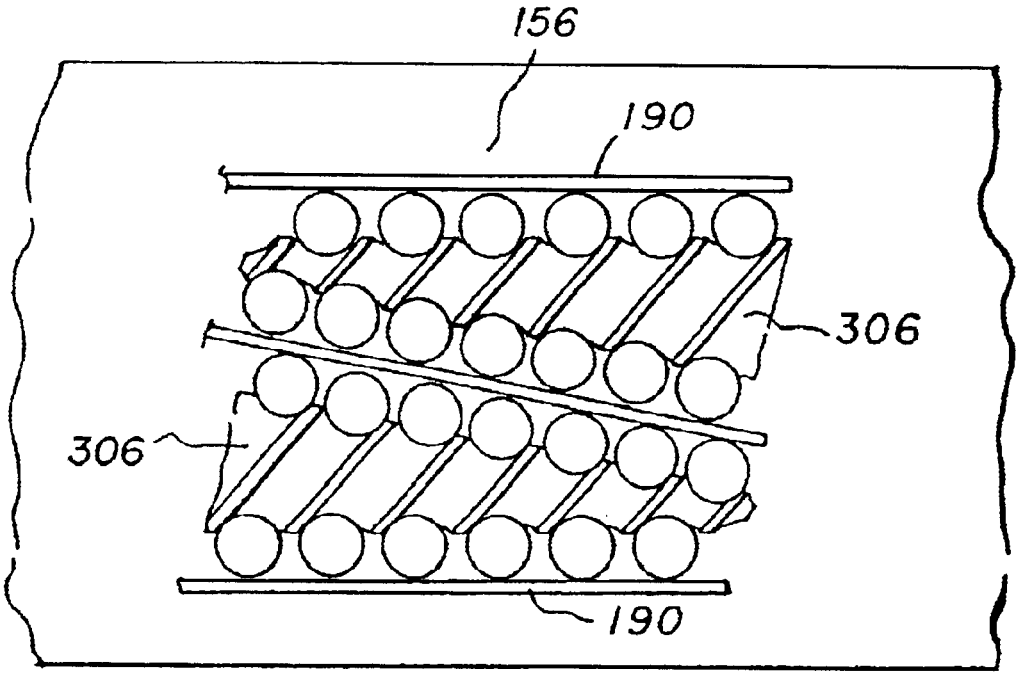

Referring now to FIGS. 13B and 13C other typos of screw conveyors are illustrated in which the diameter of the screw conveyor varies from one end to another. As illustrated in FIG. 13B the funnel-shaped conveyor 306 can be utilized to convey containers along the length of the conveyor to precise positions for filling, sealing, inspecting and rejecting positions for the containers. In FIG. 13B containers move in the direction of arrow 315. In FIG. 13C two funnel-shaped conveyors 306 are placed in a lateral arrangement to accommodate a rectangular shaped bed 156 of the novel filling and sealing apparatus 100. In the embodiment as illustrated in FIG. 13C the containers can move in the same direction or in opposite directions where the novel filling and sealing apparatus includes input and output production lines extending in opposite directions.

Figure 25:
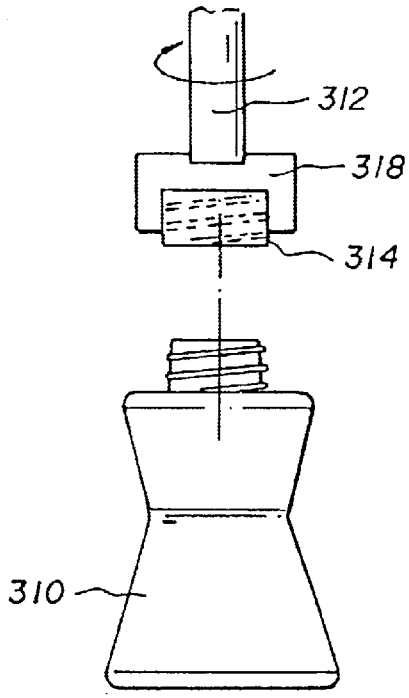
FIG. 25 is a side elevational view illustrating the utilization of a screw cap seal application of the invention.
Figure 24:
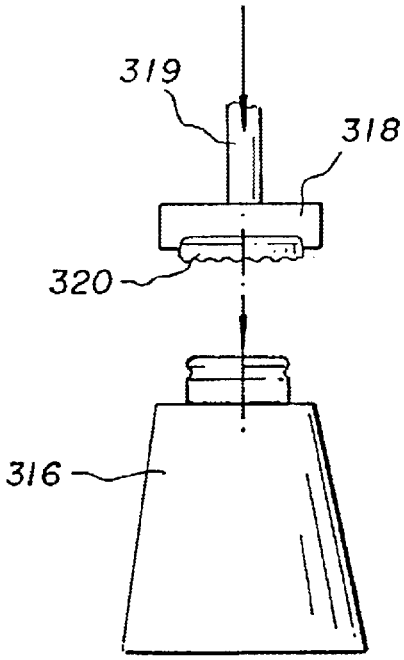
FIG. 24 is a side elevational view illustrating an alternative embodiment of the invention providing for the sealing of containers with a crimp seal.

Referring now to FIGS. 24 and 25 the novel filling and sealing apparatus 100 is not limited to filling yogurt containers, fruit juice containers or other such containers having a foil seal on the container. As illustrated in FIG. 25 a container 310 that has been filled at a filling position 166 of the novel filling and sealing apparatus is transported to a sealing position 176 where the container may optionally be purged of ambient air and a rotatable piston 312 terminating in cap holder 318 is provided for advancing a screw cap 314 to attach the screw cap 314 onto container 310. The invention may also be utilized for the filling and crimp-sealing (FIG. 24) of a crimp-sealed container 316 by providing a cap holder 318 at the end of a pressure piston 319 for applying a crimp cap 320 to the top of crimp-sealed container 316.

At this point the filling and sealing is completed on the novel filling and sealing apparatus having a discontinuous operation of screw conveyors to provide a complete filling, sealing, inspection and optional container removal operation in a production line providing for the positioning of containers at multiple work stations along the length of the screw conveyors. Once the containers have been filled and sealed and optionally inspected, the filled and sealed container exits the novel filling and sealing apparatus 100 and is transported in the preferred embodiment of the invention to an accumulation conveyor 188.

Referring now to FIGS. 1A, 1B, 26 and 44 the remainder of the novel production line in accordance with the preferred embodiment of the invention is illustrated. In the preferred embodiment of the invention only properly filled, sealed and fully inspected containers are allowed to continue down the production line, while defective containers having filling or sealing defects are removed in the novel filling and sealing apparatus 100. The accumulation conveyor 188 transfers the containers to sleevers 322 and to heat tunnels 324 and finally to novel straw applicators 326 before the consumer packaged product is placed in snipping cartons as will be described hereinafter in greater detail. The accumulation conveyor 188 operates as a control station and provides information to a computer regarding flow rates so that the computer with information from accumulation conveyor 188 alone or together with infeed conveyor 60 can increase or decrease the speed of the elevated feed conveyor 22, the novel orientation conveyor 32 and the speed of operation of the discontinuous operation of screw conveyors 102–112. The accumulation conveyor 188 provides information as to flow rate by utilizing a plurality of conveyor lanes which take the twelve lanes of filled and sealed containers from screw conveyors 102–112 from the novel filling and sealing apparatus and restrict the twelve lanes down to nine forward lanes in the accumulation conveyor 188.

Figure 27:
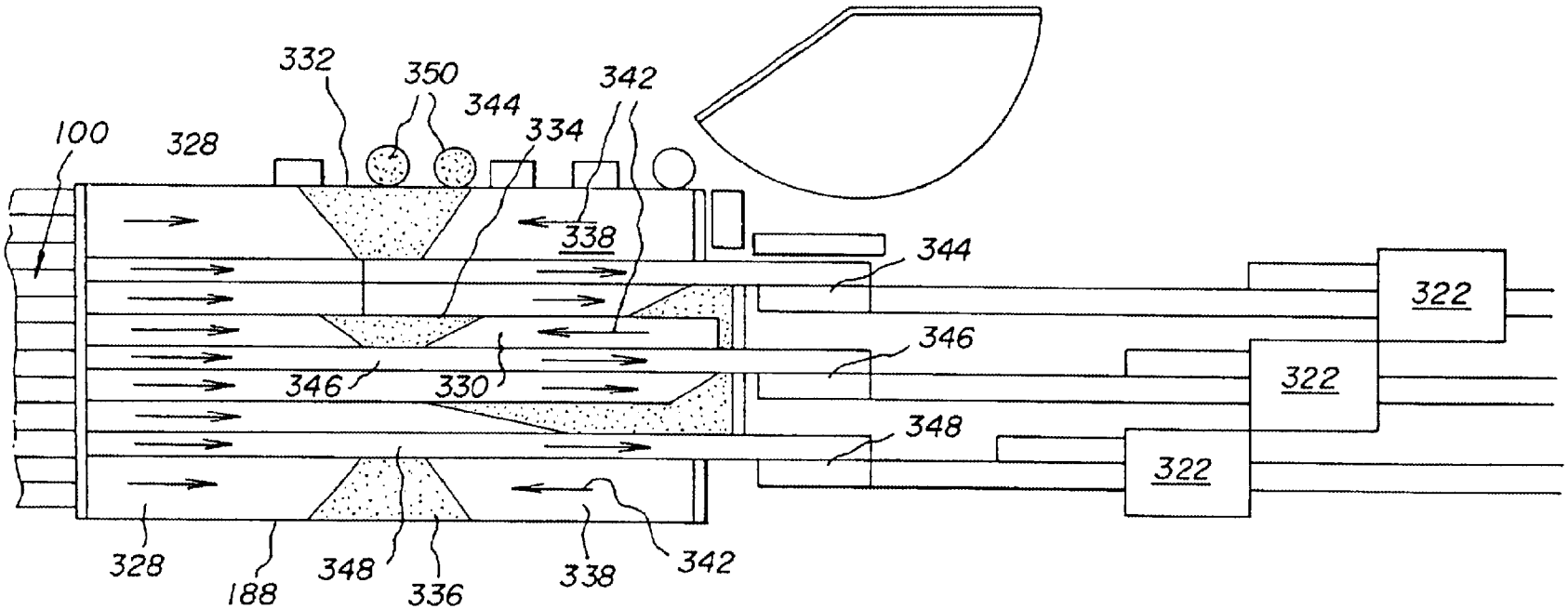
FIG. 27 is a top plan illustrating the operation of the flow regulating conveyor in the novel production line of the invention.

The two outside lanes 328 and center lane 330 (FIG. 27) do not flow the entire length of the accumulation conveyor 188. Instead half way through the accumulation conveyor 188 the two outside lanes 328 and the center lane 330 are divided by dividers 332, 334 and 336. Dividers 332, 334 and 336 allow outside lanes 338 and center lane 330 to continuously operate in a reverse direction as represented by arrows 342. The operation of outside lanes 338 and center lane 330 in an opposite direction allows bunched up containers to be diverted back onto the reverse flowing conveyor lanes 338 and 330 and not proceed further on through the production line into the remaining three production lines 344, 346 and 348.

The operation of the reverse flowing conveyor lanes provided by outside lanes 338 and center lane 330 operates much in the way of a counterflow mechanism for fluids in which excess containers are moved off the three direct conveyor lanes 344, 346 and 348 and caught in a reverse flow or eddy current where the containers are constantly moving so as to not plug up the main production lines 344, 346 and 348 and remain in circulation without entering the production line until such time as the containers are able to be directly channeled onto the direct production lines 344, 346 or 348.

Drive for the accumulation conveyor is provided by drive motors 350 which are connected to an accumulation disconnect panel 352 disposed on wall 354. Also disposed on wall 354 is a control panel 356 and power panels 358 for the heat tunnel 324.

The information as to flow rate and backflow information is supplied to a computer 340. Computer 340 can adjust the flow rate to reduce the accumulation of containers on the accumulation conveyor by slowing down the elevated feed conveyor 22, the novel orientation conveyor 32 or the novel filling and sealing apparatus 100 to adjust the rate of production of the novel production line. The accumulation conveyor 188 in addition to providing information to computer 340 for increasing and decreasing the rate of production also regulates production flow for when any of the screw conveyors 102–112 need to be shut down or when one of the lanes of the plurality of lanes of the novel orientation conveyor have to be shut down or when one or more of the direct production lines 344, 346, and 348 need to be shut down in the event one of the sleevers 322, ovens 324 or straw applicators 326 is or line or requires maintenance. In the event one of the three direct production lines 344, 346 or 348 require a diversion of the filled and sealed containers to other production lines, the accumulation conveyor provides for the diversion a the filled and sealed containers to the other remaining production lines as will be described hereinafter in greater detail.

Figure 26:
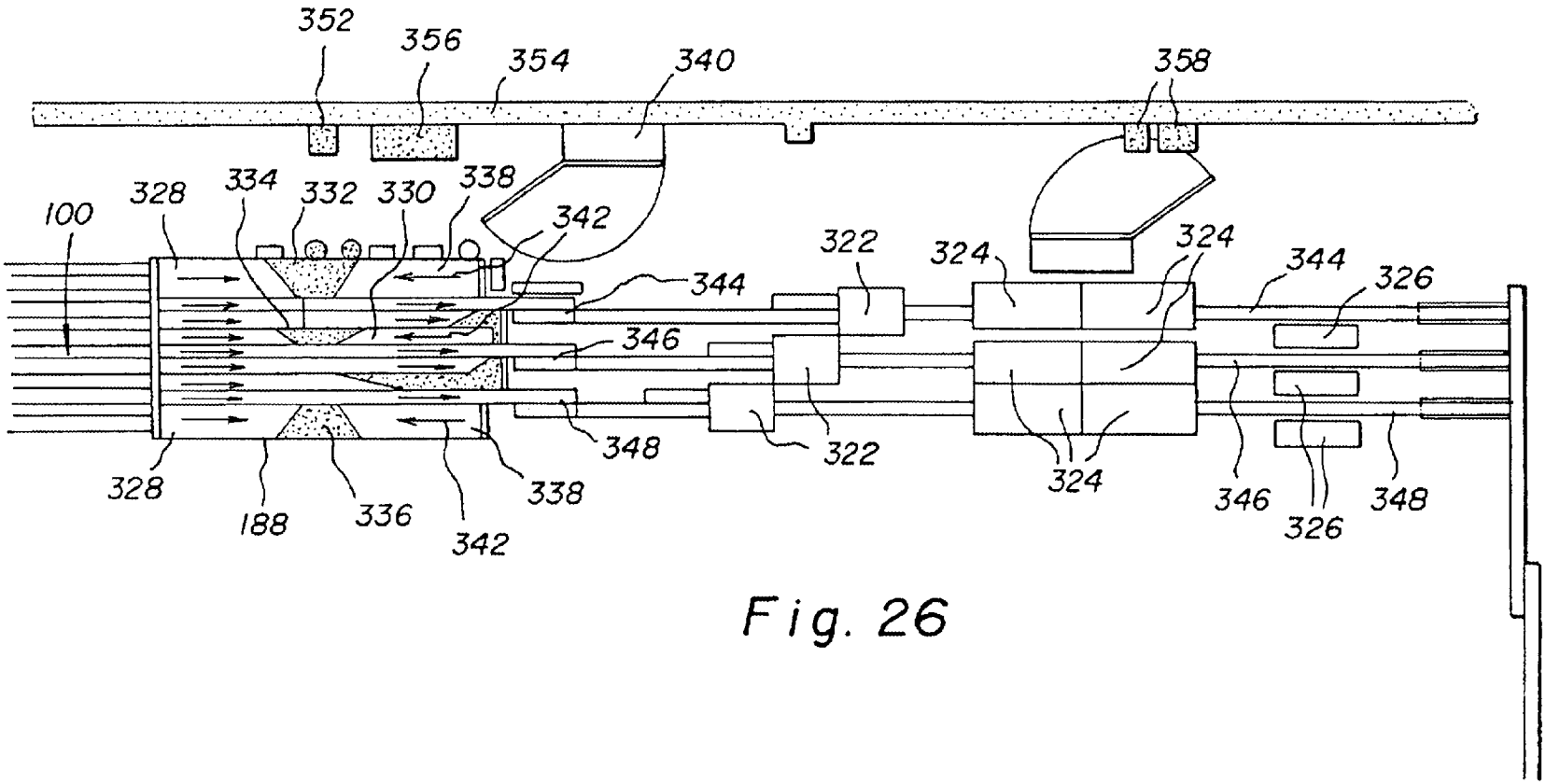
FIG. 26 is a top plan view of a flow regulating conveyor with sleevers and straw applicators in the novel production line of the invention.
Figure 28:
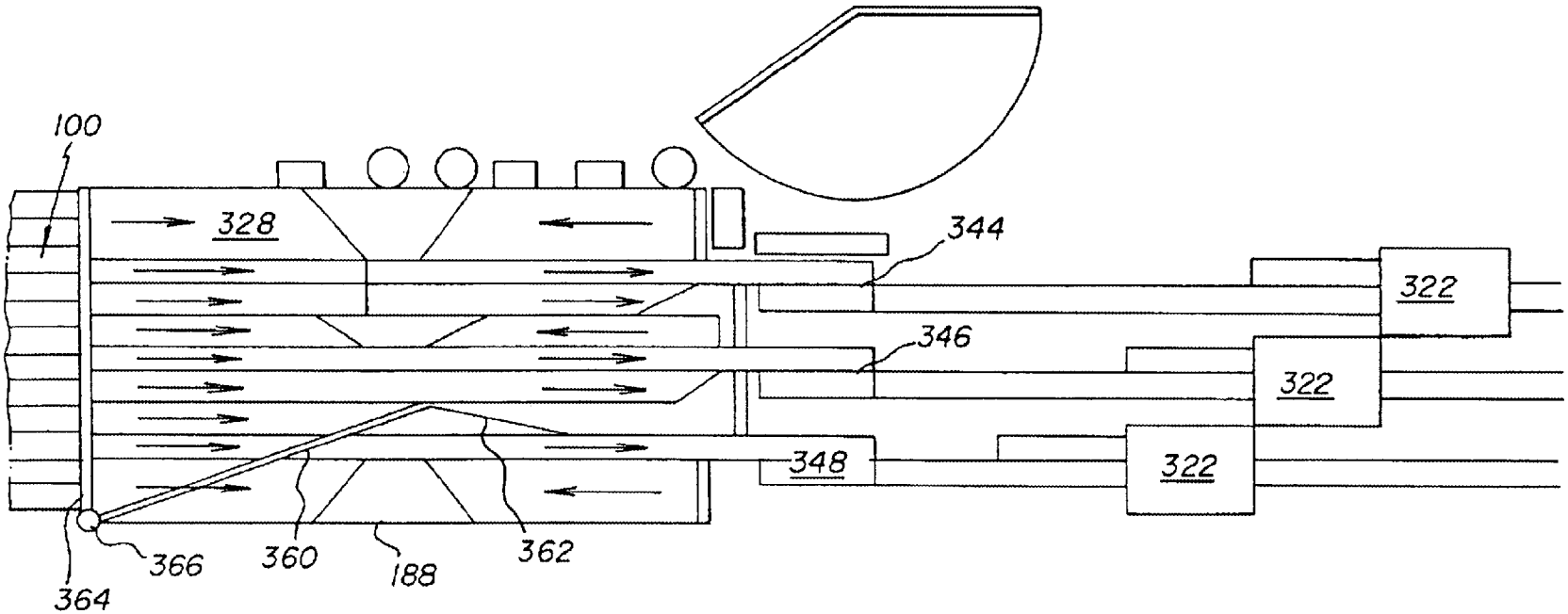
FIG. 28 is a top plan view similar to FIG. 27 illustrating the operation of the flow regulating conveyor in the production line shutting off the flow production lines of the right side of the conveyor.

Referring now to FIGS. 26 and 28 the accumulation conveyor 188 together with computer 340 controls production by diverting production to other lanes by shutting down individual lanes where, for example, a sleever 322 or oven 324 or novel straw applicator 326 runs out of straws in line 8 by swinging divider 360 across outside lane 328 to diverter 362. This diverts all production from production line 348 to the remaining two production lines 344 and 346. Divider 360 is pivotally attached to frame 364 at pivot 366 to close down line 348. When lanes are shut down the novel computer controlled production line processes the information and can then slow down elevated feed conveyor 22, novel orientation conveyor 32 as well as slowing down or stopping production from one of the screw conveyors 102–112 of the novel filling and sealing apparatus 100.

Figure 29:
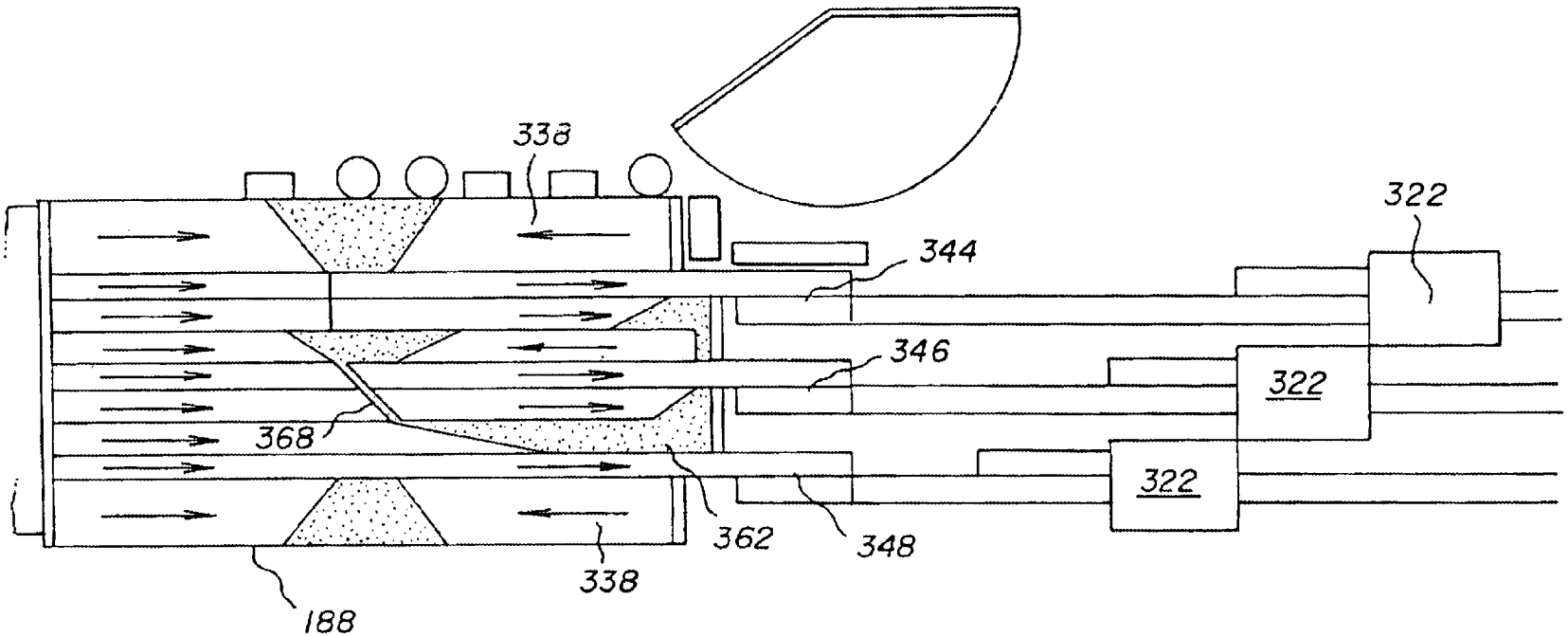
FIG. 29 is a top plan view similar to FIG. 27 illustrating the shutting down of the center lanes of the flow regulating conveyor in the novel production line of the invention.
Figure 30:
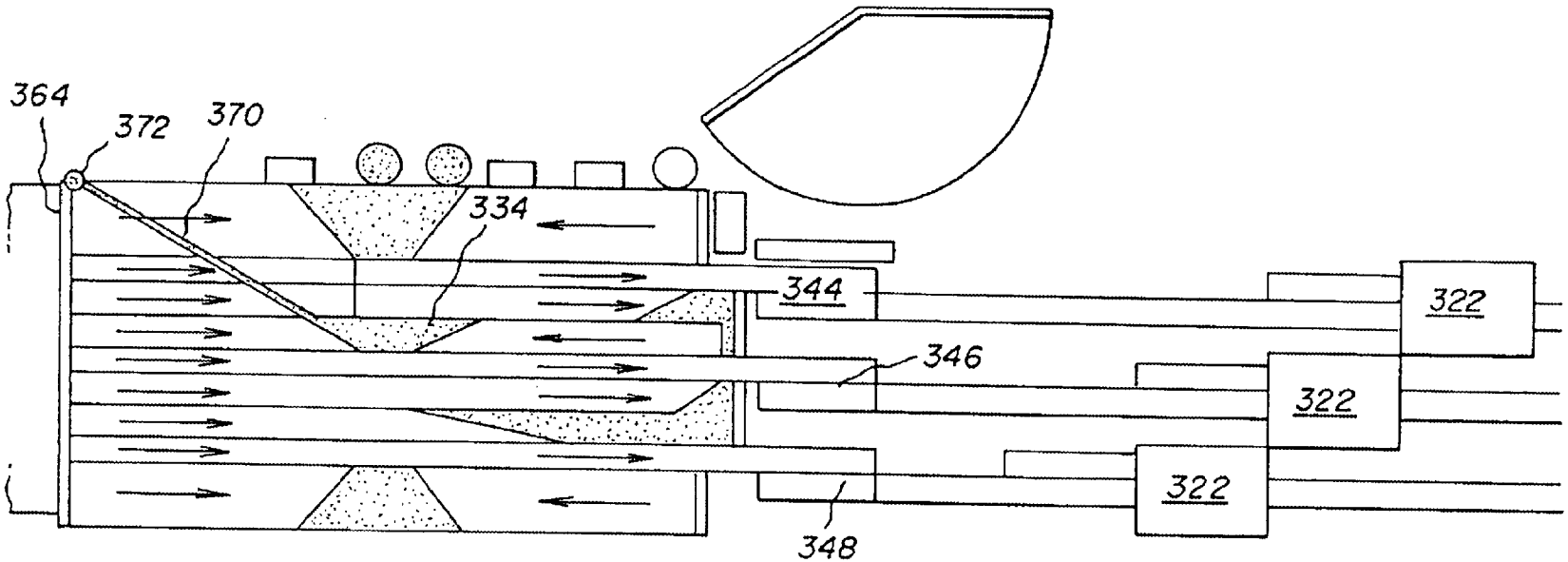
FIG. 30 is a top plan view similar to FIG. 27 illustrating the shutting down of the left lanes of the flow regulating conveyor.

Accumulation conveyor 188 can shut down center production line 346 and divert filled and sealed containers to the remaining production line 344 and 348 by pivoting divider 368 across the center lanes to contact diverter 362 (FIG. 29). Once divider 368 is in contact with diverter 362 all remaining production flows down open production lines 344 and 348 or is channeled through the back flow outside lanes 338. Similarly the accumulation conveyor 188 can close off production fine 344 (FIG. 30) and channel all production to production lines 346 and 348 by pivoting divider 370 to divider 334 to shut down production line 344. Divider 370 like divider 360 is pivoted to frame 364 by a pivot 372.

Once the filled and sealed containers exit accumulation conveyor 188 the containers in accordance with the preferred embodiment of the invention are then sleeved in sleevers 322 to apply labels or sleeves with labels to the outside of the filled and sealed containers. The sleevers which apply labels to the containers may be any type of prior art sleever or labeler currently on the market to apply labels or sleeves which are connected to the novel production line through computer control and related computer program to control the operation of the entire novel production line. In the preferred embodiment of the invention sleevers 322 are American Fuji Seal, Inc. sleevers and may be obtained from American Fuji Seal, Inc. of Fairfield, N.J. 07004 and as a result will not be described in further detail.

In addition to the attaching of a sleeve with a label in the novel production line a heat tunnel 324 which can be a steam or radiant heat tunnel and preferably is a steam tunnel which is provided to shrink-wrap the plastic sleeve containing the label to the packaged and sealed container. The heat tunnels for heat-sealing the sleeve containing the label to the container can also be obtained from American Fuji seal of Fairfield, N.J. 07004 and as a result will not be described in further detail. Once the sleeve containing the label is shrunk to the containers the containers transported down production lines 344, 346 and 348 to the novel straw applicators 326 for attaching an individually wrapped straw to the outside of the filled and sealed container.

Referring now to FIGS. 31, 31A, 32, 32A, 33 and 33A one of the novel straw applicators 326 is illustrated. Straw applicators 326 may operate as stand alone units for advancing individually wrapped straws on demand or be linked to the computer for controlling the entire production lane. As heretofore described each production line 344, 341 and 348 includes a novel straw applicator 326, each of which applies straws to filled and sealed containers coming down one of the production lines 344, 346 or 348. For purposes of illustration only one of the novel straw applicators 326 associated with line 346 will be described since the other straw applicators operate the same for lines 344 and 348.

As a filled and sealed and labeled container 58 moves down production line 346, the filled, sealed and labeled container 58 is sensed by sensor 380 which may be attached to the straw and tape supply housing 382. Straw and tape supply housing 382 houses a plurality of individually wrapped telescoping straws 384 which are interconnected by a plastic band 386. Straw and tape housing also houses a roll of adhesive tape 388. Straw plastic band 386 is advanced past straw web pivot bar 387 while adhesive tape 388 is advanced past adhesive tape web pivot bar 389. A bonding roller 391 bonds adhesive tape 338 to the straw plastic band 386. As soon as sensor 380 senses the presence of a filled, sealed and labeled container 58 on production line 346 the drive motor 390 is engaged to sequence the delivery of an individually wrapped telescoping straw to container 58 as contacts straw applicator cylinder 392 as will be described hereinafter in greater detail.

The timed relationship in the preferred embodiment is provided by a demand sensor 380 which activates and controls the operation of drive motor 390. Individually wrapped telescoping straws 384 on plastic band 386 and adhesive tape 388 are drawn out of housing 382 by drive-motor 390 which is connected to drive shaft 394 (FIG. 32:) through bearing 396 connected to frame 398. Drive shaft 394 is connected to pulleys 400 and 402 for driving divided straw conveyor belts 404 and 406. Divided straw conveyor belts 404 and 406 are divided into upper straw conveyor belt 404 and lower straw conveyor belt 406 that connects drive pulley 400 with notched pulley 408. Similarly drive pulley 402 connects lower straw belt 406 with notched pulley 408. Notched pulley 408 includes a plurality of notches 410 which accommodate the individually wrapped telescoping straws 384 and positively engage and control the positioning of the telescoping straws 384 into the notches 412 on upper straw conveyor belt 404 and lower straw conveyor belt 406. Notched pulley 408 is journalled to frame 398 through a bushing 414. The notches 410 in notched pulley 108 together with notches 412 in upper straw conveyor belt 404 and lower straw conveyor belt 406 provide a positive engagement and advancement of the plastic band 386 connecting the individually wrapped telescoping straws 384.

Figure 31A:
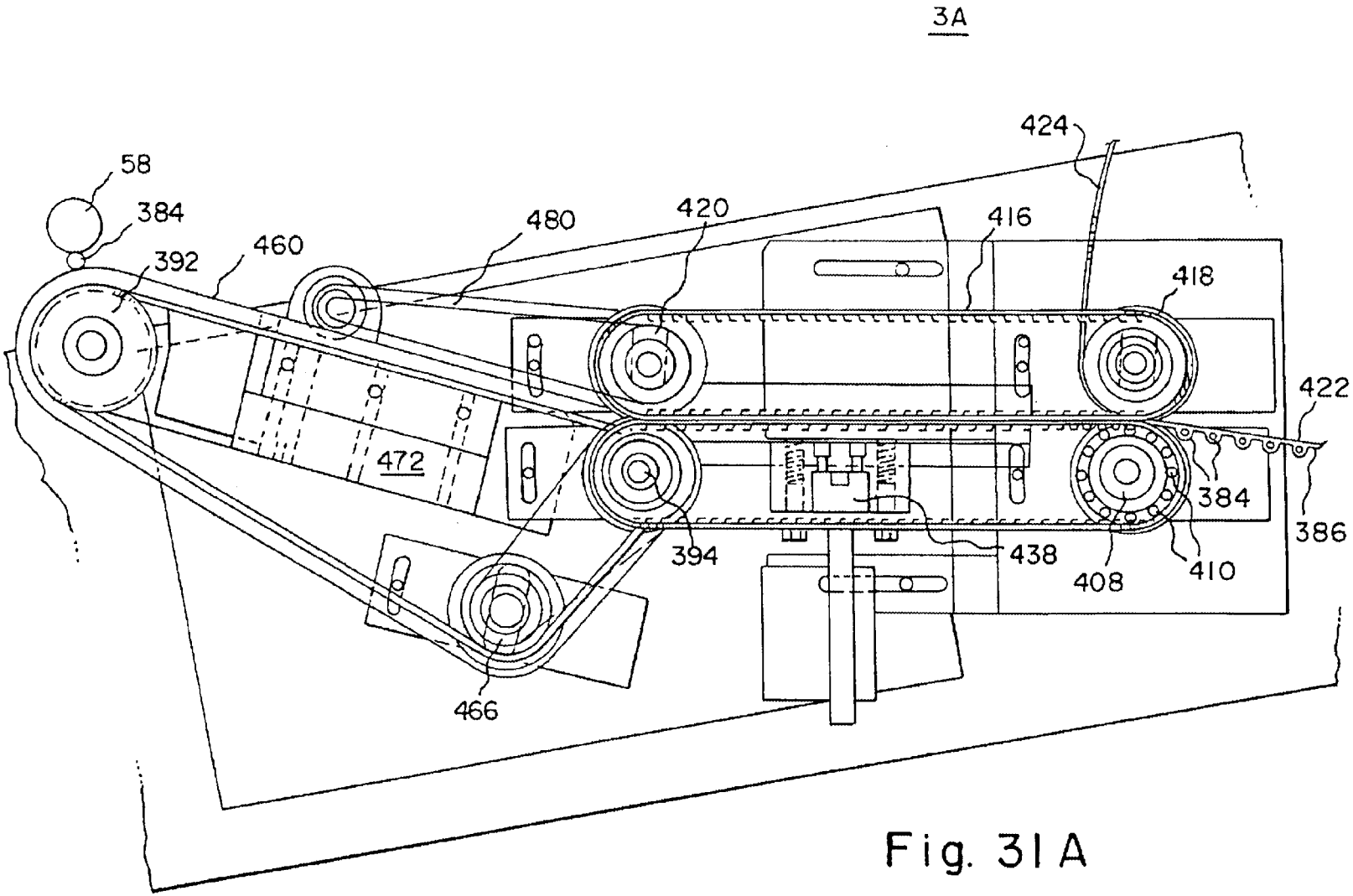
FIGS. 31 and 31A (31A enlarged without housing) are top plan views of the novel straw applicator illustrating the straw applicator and associated tension housing (FIG. 31) or the straw applicator of the invention.
Figure 31:
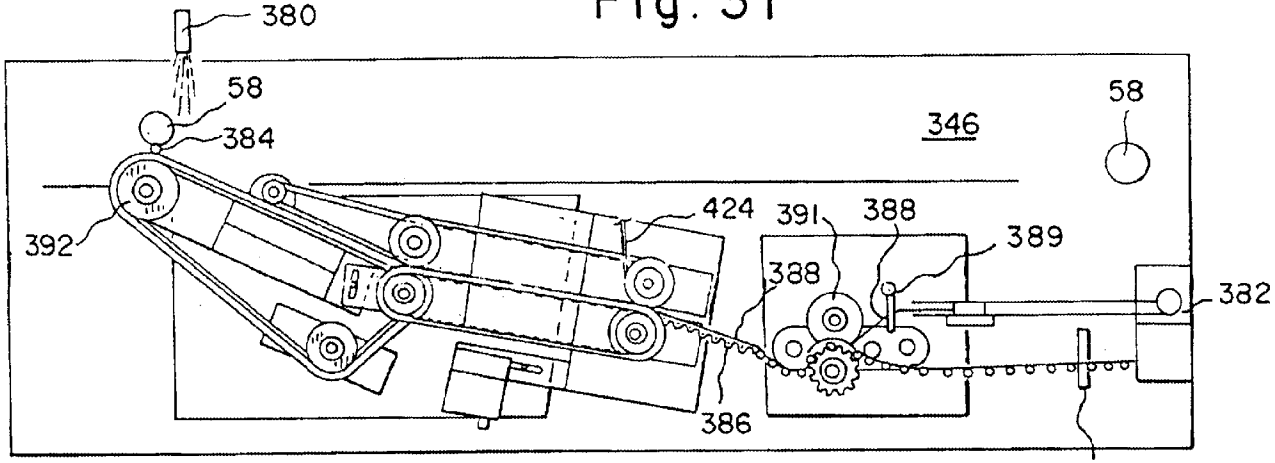
Figure 33:
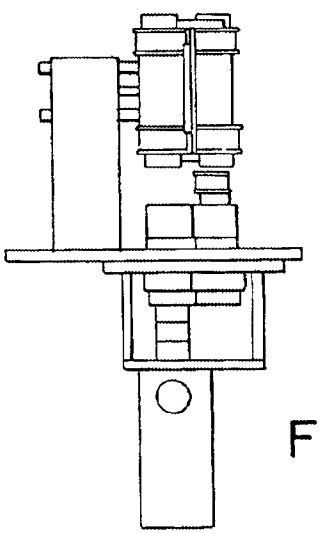
FIGS. 33 and 33A (33A enlarged) a rear elevational view of the novel straw applicator of FIG. 31.

Laterally disposed to notched pulley 408 and drive pulleys 400 and 402 is conveyor belt 416 connected between two servant pulleys 418 and 420 (FIG. 31A). Servant pulleys 41 and 420 together with conveyor belt 416 provide an abutting surface to upper straw conveyor belt 404 and lower straw conveyor belt 406 to capture, engage and positively advance telescoping straws 384 between straw conveyor belts 404 and 406 and conveyor belt 416. Servant pulley 418 draws an adhesive tape 388 from housing 382 and applies the adhesive tape 388 to the flat side 422 along the back of the plastic band 326 of the individually telescoping straws 384. As soon as the adhesive is applied to the flat side 422 of individually wrapped telescoping straws 384, the protective layer 424 of the double-sided adhesive tape 388 is removed and the protective layer 424 is discarded as the straw bearing the adhesive backing on the individually wrapped telescoping straws 422 proceeds down between upper straw conveyor belt 404, lower straw conveyor belt 406 and conveyor belt 416.

Figure 35:
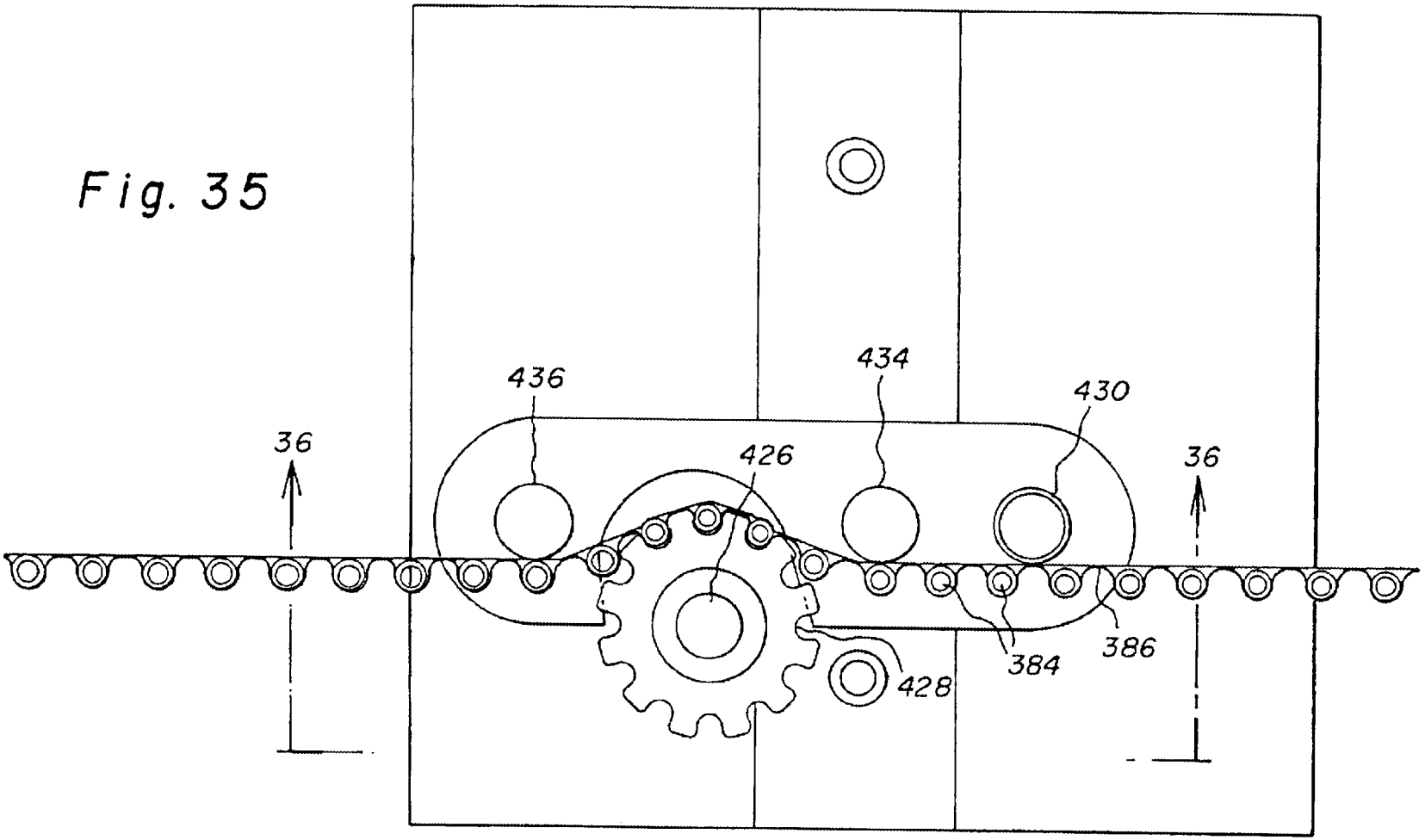
FIG. 35 is a top plan view of the straw tensioning and sequencing apparatus of the novel straw applicator.
Figure 36:
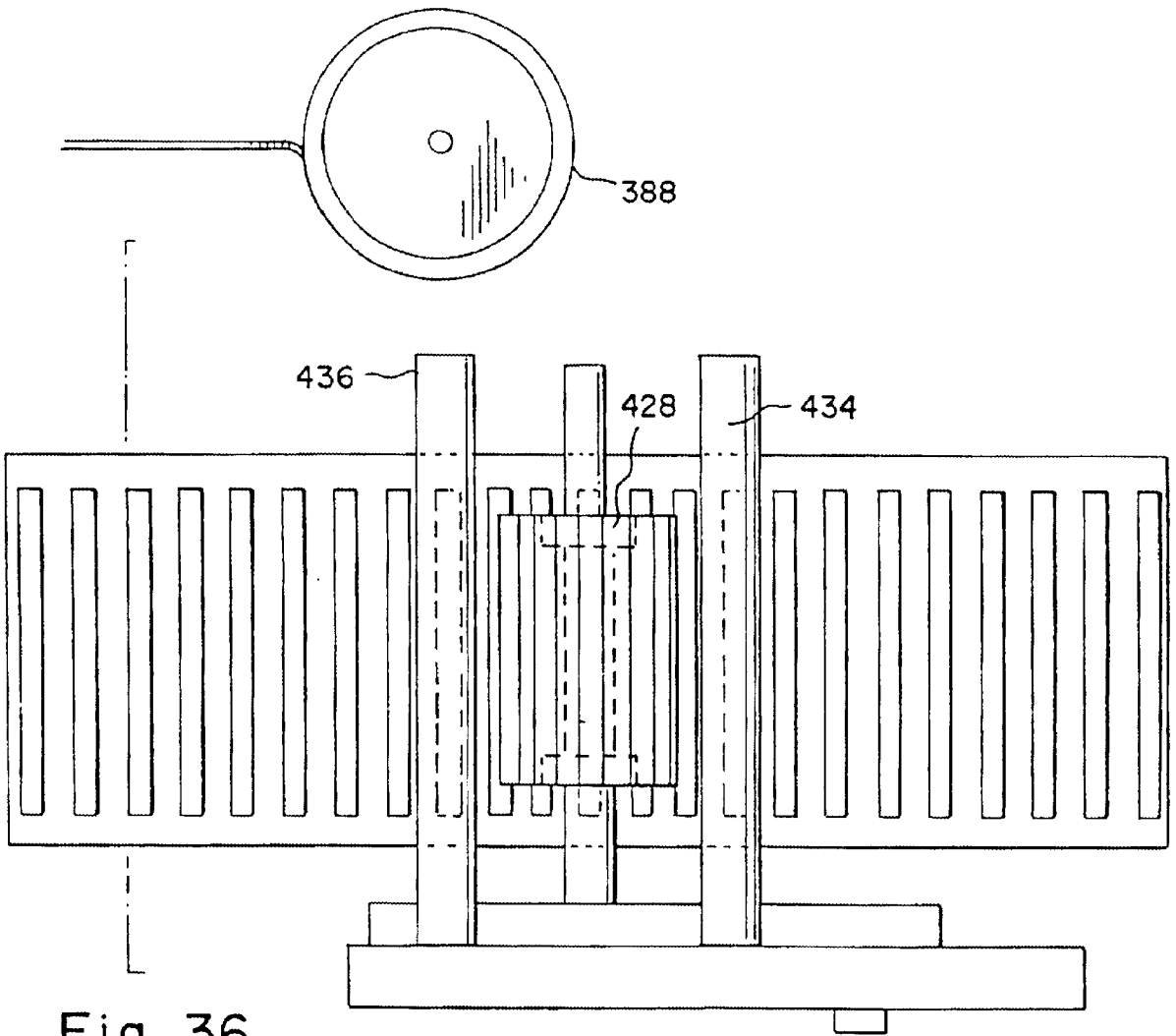
FIG. 36 is a side view of the straw tensioning and sequencing device taken along line 36—36 of FIG. 35.
Figure 37:
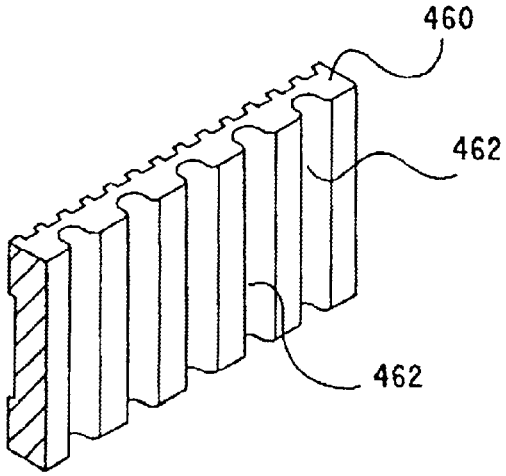
FIG. 37 is a perspective view of the straw applicator belt of the novel straw applicator of the invention.
Figure 38:
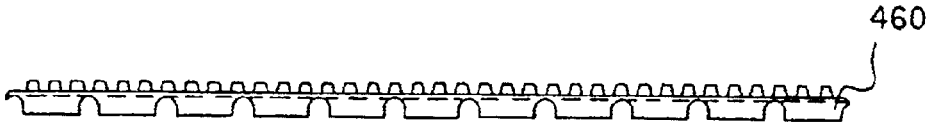
FIG. 38 is a top plan view of the straw applicator belt of FIG. 37.
Figure 39:
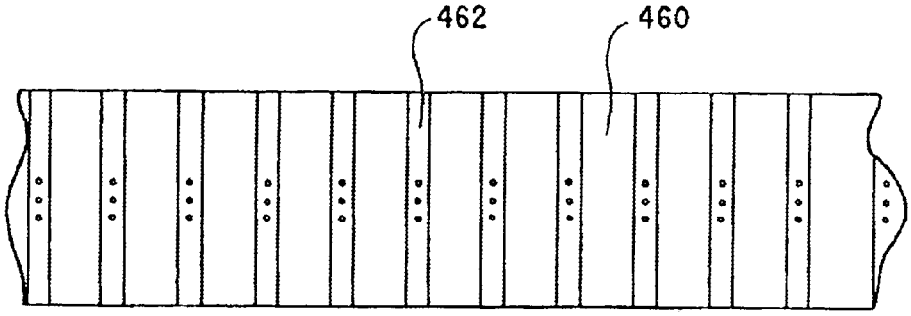
FIG. 39 is a side elevational view of the outside of the straw applicator belt of the novel straw applicator.
Figure 40:
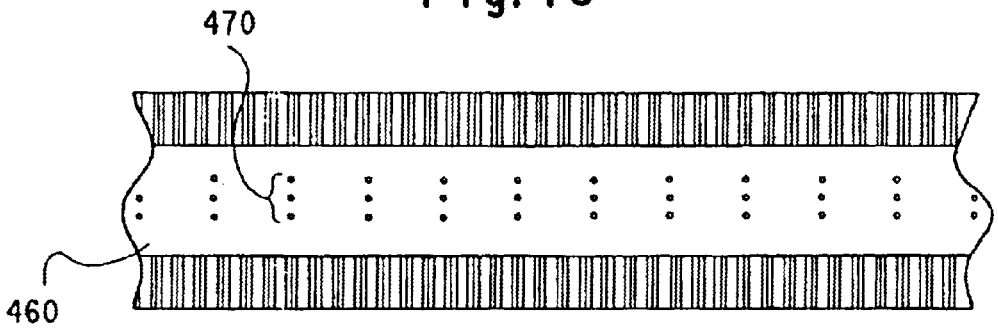
FIG. 40 is an inside side view of the straw applicator belt of the novel straw applicator of the invention.

To further assist in the positive alignment and engagement of the straws between notched pulley 408 and servant pulley 418, a straw tensioning mechanism is provided in straw and tape housing 382. The straw tensioning mechanism (FIGS. 35 and 36) includes a notched tensioning pulley 426 which, like notched pulley 408, includes a plurality of notches 428 which match the contour of the telescoping straws 384 and serve to tension plastic band 386 and assist in the tensioning, sequencing and feeding of the individually wrapped telescoping straws to notched pulley 408 and upper straw conveyor belt 404 and lower straw conveyor belt 406. A roller pulley 430 assists in the removal of the layered telescoping straws 432 in housing 382. Notched tensioning pulley 426 cooperates with feed cylinders 434 and 436 in sequencing and tensioning and feeding the straws to notched pulley 408 and the upper and lower straw conveyor belts 404 and 406.

Figure 32:
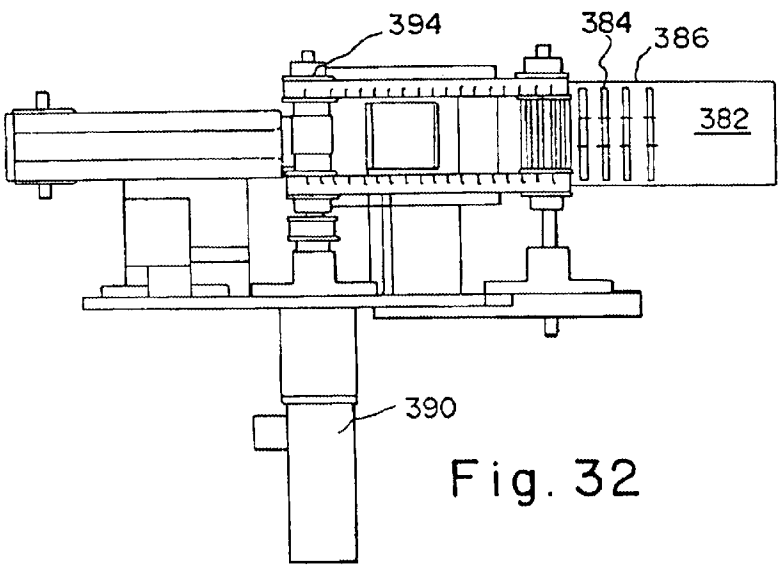
FIGS. 32 and 32A (32A enlarged) are side elevational views of the novel straw applicator of FIGS. 31 and 31A.
Figure 32A:
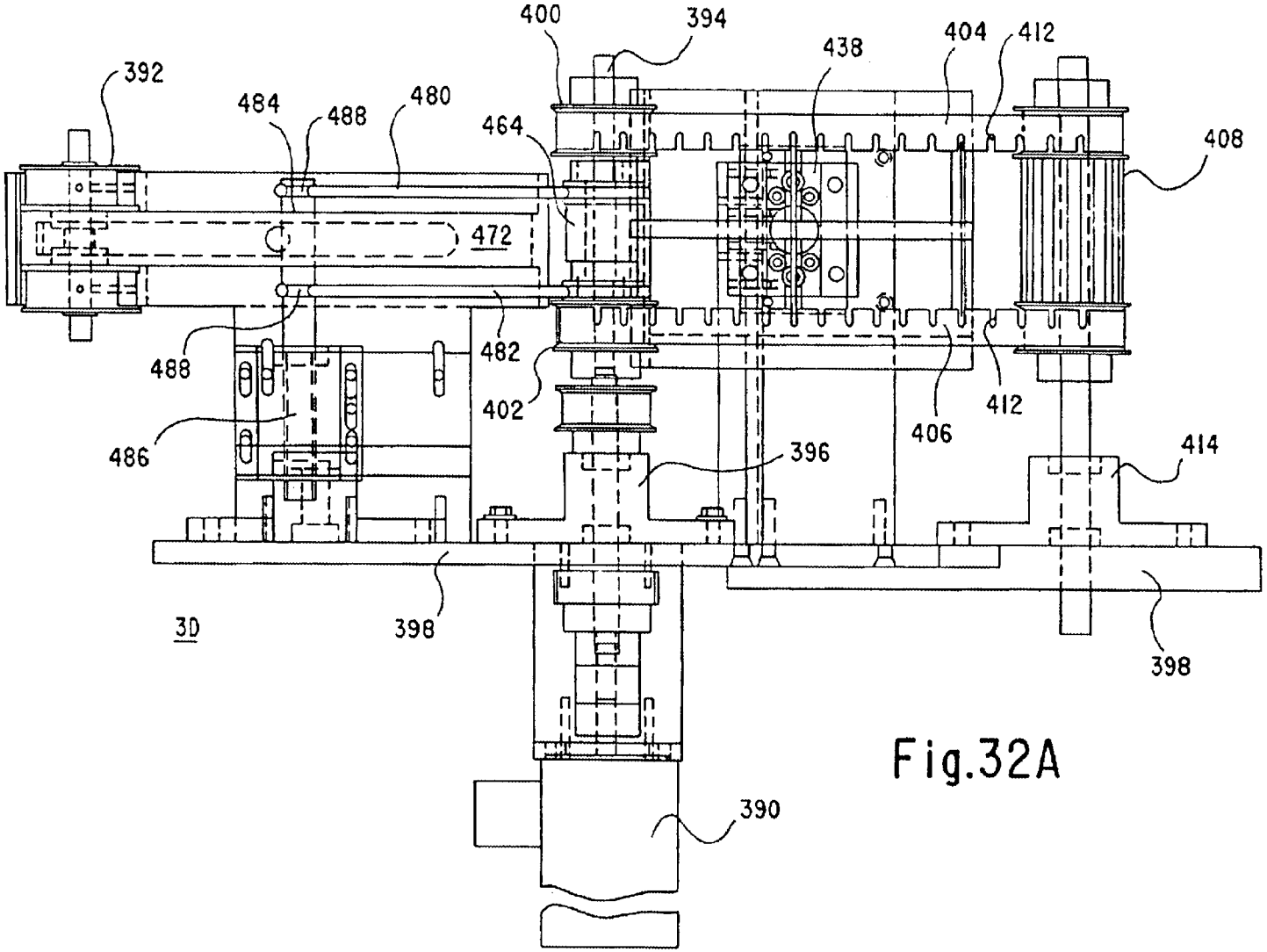
Figure 33A:
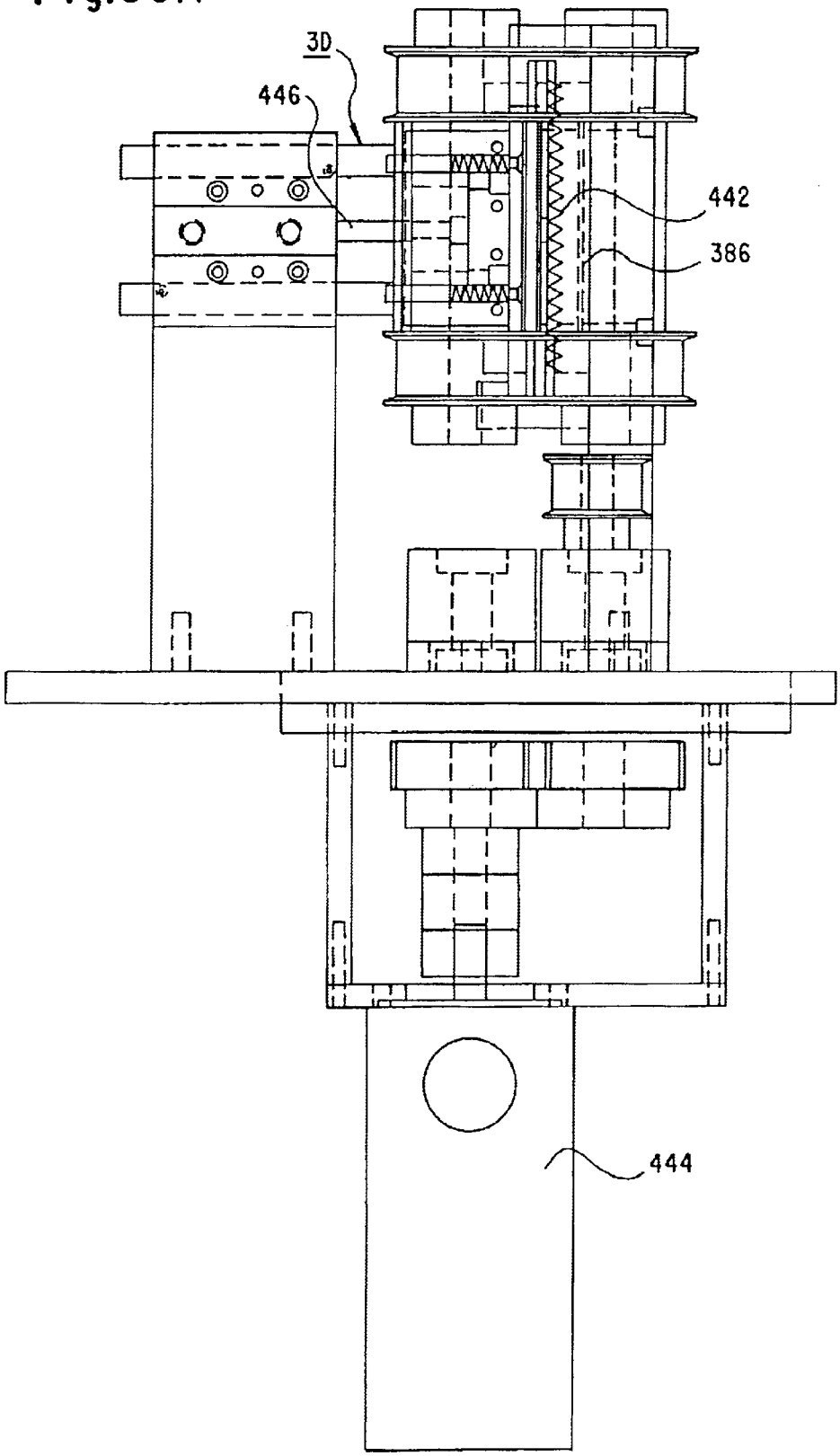
Figure 34:
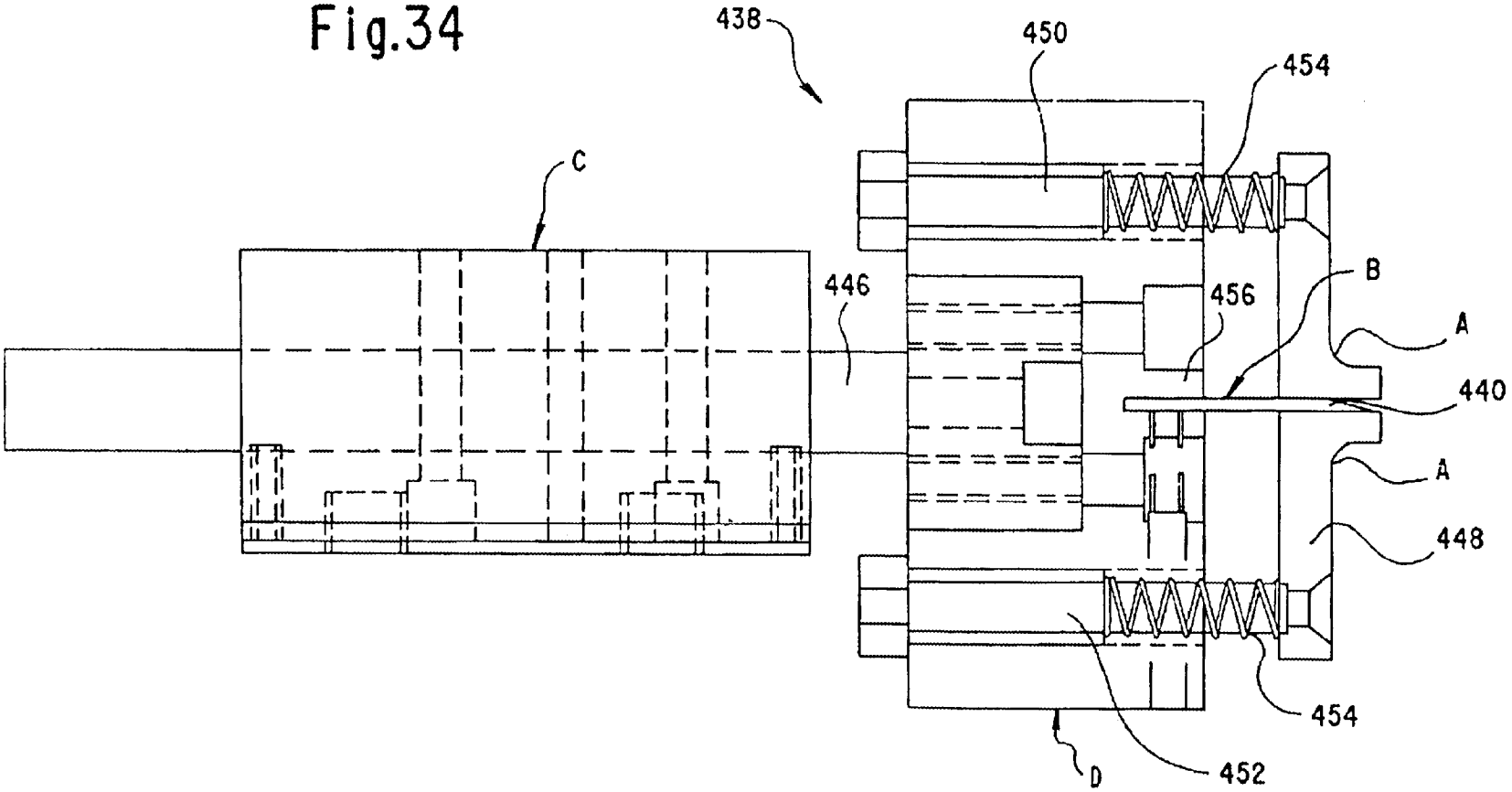
FIG. 34 is a side elevational view of the knife assembly for cutting individually wrapped straws from a band of straws.

Referring now to FIGS. 31A, 32A, 33A and 34 the means for separating the individually wrapped telescoping straws 384 from the plastic band 386 is illustrated. The means for separating the individually wrapped telescoping straws 384 with the adhesive applied to the flat side is disposed intermediate drive pulleys 400, 402 and notched pulley 408 (FIG. 32A). In the best mode of the invention the means for separating the individually wrapped telescoping straws 384 is a knife assembly 438 which includes a knife blade 440, preferably having a serrated cutting edge 442 (FIG. 33A). The serrated edge 442 of knife blade 440 is generally in the retracted position as illustrated in FIG. 34 until the plastic band 386 between individually wrapped telescoping straws 384 is in position at which time solenoid 444 activates piston 446 to advance the knife blade past the protective mechanical sheath 448 to result in serrated edge 442 cutting the plastic band 386 as illustrated in FIG. 33A.

Mechanical sheath 448 includes a pair of laterally disposed support cylinders 450 and 452 as well as associated springs 454 to maintain mechanical sheath 448 in its protected covering position as illustrated in FIG. 34. The action of solenoid 444 in advancing piston 446 causes the knife supporting assembly 456 to bias springs 454 and advance the serrated edge 442 of knife blade 440 to cut the plastic band 386 of the individually wrapped telescoping strews 384. Thereafter the individually wrapped telescoping straws continue their advancement toward drive pulley 400 and 402. When the individually wrapped telescoping straws with an adhesive back, serrated by the knife assembly 438, reach drive pulleys 400 and 402 they are transferred onto a novel straw application belt 460.

Referring now to FIGS. 31A, 32A, 37, 38, 39 and 40 the elastomeric novel straw application belt 460 results in the transfer of the separated individually wrapped telescoping straws with an adhesive back from upper straw conveyor belt 404 and lower straw conveyor belt 406 onto elastomeric straw applicator belt 460. Elastomeric straw application belt 460 is disposed between upper straw conveyor belt 404 and lower straw conveyor belt 406 and is driven by drive shaft 394 in synchronization with straw conveyor belts 404 and 406. The transfer of the individually wrapped telescoping straws 384 onto the elastomeric straw application belt 460 results in the advancement of the captured elastomeric straw in the notched straw receiving pocket 462 and their advancement toward the straw applicator cylinder 392.

Elastomeric straw application belt 460 is precisely controlled by drive pulley 464 on drive shaft 3194. Elastomeric belt extends from drive pulley 464 to straw applicator cylinder 392 and back to drive pulley 464 through idler adjustment pulley 466. The precise transportation of individually wrapped telescoping straws 384 in elastomeric belt 460 is controlled through the use of laterally adjacent timing notches 468 on the back side of elastomeric straw application belt 460 together with rubber bands 480, 482 extending from drive pulley 464 to servant shaft 484 journelled to housing 398 through bearing assembly 486. Servant shaft 484 includes grooves 488 for capturing rubber bands 480 and 482 in rotational alignment with drive pulley 464. The combination of rubber bands 430, 482 with notched receiving pockets 462 holds individually wrapped telescoping straws in notched receiving pockets until a vacuum is applied to notched receiving pockets 462 in elastomeric straw application belt 460.

The maintenance of the separated individually wrapped telescoping straws 384 are further maintained in notched straw receiving pockets 462 by the application of a vacuum through a plurality of ports 470 extending through elastomeric straw application belt which connect the notched straw receiving pockets to a vacuum supply box 472. The vacuum supply box 472 runs along the back side of elastomeric straw application belt 460 to apply a vacuum to maintain the separated individually wrapped telescoping straws 384 with an adhesive on the back until the straws reach the straw applicator cylinder 392 at which point the adhesive back flat surface of the adhesive coated straw contacts sleeved container 58 to apply the straw to the side of the container as it travels down production line 346.

As previously discussed the novel continuous production line of the invention integrates the continuously operating elevated conveyor 22 with the continuously operating novel orientation conveyor 32 with the continuously operating infeed conveyor 60 with the discontinuous operation or screw conveyors 102–112 in the novel filling and sealing apparatus 100. The discontinuous operation of screw conveyors 102–112 are integrated with the continuously operating accumulation conveyor 188, the continuously operating sleever 322 and the continuously operating heat tunnels 324 with the discontinuously operating straw applicators 326 which operates only on demand to advance straws and attach straws when one of the three production lines 344–348 provide a filled, sealed and sleeved container 58.

The integration of the continuous and discontinuous production lines to provide a final packaged product is achieved through the utilization of a computer control system for controlling the entire production operation for the filling, sealing and labeling and completion of the final filled, sealed, labeled end product with a straw applied to it. The operation and control of the integrated production line will be further described with respect to FIGS. 41A–41G which illustrate a computer flow chart logic for operating the novel filling and sealing machine of the novel production line.

Referring now to FIGS. 41A–41F and 42 the time operation sequence and operation of the novel filling and sealing machine in the novel integrated production line is illustrated. The novel filling and sealing machine is activated by turning the power on as represented by block 474 which starts the process by initializing the programmable logic control and the servo-control as represented by block 476. The position screw conveyors 102–112 are set in the home position as represented by block 478. Once the screw conveyors 102–112 are in the start or home position the various functions of the machine and lane options are selected for the various production lines are entered as represented by block 500. This results in a number of procedures which check various stages of the production line including a determination as to whether the pick and place mechanism for the 180 degree turnable transport mechanism 244 is in position as represented by block 504 as well as various fill sensors and fill sequencers are in position with valves closed, pistons retracted and the positive shut-off valve activated as represented by the logic circuits and related interrogation blocks 506 and 508 before the machine is ready for operation as represented by sequence block 510.

Figure 41A:
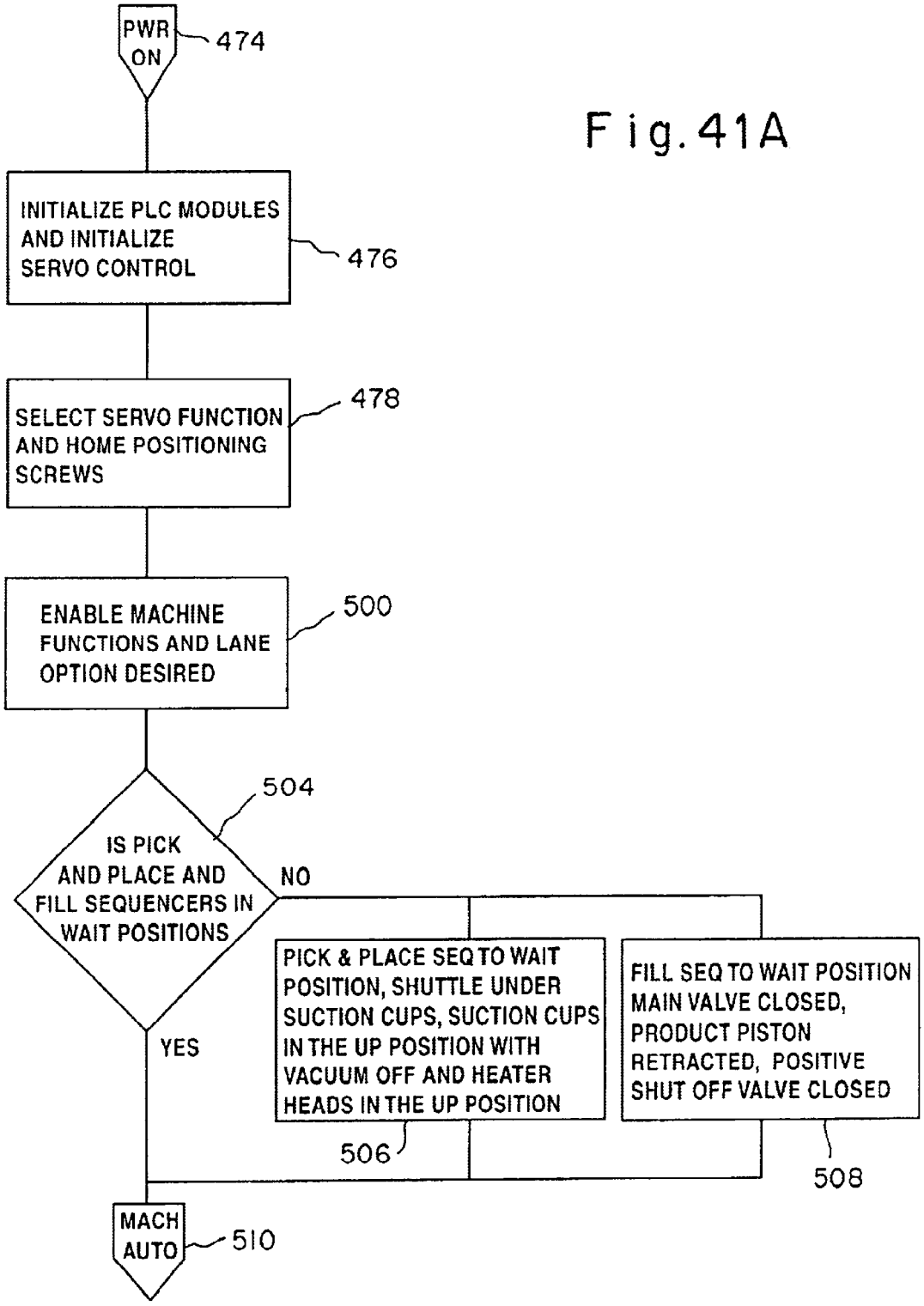
FIGS. 41A–F is a diagram of the computer logic program for operating the novel filler sealer apparatus of the invention.
Figure 41B:
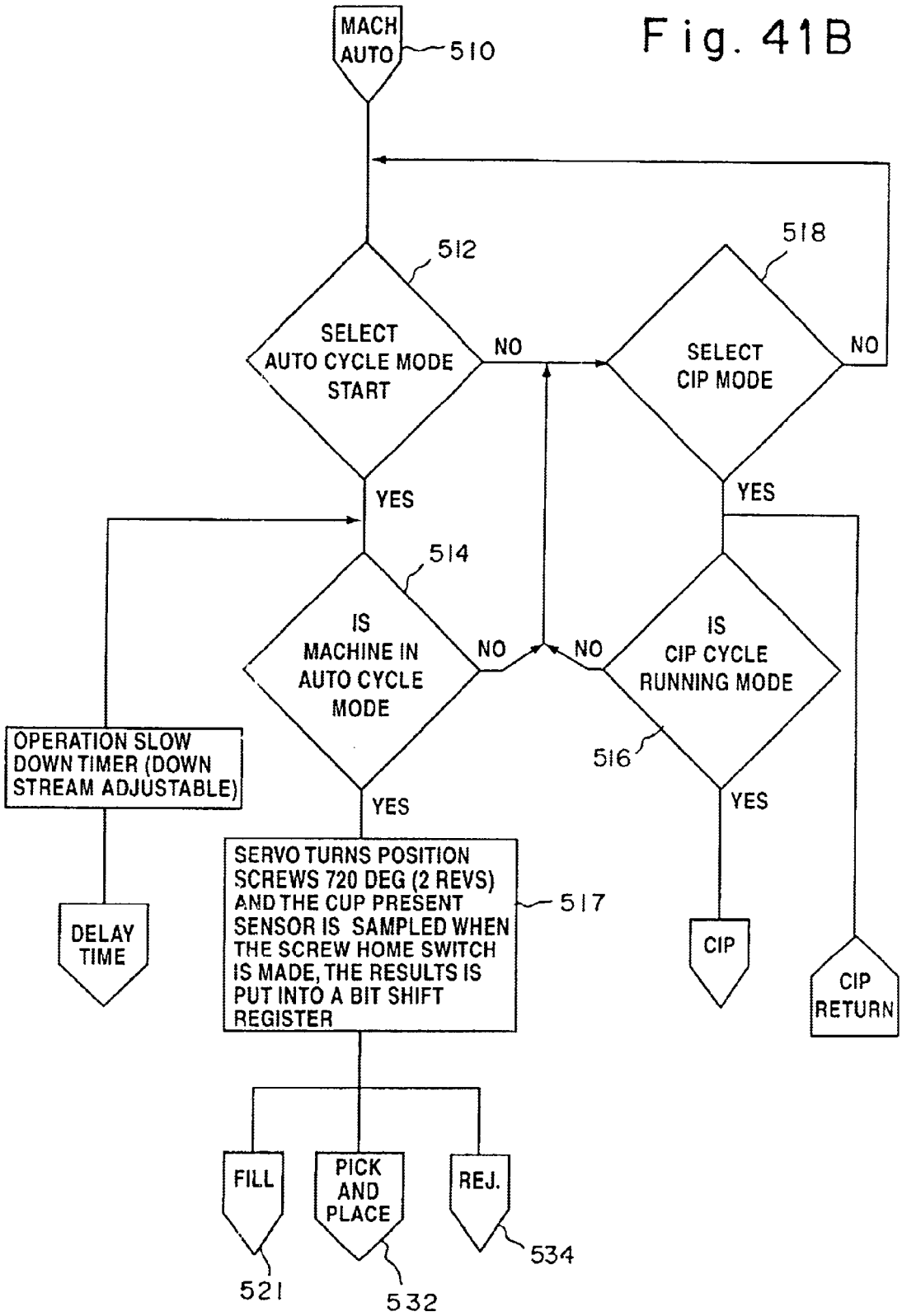
Figure 41C:
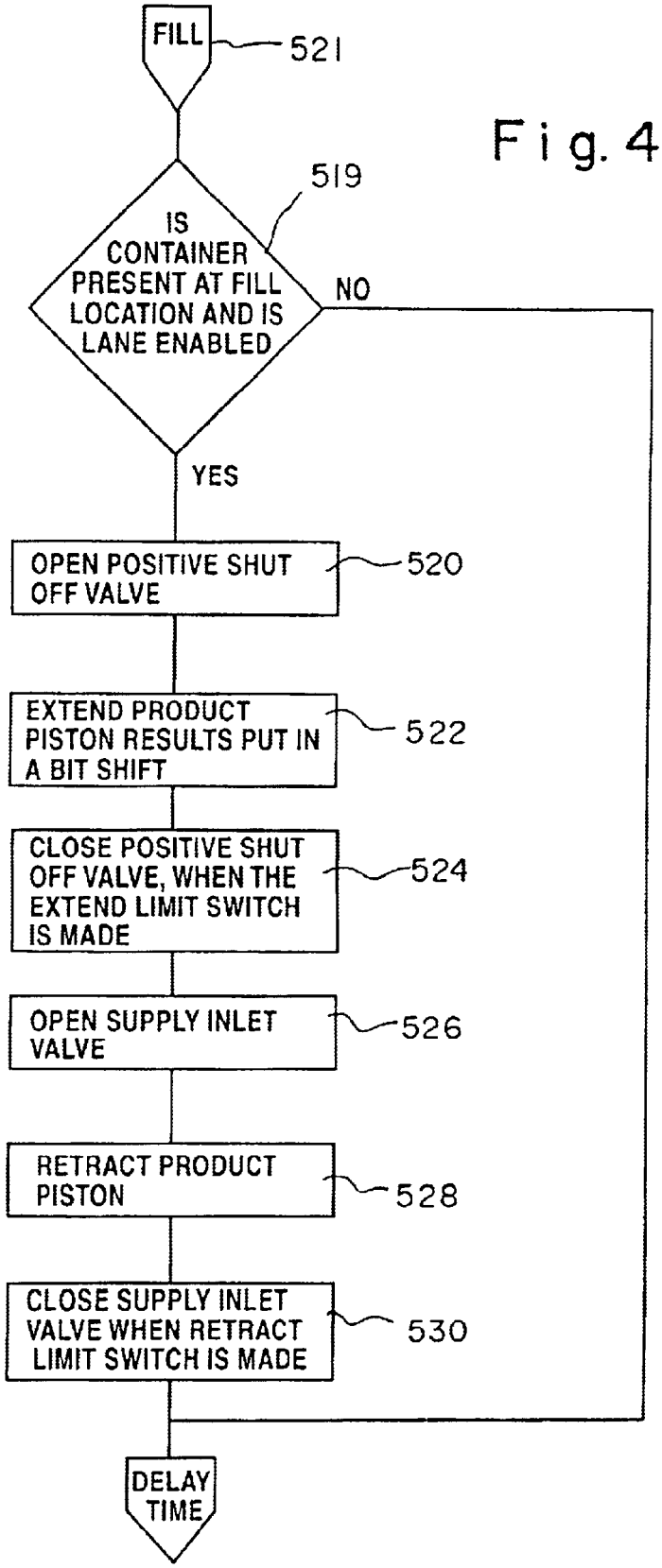

Once the machine is ready for operation, various logic loops are performed as represented by logic blocks 512, 514, 516 and 518 before the position screw is activated and determination is made whether the pa red position sensors 158–164 have sensed the presence of a container at the screw conveyor apparatus as represented by block 517 and which then proceeds to the fill operation as represented by block 521. The computer program prepares for the filling of the containers after determining whether a container is present as represented by block 519 before proceeding to open the positive shut-off valve, as represented by block 520, resulting in the extending of pistons to transfer product (block 522), the closing of the positive shut-off valve when the limit switch is contacted (block 524), then opening the supply inlet valve (block 526), retracting the product piston (block 528) and closing the supply inlet valve (block 530), wren the retract limit switch is contacted as illustrated in FIG. 41C.

Figure 41D:
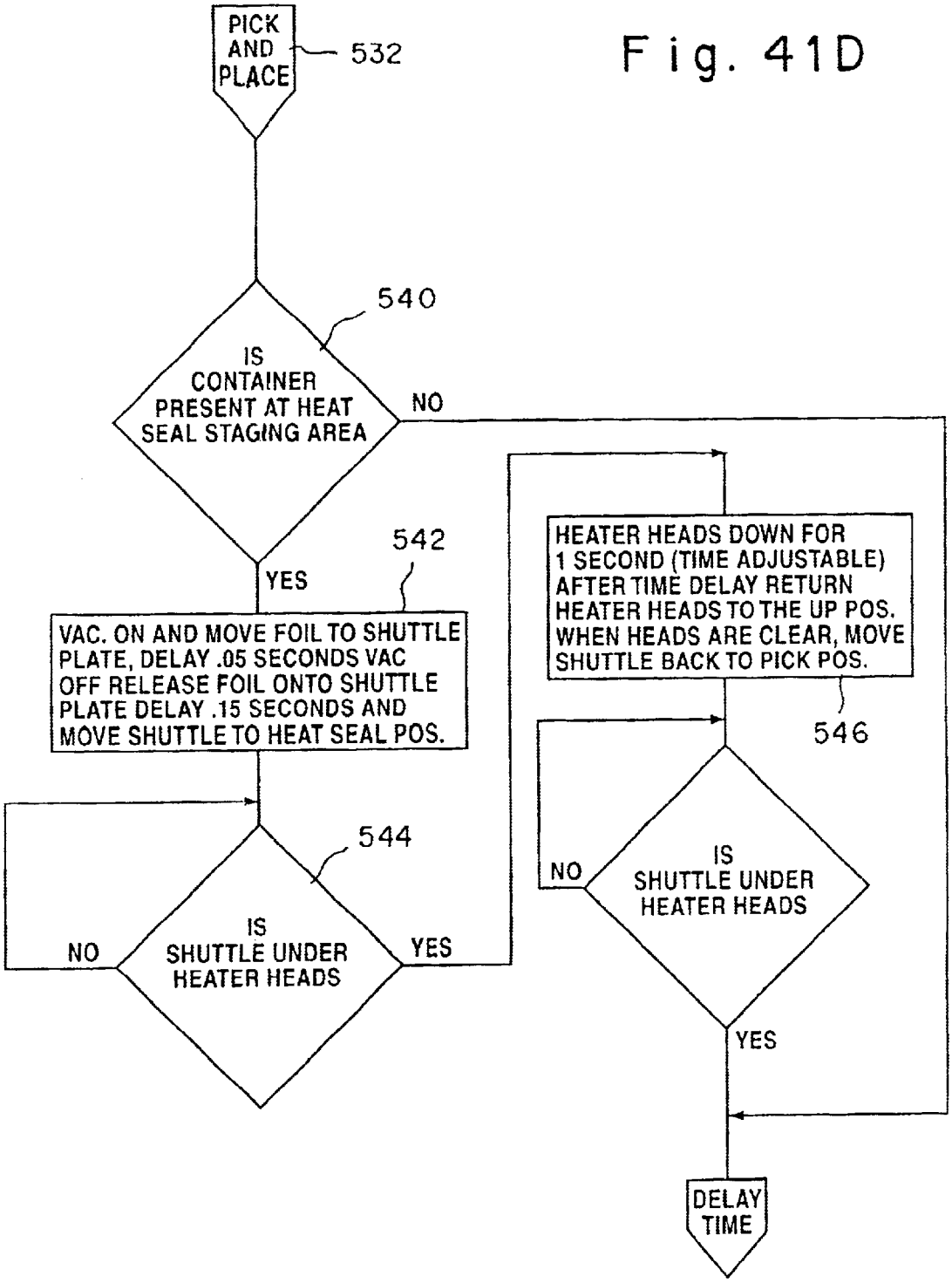
Figure 41E:
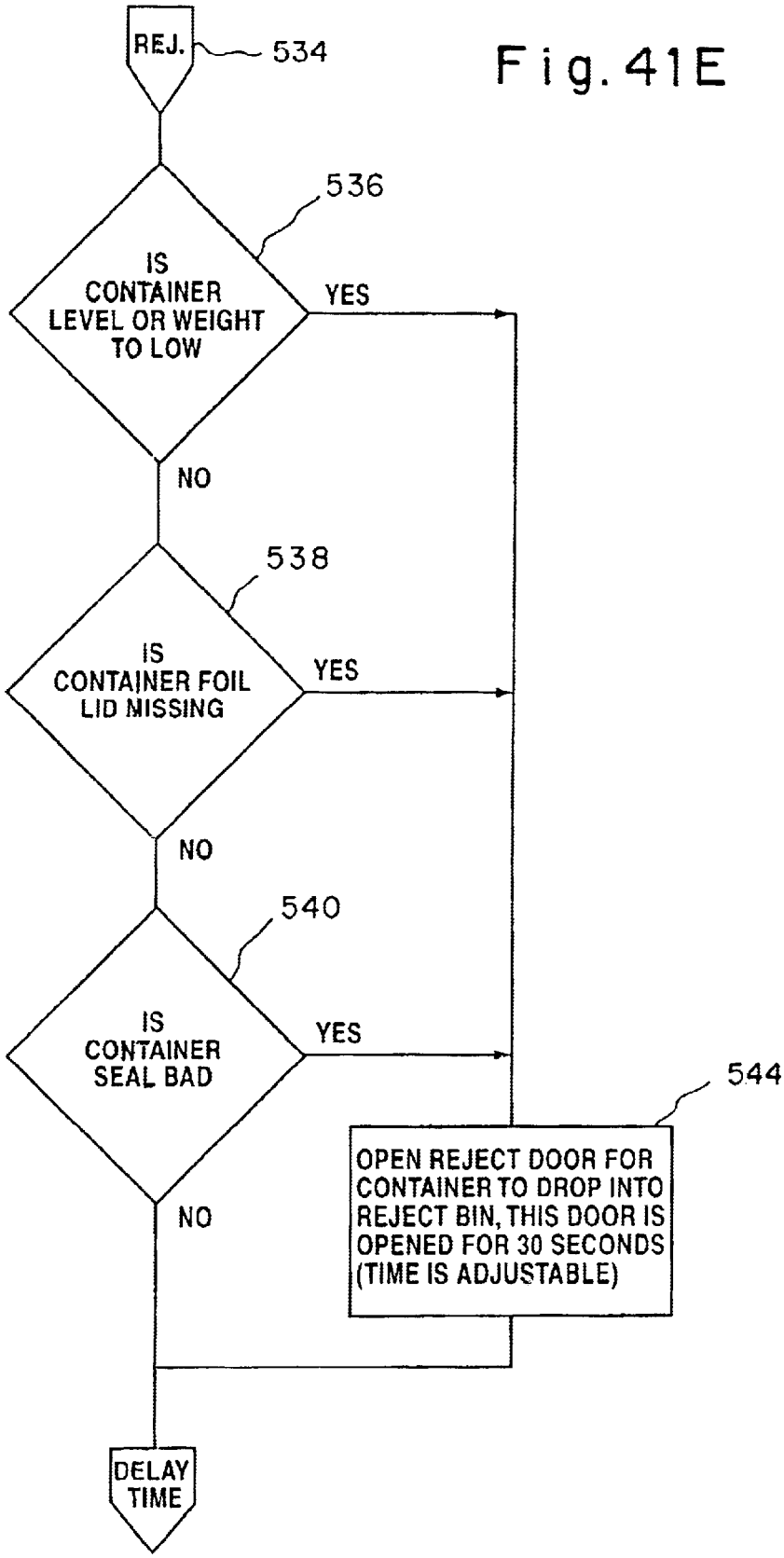

Meanwhile the pick and place logic loop, as represented by block 532, is initialized and the logic sequence of determining whether a container is present at the heat-seal staging area (block 540) is accomplished which includes activating vacuum to move foil to the shuttle plane and then releasing vacuum to transfer foil to the shuttle plate (block 542) and determining whether the shuttle plate is under the heating heads (block 544) before the heater heads are moved down to seal the container (block 546) as illustrated in FIG. 41D. Simultaneously with the filling, the reject circuit as represented by block 534 is activated for simultaneously determining whether to reject the container due to improper fill through a reject door as represented by block 536 (FIG. 41E) or whether to reject the container due to a missing foil seal (block 538) or due to a bad seal (block 540). If either the container 58 either failed seal inspection, does not have a seal or the seal is defective or has been improperly filled reject door 180 is opened as represented by block 544 in FIG. 41E.

Figure 41F:
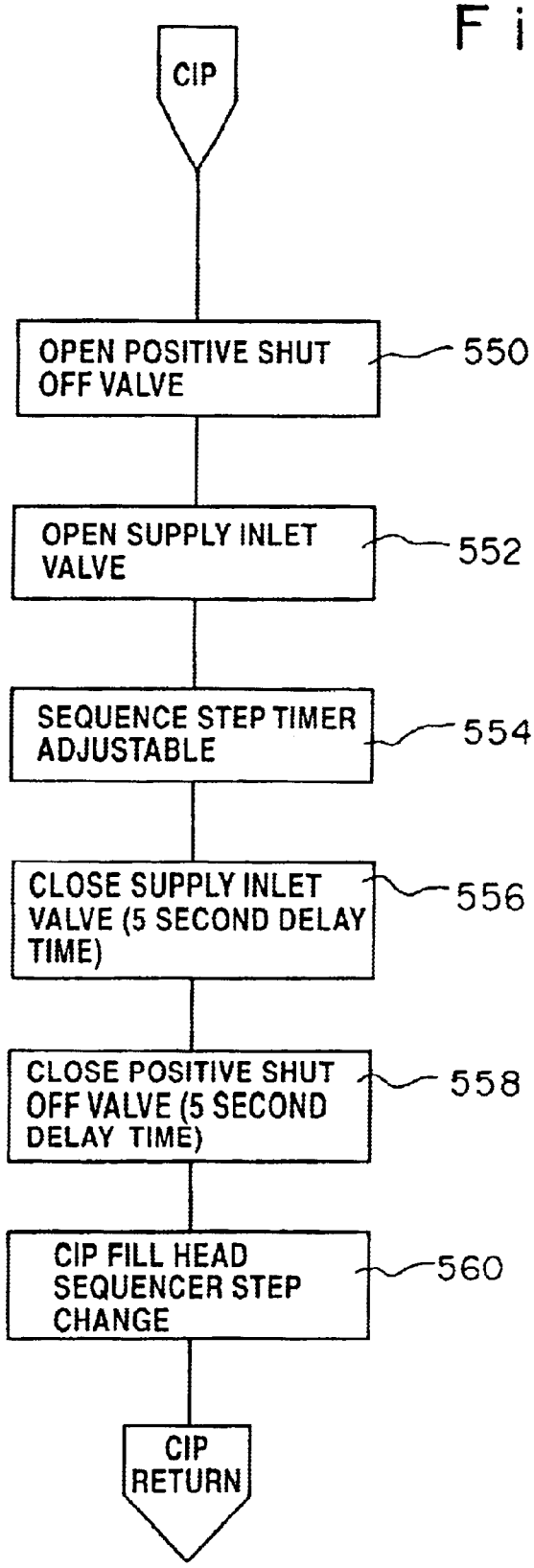
Figure 42:
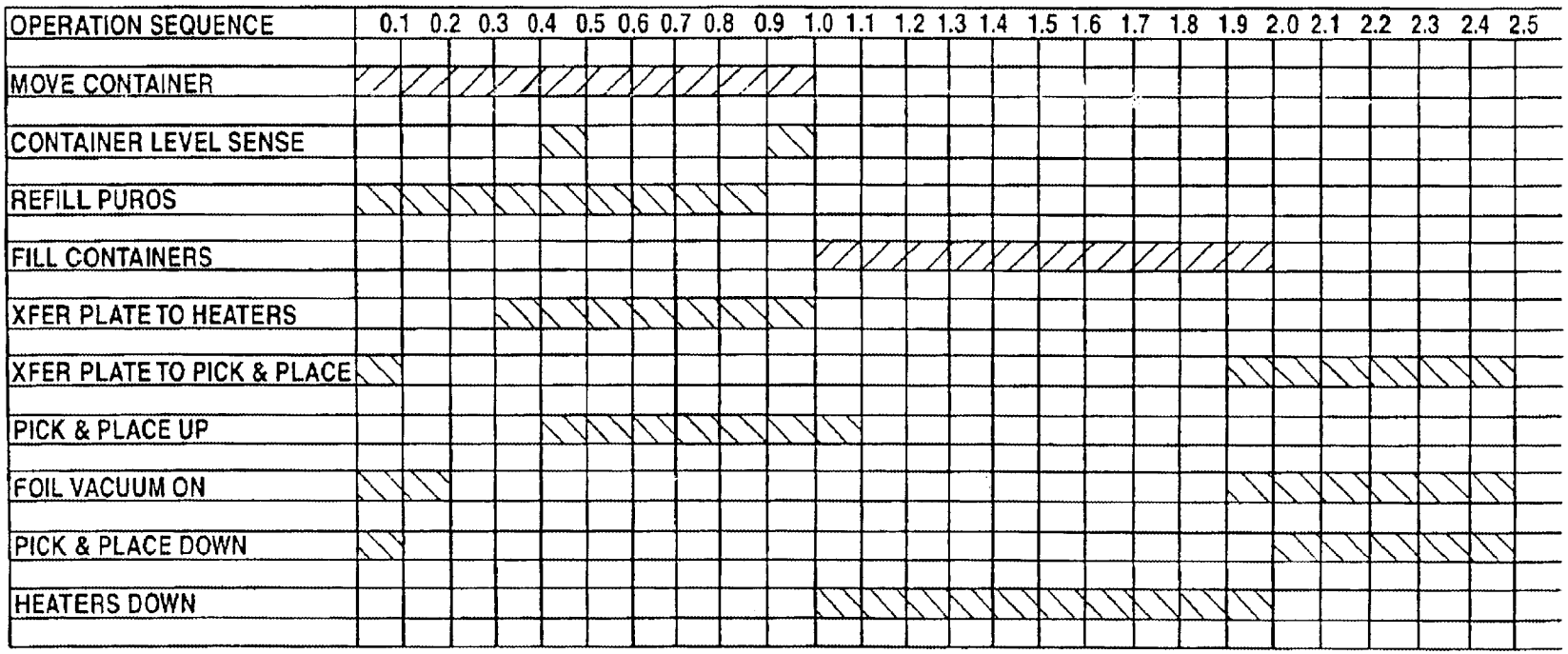
FIG. 42 is a time operation sequence chart illustrating time operation periods for the novel filler sealer apparatus.

FIG. 41F illustrates the automated operation of the clean in place device for providing periodic cleaning of the novel filling sealing machine of the invention. The clean in place operation is initiated by opening the positive shut-off valve in filler head 146 by retracting piston 224 from positive shut-off valve 228 as represented by block 550. Once the positive shut-off valve is opened the cleaning supply inlet valve is opened (block 552) the timing of the cleaning cycle is initiated (block 554). At the completion of the cleaning cycle the supply inlet valve is closed (block 556), the positive shut-off valve is closed (block 558) end the filler head is replaced to the fill position as represented by block 560 in FIG. 41F. The positive shut-off valve 228 provided by diaphragm 153 and rim 157 is similarly opened in modified filler head 141 by the removal of air pressure from plenum space 155 to provide for cleaning in the same manner as with filler head 146.

Figure 43A:
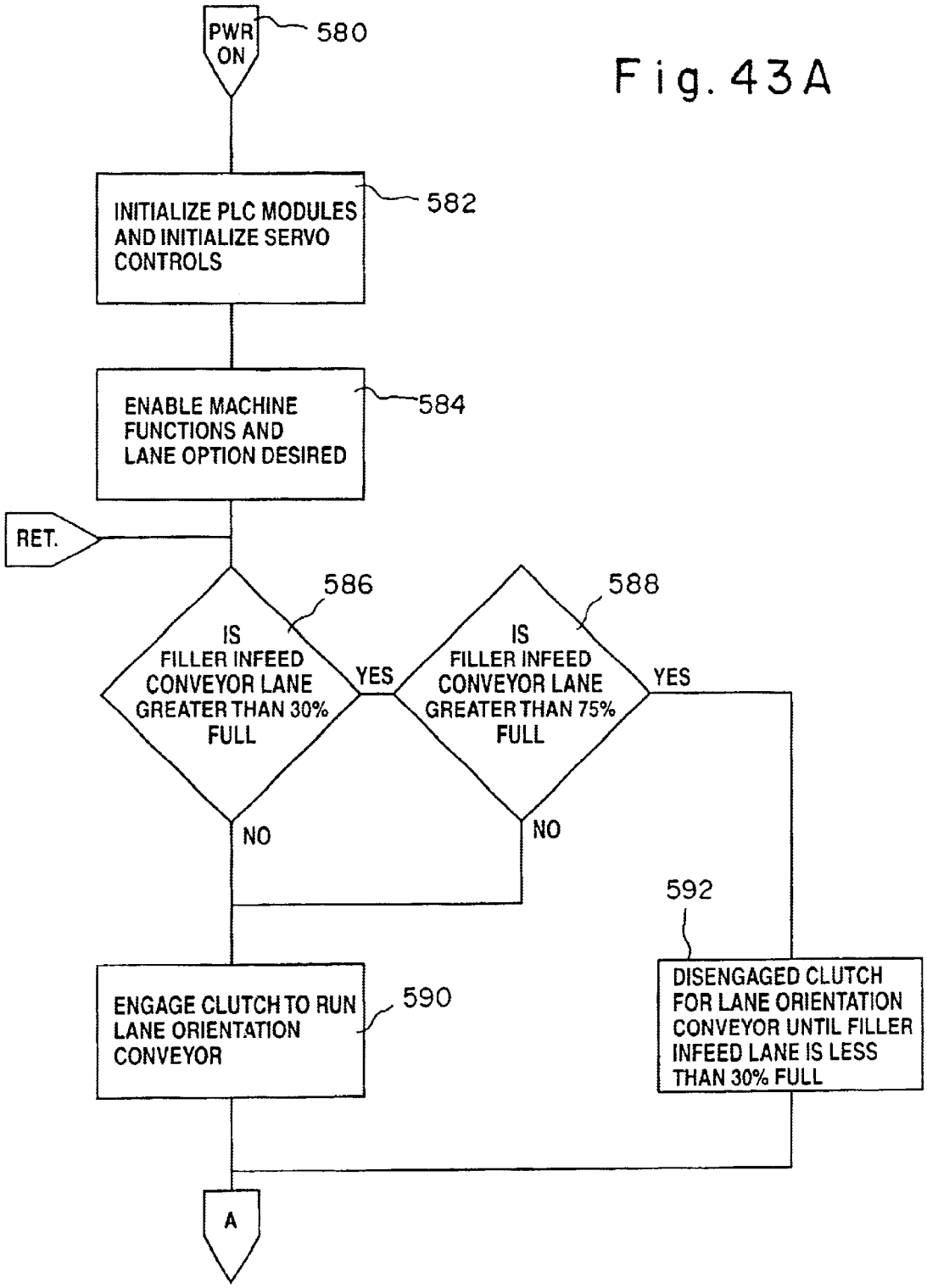
FIGS. 43A–C is a diagram of he computer logic program for operating the novel production line of the invention.
Figure 43B:
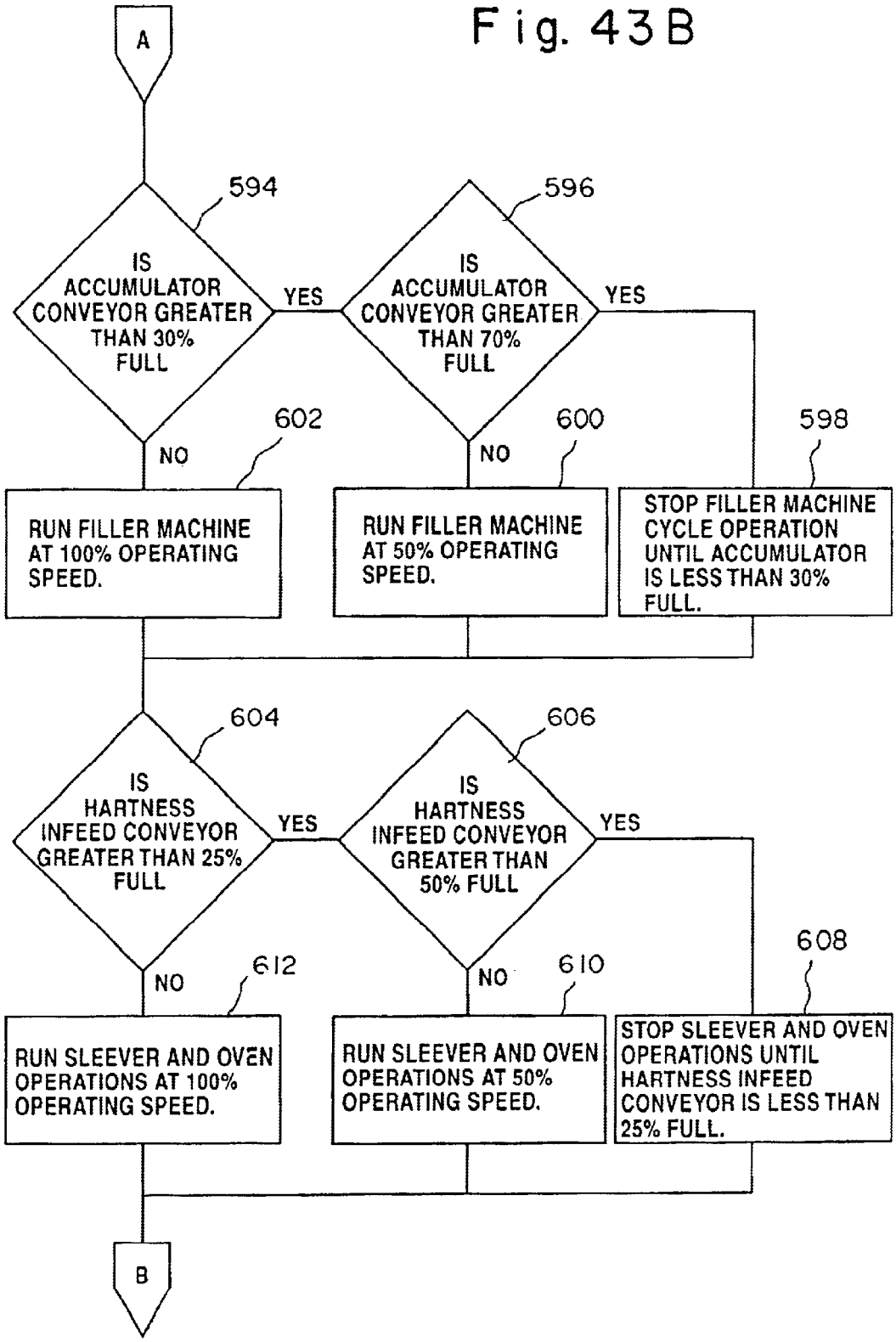
Figure 43C:
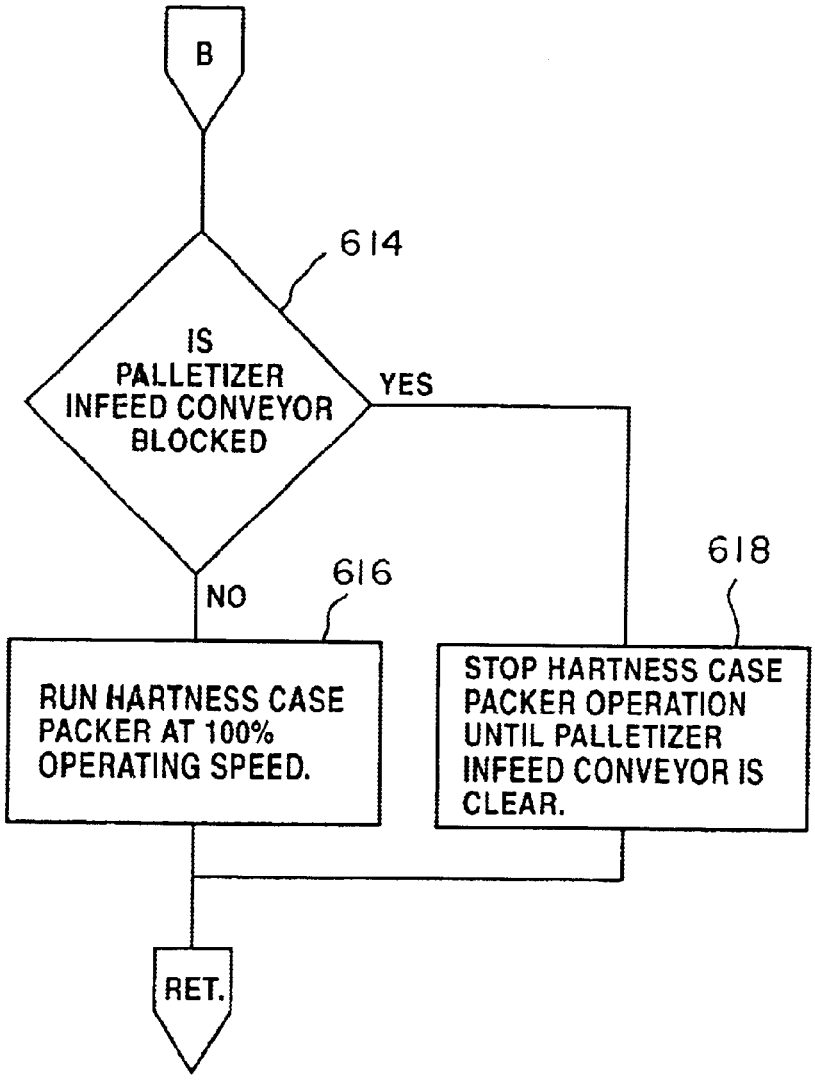
Figure 44:
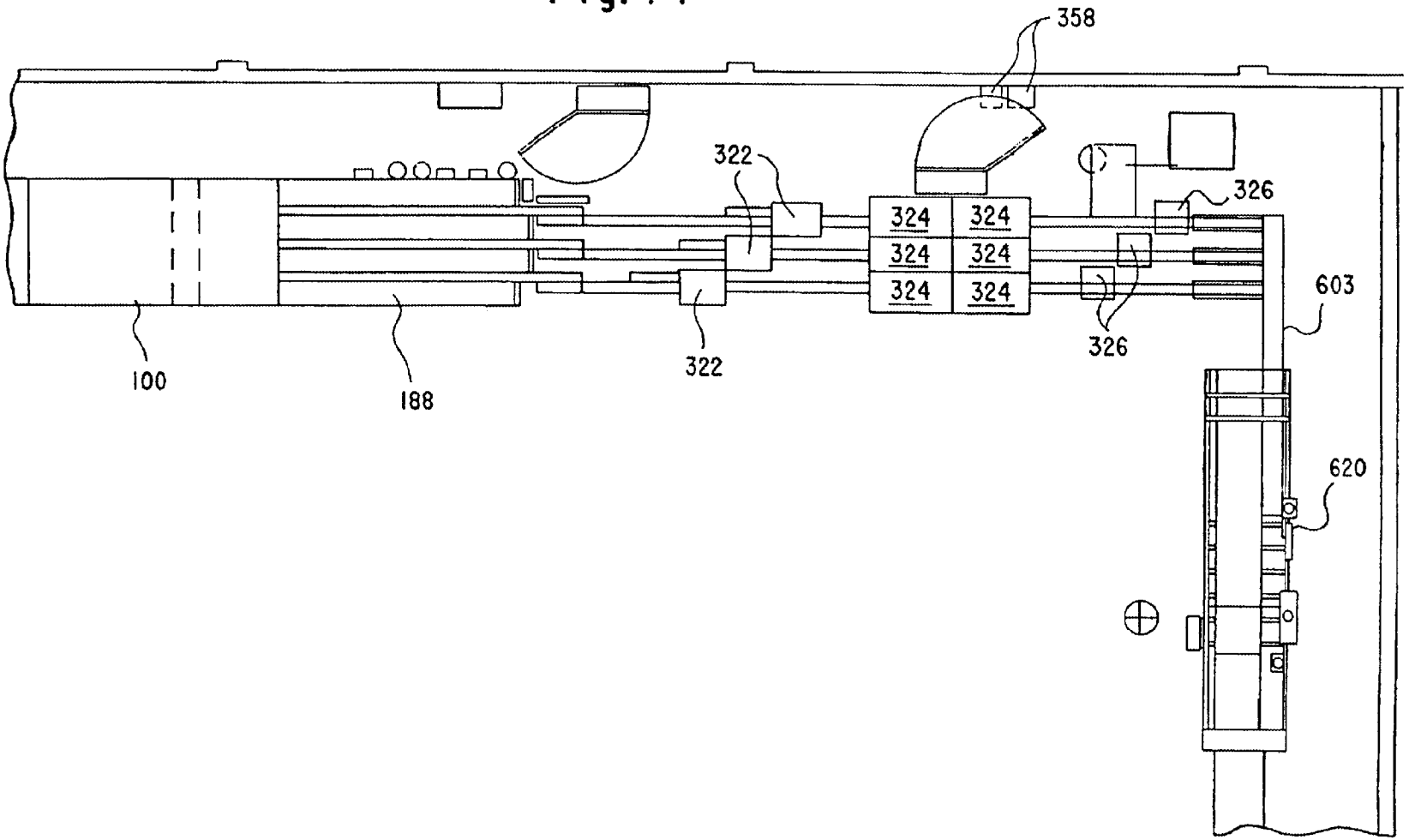
FIG. 44 is a top plan view illustrating the novel computer controlled production line including the carton packaging end of the novel production line.

Additional computer program and control is provided for the novel production line of the preferred embodiment including the operation of the elevator conveyor, operation of the rough sequencing orientation conveyor, operation of the accumulation conveyor, operation of the conveyors for the sleevers and heat tunnels as well as for the operation of the novel straw applicator apparatus to provide a continuous production line to maintain an integrated production over various continuous and discontinuous conveyor processes, number of production lines and speeds of production throughout the novel conveyor production of the invention as illustrated in FIG. 43A, FIG. 43B and FIG. 43C. The power is turned on as represented by block 580 which starts the process by initiating the programmable logic control and initiating the servo controls as represented by block 582. The machine functions and lane options are selected as represented by block 584.

The logic loop for integrating the novel integrated automated production line includes control of the orientation conveyor 32 by first determining the amount of containers on infeed conveyor 60. If any lane of the infeed conveyor is about 75% or less full the clutch assembly 68 is engaged to run orientation conveyor 32 as represented by blocks 586, 538 and 590. In the event any lane of the infeed conveyor 60 is greater than about 75% full then clutch assembly 68 is disengaged as represented by blocks 588 and 592 to slow down input to one or more of the screw conveyors 102–112 of the novel filling and sealing machine 100 as illustrated in FIG. 43A.

The logic loop for regulating the operation of the novel filler sealer machine 100, the sleepier 322 and heat tunnels and production lines 344, 346 and 348 by accumulation conveyor 188 is illustrated in FIGS. 43B and 43C. As illustrated by blocks 594 and 596 the amount of filled containers 58 on the accumulation conveyor control the operational speed of the novel filler sealer machine which for purposes of illustration are run at 30%, 50% and 100% production rates as illustrated by blocks 598, 600 and 602 respectively. The speed of operation of sleevers 322 and ovens 324 are similarly regulated by a Hartness infeed conveyor 603 (FIG. 44) available from Hartness International of Greenville, S.C. (block 604 and 606) which like accumulation conveyor 188 controls the speed of operation of the sleevers 322 and ovens 324 in lanes 344, 346 and 348 which for purposes of illustration are run at 25%, 50% and 100% as illustrated bar blocks 608, 610 and 612 of FIG. 43B.

Referring now to FIG. 43C the computer control of the production line can also include control of the packing of cartons containing the filled, sealed and packaged consumer product with the straw applied to the outside of the container by including control of the palletizer infeed conveyor (block 614) which controls the rate of production by the Hartness case packer as represented by block 616 and 618. The palletizer infeed conveyor is a commercially available conveyor obtained from FANUC Robotics of Irvine, Calif. The palletizer infeed conveyor like the accumulation conveyor provides information to the computer to control the boxing of filled, sealed and inspected containers. The Hartness case packer 620 (FIG. 44) is a carton packaging machine also available from Hartness, International.

The input elevated conveyor provides a single continuous production line which is divided into four separate production lines that are susceptible to individual control and which provides for the orientation and rough sequencing of containers that are then fed into the four production lines of the novel sealing and filling apparatus 100. The novel production line also includes provision for shutting down one or more of the production lines in the event there is a jam or fault in any of the lines, without stopping the entire production operation. The four production lines from each of multiple work stations of the novel filling and sealing apparatus of the invention. The novel tilling and sealing apparatus of the invention utilizing the positioning screw conveyor receives and indexes the containers from the orientation device and transports those containers to the plurality of work stations in a plurality of production lines along the novel filling and sealing apparatus of the invention.

The novel filling and sealing apparatus fills pairs of containers to a six ounce fluid capacity with an acceptable overflow of about ⅛ of an ounce without sloshing or spilling the containers during production. Further the novel filling and sealing apparatus handles a plurality of containers at various stations to inspect, seal, remove and purge ambient air from the containers and provide an aesthetically pleasing crimp on the foiled lid with a tab folded (and not creased) up and over to lie on the top of the container. All containers not meeting the acceptable product content level or all containers not properly sealed are rejected through doors at the bottom of the bed of the novel filler and sealer apparatus of the invention.

The frame assembly of the novel filler and sealer apparatus is made of stainless steel with sliding access doors made of ⅜ of an inch clear Lexan® plastic to provide for an ease of cleaning as well as maintaining a clean production environment. The sliding access doors include a safety interlock feature to prevent access to the machine during operation. The product filler assembly includes sensors that not only detect the presence of containers but also whether the containers containers have been properly filled as well as an electronic feed-back adjustment system by which the volume of dispensed food product is controlled by the stroke of the piston to prevent multiple containers from being improperly filled. The filling system is activated by opening the filler manifold actuator and retracting the filler cylinder which draws in the product. The filler manifold actuator is then closed, the filler cylinder pushes forward and simultaneously the positive shut-off valve opens, pumping the product into the container. The positive shut-off valve then closes to prevent any product from dripping during the filling cycle. In the event a container has a low product fill the sensor will also signal the programmable logic control and that container is then rejected from the novel filling and sealing production line and this information is then used to modify the time the positive control valve remains open to automatically correct for fill errors for each of the filler heads.

The pick and place assembly in the preferred embodiment utilizes eight vacuum cups four vacuum cups per each position screw conveyor with each pick and place assembly accommodating two position screw conveyors. As a result three pick and place mechanisms are mounted on cross-supports to accommodate the twelve production lanes provided by the six position screw conveyors. The vacuum cups of the pick and place mechanism are operated individually by pumps and valves to individually and selectively remove foils located above the assembly and then allow the pick and place mechanism to mechanically pivot 180 degrees by guide shafts and cams driven place mechanism are operated individually by pumps and valves to individually and selectively remove foils located above the assembly and then allow the pick and place mechanism to mechanically pivot 180 degrees by guide shafts and cams driven by cylinders so that at the bottom of the stoke the pick and place mechanism deposits the foil directly down into a single shuttle plate having twenty-four cavities for accommodating the twelve production lanes provided by the six position screw conveyors. If any container has been removed or is defective, the foil is not removed and the corresponding opening for the shuttle plate remains empty.

The shuttle plate then moves from the pick and place assembly position to the heat-seal position to line up the fill seal in direct perpendicular alignment to the heat-seal pistons. However, prior to the advancement of the shuttle plate assembly the heat-seal pistons purge the filled containers with nitrogen gas through a manifold operated by three solenoid control valves. The nitrogen is routed through the pistons' heads as previously described, and when all of the containers that are to be sealed are purged with nitrogen gas, the shuttle plate moves into position and the pistons are advanced through the openings in the shuttle plate to seal the foil to the container to provide a filled and sealed container.

As the foil is heat-sealed to the container it is also form-fitted around the top surface of the container (Picture 5 and 6) and a foiled tab provided on the foil seal protrudes outwardly and, as the shuttle plate moves back to the pick and place position, it folds the tab over the top of the container. As the container exits the sealing area the tab is brushed back to bend the tab over the too of the container to provide a final filled and sealed container. Any container not properly having a proper foil seal or with low product level are rejected as previously described.

The filled, sealed and inspected containers are then sleeved with a sleeve containing a label and the sleeve is heat-shrunk to the container in the heat tunnels. A telescoping straw is applied to the outside of the container with the novel straw applicator to provide a final, filled, sealed, labeled, packaged product including a telescoping straw as illustrated in Picture 4. A comparison of Picture 4 with Picture 1 (prior art) illustrates the difference in appearance of the final product as a result of utilizing the novel straw applicator as well as the utilization of the novel ambient air purging heat-sealing pistons to form fit the foil seal around the container in the novel filler sealer machine of the invention.

The novel filling and sealing machine is controlled by an Allen Bradley SLC 5/04 PLC. A programmable logic control monitors all of the sensors discussed in addition to failsafe sensors located on all major assemblies. The novel production line can include screens and computer interfaces for operators to monitor the entire automated production system.

The cleaning of the novel filling and sealing apparatus is provided by a clean in place showering system which utilizes a series of overhead clean in place tubing which creates a sanitized water shower system for cleaning all of the components which handle food or components upon which food product can be spilled during production. The nozzles of the showering system create an overlapping fan-like dowsing effect for dowsing all of the lanes in the novel filling and sealing machine. The clean in place system further circulates cleaning solution through the filler manifolds, filler valves to the filler pumps and to the positive shut-off valves and en returns the cleaning solution to the clean in place manifold. The closed loop clean in place system requires that all internal components are free from cracks and other imperfections or welds that would prevent proper cleaning during the clean in place cycle. The same is true with the heater heads which are designed to pivot toward the output end of the novel filling and sealing apparatus of the invention. The pivotable heater heads allows access for cleaning of any heater heads that might contact any food product surface.

As will be recognized by those skilled in the art the novel integrated automated production line can be used to fill containers other than yogurt beverage containers or other yogurt product containers and is applicable to various types of fluid food products, particularly baby food, dairy products, creams, puddings and food as well as to filling containers with non-food fluid materials in a liquid or dry form. As will be further recognized by those skilled in the art the novel production line is not limited to plastic containers but can be easily adapted to glass bottles, metal or other containers which may or may not be transparent and from which the level of the liquid can be read either through the container or sensed by a sender through the top of the container to determine the volume of material in the container or weighed in novel filler sealer apparatus where the contents of the container are sold by weight.

It will also be appreciated the invention is not limited to containers that have a ton of cross-section less than the base of the container since such containers can be filled in alternative embodiments of the novel filling and sealing machine of the invention. It will be further appreciated that various portions of the novel production line are novel in their own right including the orientation conveyor, novel filling and sealing apparatus and novel straw applicator which may be used alone in various other types of production lines without using the entire novel production line of the invention. Similarly certain aspects of the production line, including the novel ambient air purging sealer piston, positive shut-off valve, novel straw applicator belt and novel screw conveyor, novel retractable production line scale may be utilized without utilizing the entire production line, entire machines or entire novel systems of the present invention. These subcomponents as well as the entire novel production line are each themselves subject to changes and modifications by those skilled in the art for purposes of implementing the invention in a variety of applications. In addition the computer control of production flow techniques utilizing the accumulation conveyor(s) may be achieved by other flow rate mechanisms alone or with conveyors and such flow rate control mechanisms will be referred to generically as "accumulation means". As a result those skilled in the art will recognize the invention has a wide range or applications and implementations which are deemed includes within the scope of the present invention as defined in the following claims.

Further, as used herein and in the following claims, the word 'comprising' or 'comprises' is used in its American technical sense to mean the enumerated elements include but do not exclude additional elements which may or may not be specifically included in the dependent claims. It will be understood such additions, whether or not included in the dependent claims, are modifications that both can be made within the scope of the invention. It will be appreciated that these and other modifications can be made within the scope other invention as defined in the following claims.

What is claimed is:

1. A filling and sealing machine comprising:

(a) a screw conveyor shaft having a first end and a second end and a spiral thread disposed between said first end and said second end of said screw conveyor shaft for conveying a pair of containers disposed on laterally adjacent sides or said spiral thread disposed on said screw conveyor shaft;

(b) a pair of guides in axial alignment with said screw conveyor shaft and intermediate the ends of said screw conveyor shaft;

(c) means for intermittently rotating and stopping said screw conveyor shaft; and (d) a filling area, a sealing area and an inspection area disposed along the length of said screw conveyor shaft, said filling area, said sealing area and said inspection area in perpendicular alignment between successive spiral threads of said screw conveyor shaft when said screw conveyor shaft is stopped.

2. The filling and sealing machine of claim 1 further comprising a reject area disposed intermediate said inspection area and said second end of said screw conveyor shaft and in perpendicular alignment between said successive spiral threads of said screw conveyor shaft with said filling area, said sealing area and said inspection area when said screw conveyor shaft is stopped.

3. The filling and sealing machine of claim 2 further comprising a second filling area, a second sealing area, a second inspection area and a second reject area in a perpendicular alignment between successive spiral threads on the laterally adjacent sides of said screw conveyor shaft.

4. The filling and sealing machine of claim 3 wherein said filling area and said second filling area, said sealing area and said second sealing area and said inspection area and said second inspection areas and said reject area and said second reject area are in axial alignment between successive spiral threads on opposite sides of said screw conveyor shaft.

5. The filling and sealing machine of claim 2 wherein said screw conveyor shaft includes an area of reduced diameter in said reject area.

6. The filling and sealing machine of claim 1 wherein said screw conveyor shaft includes an area of reduced diameter of said screw conveyor disposed in said inspection area.

7. The filling and sealing machine of claim 6 wherein said area of reduced diameter of said screw conveyor is without a spiral thread.

8. The filling and sealing machine of claim 7 further comprising a retractable scale disposed in said inspection area.

9. The filling and sealing machine of claim 7 further comprising a vibrator for moving containers in said area of reduced diameter.

10. The filling and sealing machine of claim 1 further comprising a plurality of filling areas, a plurality of sealing areas, a plurality of inspection areas and a plurality of reject areas in perpendicular alignment between successive spiral threads of said screw conveyor shaft when said screw conveyor shaft is stopped.

11. The filling and sealing machine of claim 10 wherein said perpendicular alignment between successive spiral threads with said plurality of filling areas, said plurality of sealing areas, said plurality of reject areas are provided in axial alignment between successive spiral threads on opposite sides of said screw conveyor shaft.

12. The filling and sealing machine of claim 1 further comprising a second screw conveyor shaft disposed in parallel alignment with said screw conveyor shaft.

13. The filling and sealing machine of claim 1 further comprising a plurality of screw conveyor shafts disposed in parallel alignment with said screw conveyor shaft.

14. The filling and sealing machine of claim 13 further comprising a plurality of filling areas, a plurality of inspection areas and a plurality of reject areas in perpendicular alignment between successive spiral threads of said screw conveyor shaft and said second screw conveyor shaft.

15. The filling and sealing machine of claim 14 further comprising a plurality of sealing areas in perpendicular alignment between successive spiral threads of said screw conveyor shaft and said second screw conveyor shaft.

16. The filling and sealing machine of claim 15 wherein said plurality of screw conveyor shares are six screw conveyor shafts.

17. The filling and sealing machine of claim 16 wherein said sealing areas seal filled containers with a foil seal heat-sealed to said filled containers.

18. The filling and sealing machine of claim 17 wherein said foil seal is applied to said containers with a piston having a heating element.

19. The filling and sealing machine of claim 18 wherein said piston heating element is a spring-biased heating element.

20. The filling and sealing machine of claim 18 wherein said piston includes a gas purge port for purging ambient air from said container before said container is sealed with said foil seal.

21. The filling and sealing machine of claim 18 wherein said piston includes a pivot bearing.

22. The filling and sealing machine of claim 21 wherein said pivot bearing is a ball and socket bearing.

23. The filling and sealing machine of claim 18 further comprising a device for periodically circulating a cleaning solution to said filling area to clean said filling area.

24. The filling and sealing machine of claim 18 further comprising a computer for controlling the means for intermittently rotating and stopping said screw conveyor shaft.

25. A container filling and sealing machine comprising:

(a) a pair of aligned guides for receiving paired containers;

(b) a positioning shaft having a first end and a second end with a spiral thread disposed between said first end and said second end of said positioning shaft in axial alignment with said pair of aligned guides for advancing said paired containers;

(c) a pair of container filling ports disposed intermediate the ends of said pair of aligned guides and said positioning shaft to fill a first set of paired containers;

(d) a pair of heat-sealing pistons for heat-sealing a second set of paired containers;

(e) a shuttle plate for receiving and transferring a foil to said pair of heat-sealing pistons; and (f) means for intermittently rotating said positioning shaft in a timed relationship to the completion of the filling of said first set of paired containers and said heat-sealing of said second set of paired containers.

26. The container filling and sealing machine of claim 25 further comprising a pair of fill inspection devices disposed between said pair of container filling ports and said pair of heat-sealing pistons for determining whether each container of said first set of paired containers is properly filled.

27. The container filling and sealing machine of claim 26 further comprising a pair of fill reject doors disposed between said pair of fill inspection devices and said pair of heat-sealing pistons for removing an improperly filled container.

28. The container filling and sealing machine of claim 26 further comprising a pair of seal inspection devices disposed between said pair of heat-sealing pistons and said second end of said positioning shaft.

29. The container filling and sealing machine of claim 28 further comprising a pair of reject doors disposed between said seal inspection devices and said second end of said positioning shaft for removing a container failing inspection.

30. The container filling and sealing machine of claim 29 further comprising a computer for controlling said timed relationship.

31. The container filling and sealing machine of claim 30 further comprising a pair of position sensors for determining whether both containers of said first set of paired containers are in place under said pair of container filling ports.

32. The container filling and sealing machine of claim 31 further comprising a pair of independently controllable positive control shut-off valves connected to said pair of container filling ports.

33. The container filling and sealing machine of claim 32 wherein said pair of independently controllable positive control shut-off valves are independently operated by said computer based on information provided by said pair of position sensors.

34. The container filling and sealing machine of claim 31 further comprising a second pair of position sensors for determining whether both containers of said second set of paired containers are in place under said shuttle plate.

35. The container filling and sealing machine of claim 34 further comprising a device for depositing separate pieces of foil on said shuttle plate.

36. The container filling and sealing machine of claim 35 wherein said device for depositing separate pieces of foil are independently operated by said computer based on information provided by a bit shift register in said computer.

37. The container filling and sealing machine of claim 36 wherein said positioning shaft is of a reduced diameter in the area of said fill inspection devices.

38. The container filling and sealing machine of claim 37 wherein said fill inspection device is a retractable scale.

39. The container filling and sealing machine of claim 38 wherein said retractable scale is operated by a shaft driven by said shuttle plate.

40. The container filling and sealing machine of claim 30 wherein said positioning shaft is of a reduced diameter in the area of said pair of reject doors.

41. The container filling and sealing machine of claim 30 further comprising a second positioning shaft having a first end and a second end with a spiral thread disposed between said first end and said second end.

42. The container filling and sealing machine of claim 41 wherein said positioning shaft and said second positioning shaft are composed of plastic.

43. The container filling and sealing machine of claim 42 further comprising a second pair of aligned guides for receiving a second group of paired containers.

44. The container filling and sealing machine of claim 43 wherein said first pair of aligned guides and said second group of aligned guides are composed of plastic.

45. The container filling and sealing machine of claim 30 wherein each of said pair of container filling ports are connected to a positive control shut-off valve.

46. The container filling and sealing machine of claim 45 wherein said positive shut-off valve is provided by a tapered piston and tapered piston seat combination.

47. The container filling and sealing machine of claim 45 wherein said positive shut-off valve is provided by an air pressure activated diaphragm to open and close a nozzle.

48. The container filling and sealing machine of claim 45 further comprising a clean in place device for periodically circulating a cleaning solution to clean said positive control shut-off valve.

49. The container filling and sealing machine of claim 30 wherein said pair of heat-sealing pistons includes a spring-biased heating element.

50. The container filling and sealing machine of claim 49 wherein each heat-sealing piston of said pair of heat-sealing pistons has a pivot bearing at one end.

51. A filling and sealing machine comprising:

(a) an auger with a spiral thread disposed between a first end and a second end of said auger for conveying a pair of containers on laterally adjacent sides of said spiral thread;

(b) a pair of guides disposed laterally adjacent to each other and in axial alignment with said auger;

(c) a pair of filler ports disposed laterally adjacent to each other and in perpendicular alignment between successive spiral threads on said auger when said auger is stopped for filling said pair of containers;

(d) a pair of sealing pistons disposed laterally adjacent to each other and in perpendicular alignment between successive spiral threads on said auger when said auger is stopped for sealing a foil to said pair of containers;

(e) a shuttle plate for transferring said foil to said pair of sealing pistons;

(f) means for intermittently rotating and stopping said spiral threads timed to the simultaneous filling and sealing of said pair of containers; and (g) computer means for controlling said means for intermittently rotating and stopping said spiral threads.

52. The filling and sealing machine of claim 51 further comprising a second auger with a spiral thread disposed in axial alignment with said auger with a spiral thread.

53. The filling and sealing machine of claim 52 further comprising a plurality of filler ports and a plurality of heated pistons.

54. The filling and sealing machine of claim 53 further comprising a plurality of filler inspection areas, a plurality of filler reject doors, a plurality of seal inspection areas and a plurality of seal rejection doors.

55. The filling and sealing machine of claim 54 further comprising a plurality of sensors for providing information to said computer for operating said plurality of filler reject doors and said plurality of seal rejection doors.

56. The filling and sealing machine of claim 53 wherein said plurality of heated pistons includes a plurality of spring-biased heating elements.

57. The filling and sealing machine of claim 56 wherein one end of said plurality of heated pistons are pivotable.

58. The filling and sealing machine of claim 57 wherein the end opposite the heated end of said plurality of heated pistons is pivotable.

59. The filling and sealing machine of claim 58 wherein each piston of said plurality of heated pistons includes a purge port.

* * * * *